US008862003B2

(12) United States Patent
Suzuki et al.

(10) Patent No.: US 8,862,003 B2
(45) Date of Patent: Oct. 14, 2014

(54) IMAGE FORMING APPARATUS

(71) Applicants: Hidemasa Suzuki, Kanagawa (JP); Koji Masuda, Kanagawa (JP)

(72) Inventors: Hidemasa Suzuki, Kanagawa (JP); Koji Masuda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 42 days.

(21) Appl. No.: 13/827,046

(22) Filed: Mar. 14, 2013

(65) Prior Publication Data

US 2013/0243458 A1 Sep. 19, 2013

(30) Foreign Application Priority Data

Mar. 14, 2012 (JP) ..... 2012-056604

(51) Int. Cl.
*G03G 15/00* (2006.01)
*G03G 15/01* (2006.01)

(52) U.S. Cl.
CPC .... *G03G 15/5033* (2013.01); *G03G 2215/0158* (2013.01); *G03G 15/5058* (2013.01); *G03G 15/0189* (2013.01)
USPC ..... 399/49; 399/72; 399/60

(58) Field of Classification Search
USPC ..... 399/49, 72, 60
See application file for complete search history.

(56) References Cited

U.S. PATENT DOCUMENTS

| | | | | |
|---|---|---|---|---|
| 5,838,024 | A | 11/1998 | Masuda et al. | |
| 5,962,874 | A | 10/1999 | Masuda et al. | |
| 6,188,086 | B1 | 2/2001 | Masuda et al. | |
| 6,456,314 | B1 | 9/2002 | Masuda | |
| 6,496,214 | B1 | 12/2002 | Masuda et al. | |
| 2001/0021067 | A1 | 9/2001 | Masuda | |
| 2002/0051052 | A1 | 5/2002 | Masuda et al. | |
| 2002/0057329 | A1 | 5/2002 | Masuda | |
| 2003/0007067 | A1 | 1/2003 | Masuda et al. | |
| 2003/0137577 | A1 | 7/2003 | Shinohara | |
| 2004/0008247 | A1 | 1/2004 | Masuda | |
| 2005/0067944 | A1 | 3/2005 | Masuda et al. | |
| 2005/0093963 | A1 | 5/2005 | Masuda | |
| 2008/0253793 | A1 * | 10/2008 | Ishibashi et al. | 399/74 |
| 2009/0015896 | A1 | 1/2009 | Masuda | |
| 2009/0238590 | A1 | 9/2009 | Masuda | |
| 2010/0008686 | A1 | 1/2010 | Masuda et al. | |
| 2010/0266302 | A1 | 10/2010 | Suzuki et al. | |
| 2011/0043810 | A1 | 2/2011 | Suzuki et al. | |
| 2011/0044713 | A1 | 2/2011 | Masuda et al. | |
| 2012/0051770 | A1 * | 3/2012 | Sasaki et al. | 399/49 |

(Continued)

FOREIGN PATENT DOCUMENTS

| | | |
|---|---|---|
| JP | 64-035466 | 2/1989 |
| JP | 2002-072612 | 3/2002 |

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

According to an embodiment, provided is an image forming apparatus that forms an image on a moving body using toner. The image forming apparatus includes a pattern creating device that creates a first pattern for toner density detection and a second pattern for positional deviation detection on the moving body, the first pattern and second pattern being disposed to be arrayed in a main-scanning direction; a reflecting optical sensor including an emitting system that includes at least three light-emitting elements of which positions at least in the second direction are different and a light-receiving system that includes at least three light-receiving elements that receive light beams that are emitted from the emitting system and reflected from the first pattern and second pattern; and a processing device that obtains toner density information and positional deviation information simultaneously based on an output signal of the light-receiving system.

10 Claims, 80 Drawing Sheets

(56) References Cited

U.S. PATENT DOCUMENTS

| | | | | |
|---|---|---|---|---|
| 2012/0268750 | A1 | 10/2012 | Masuda | |
| 2012/0321356 | A1* | 12/2012 | Sakamoto | 399/301 |

FOREIGN PATENT DOCUMENTS

| | | |
|---|---|---|
| JP | 2003-186278 | 7/2003 |
| JP | 2004-021164 | 1/2004 |
| JP | 2004-069805 | 3/2004 |
| JP | 2004-309292 | 11/2004 |
| JP | 2004-309293 | 11/2004 |
| JP | 2009-258601 | 11/2009 |
| JP | 2010-039460 | 2/2010 |
| JP | 2011-197342 | 10/2011 |
| JP | 2011-197346 | 10/2011 |
| JP | 2012-063569 | 3/2012 |
| JP | 2012-133065 | 7/2012 |

* cited by examiner

FIG.18

NO TONER

| | | | |
|---|---|---|---|
| 0 | 0 | 0 | 0 |
| 0 | 0 | 0 | 0 |
| 0 | 0 | 0 | 0 |
| 0 | 0 | 0 | 0 |

42.3 μm (IN THE CASE OF 600 dpi)

INTERMEDIATE COLOR 1

| | | | |
|---|---|---|---|
| 1 | 1 | 1 | 1 |
| 1 | 1 | 1 | 1 |
| 1 | 1 | 1 | 1 |
| 1 | 1 | 1 | 1 |

INTERMEDIATE COLOR 2

| | | | |
|---|---|---|---|
| 2 | 2 | 2 | 2 |
| 2 | 2 | 2 | 2 |
| 2 | 2 | 2 | 2 |
| 2 | 2 | 2 | 2 |

INTERMEDIATE COLOR 3

| | | | |
|---|---|---|---|
| 3 | 3 | 3 | 3 |
| 3 | 3 | 3 | 3 |
| 3 | 3 | 3 | 3 |
| 3 | 3 | 3 | 3 |

SOLID

| | | | |
|---|---|---|---|
| 4 | 4 | 4 | 4 |
| 4 | 4 | 4 | 4 |
| 4 | 4 | 4 | 4 |
| 4 | 4 | 4 | 4 |

0: EMISSION DUTY = 0%
1: EMISSION DUTY = 25%
2: EMISSION DUTY = 50%
3: EMISSION DUTY = 75%
4: EMISSION DUTY = 100%

RECTANGULAR PATTERN p1

RECTANGULAR PATTERN p3

RECTANGULAR PATTERN p5

FIG.60
| LIGHTING TARGET OBJECT | TRANSFER BELT | DP1_p1 | DP1_p2 | DP1_p3 | DP1_p4 | DP1_p5 |
|---|---|---|---|---|---|---|
| COEFFICIENT $\alpha$ | 1.000 | 0.708 | 0.346 | 0.168 | 0.047 | 0.000 |
| COEFFICIENT $\beta$ | 0.000 | 0.150 | 0.380 | 0.514 | 0.723 | 1.000 |
FIG.61A
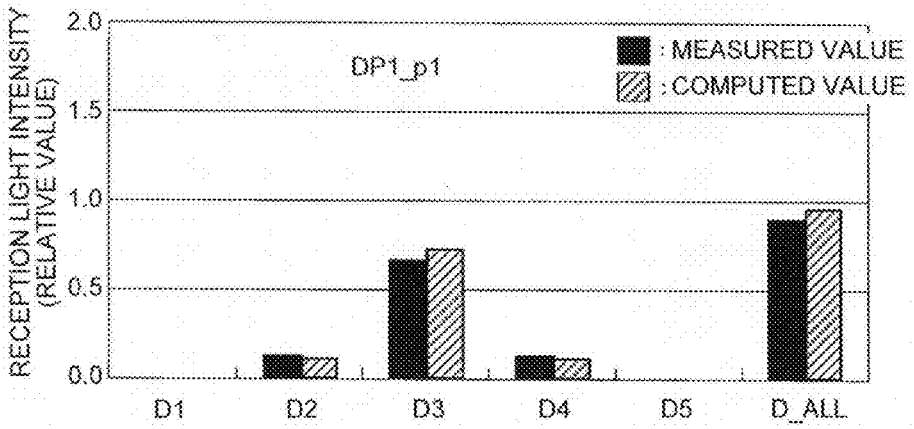
FIG.61B
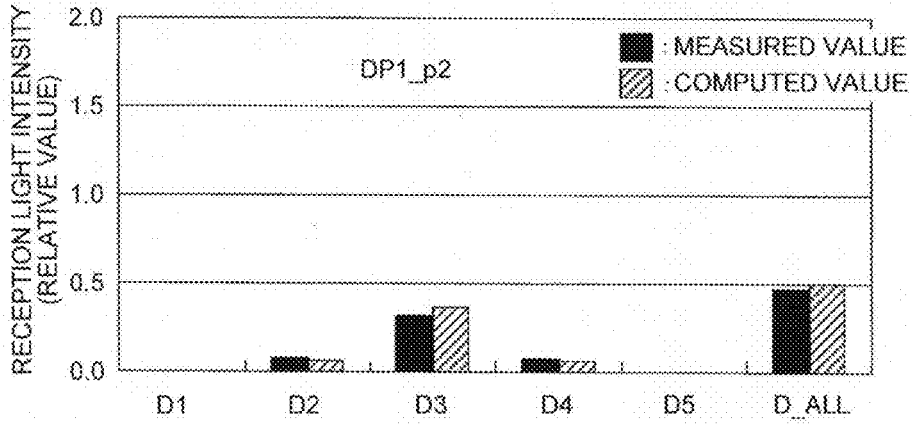

IMAGE FORMING APPARATUS

CROSS-REFERENCE TO RELATED APPLICATIONS

The present application claims priority to and incorporates by reference the entire contents of Japanese Patent Application No. 2012-056604 filed in Japan on Mar. 14, 2012.

BACKGROUND OF THE INVENTION

1. Field of the Invention

The present invention relates to an image forming apparatus, and more specifically, to an image forming apparatus that forms an image on a moving body using toner.

2. Description of the Related Art

Image forming apparatuses such as a copying machine, a printer, a facsimile, a plotter, and an MFP including at least one of them have been widely known. In these image forming apparatuses, in general, an electrostatic latent image is formed on a surface of a drum (hereinafter referred to as a "photosensitive drum" for the sake of convenience) having photosensitive properties, and toner is attached to the electrostatic latent image, whereby so-called developing is performed, and a "toner image" is obtained.

In an image forming apparatus, image density control as below is performed so that a stable image density is always obtained.

(1) A test pattern including a plurality of toner patches for toner density detection created with different image forming conditions (exposure power, charging bias, developing bias, and the like) is formed on a photosensitive drum so as to have different toner densities.

(2) A reflecting optical sensor which is an optical sensing unit receives a reflected light from each toner patch of the test pattern; and a toner density of each toner patch is calculated using the output of the reflecting optical sensor and a predetermined calculation algorithm.

(3) From the relation between the toner density of each toner patch and a developing potential obtained from the image forming conditions, a developing gamma $\gamma$ (an inclination between a developing potential on the horizontal axis and a toner density on the vertical axis) and a development start voltage Vk (an x-intercept when a developing potential is represented on the horizontal axis (x-axis) and a toner density is represented on the vertical axis) are obtained.

(4) Based on the obtained developing gamma $\gamma$, the image forming conditions such as an exposure power, a charging bias, a developing bias, and the like are adjusted so that the developing potential provides an appropriate toner density.

However, in an image forming process of a multi-color image forming apparatus, a plurality of toner images corresponding to each color such as black, magenta, cyan, and yellow, for example, are primarily transferred to an intermediate transfer belt in a superimposed manner, and is then secondarily transferred to a recording sheet in a lump; and the plurality of secondarily transferred toner images are fixed to the recording sheet, whereby a multi-color image is formed.

In this image forming process, since adjustment deviation of the optical scanning device (exposing device) and a plurality of photosensitive drums corresponding to each color and a variation of the photosensitive drum and respective driving mechanisms that drives the intermediate transfer belt appear as color deviation in a color image as they were, color deviation control is also indispensable.

As a specific method of color deviation control, in general, a test pattern for positional deviation detection of each color such as black, magenta, cyan, and yellow is formed on an intermediate transfer belt, the position of the test pattern of each color is read by a reflecting optical sensor, a positional deviation amount is calculated from the reading results and fed back to a writing time of image information, and color deviation on a recording sheet is corrected. A moving direction of a toner image on the intermediate transfer belt is referred to as a "sub-direction" and a direction orthogonal to the sub-direction is referred to as a "main direction."

Various reflecting optical sensors have been proposed (for example, see Japanese Patent Application Laid-open No. 1-35466, Japanese Patent Application Laid-open No. 2004-21164, Japanese Patent Application Laid-open No. 2002-72612, Japanese Patent No. 4154272, Japanese Patent No. 4110027). For example, examples of a conventional reflecting optical sensor include a 1-LED and 2-PD reflecting optical sensor including one light-emitting element and two light-receiving elements and a 2-LED and 1-PD reflecting optical sensor including two light-emitting elements and one light-receiving element.

In the 1-LED and 2-PD reflecting optical sensor, a light beam emitted from one light-emitting element to a test pattern forms one beam spots on an intermediate transfer belt. On the other hand, in the 2-LED and 1-PD reflecting optical sensor, light beams emitted from two light-emitting elements to a test pattern form two beam spots on approximately the same location on an intermediate transfer belt with a time difference. In any of the reflecting optical sensors, the size (spot diameter) of the beam spot was approximately 2 mm to 3 mm.

The respective test patterns for toner density detection and positional deviation detection are formed on an intermediate transfer belt so as to overlap a formation position of a beam spot in relation to a main direction and are moved in a sub-direction with movement of the intermediate transfer belt.

In this case, the beam spot and the test pattern need to overlap even if there are a mounting error of the reflecting optical sensor, a formation position error in the main direction of the beam spot resulting from deviation of a beam emission direction due to a mounting error of the light-emitting element, a formation position error of the test pattern, and a positional error in the main direction of the test pattern resulting from a skew of the intermediate transfer belt. Thus, the length of each test pattern in the main direction is set to be larger than the spot diameter.

For example, a test pattern for toner density detection includes a plurality of toner patches arrayed in a line along the sub-direction, and each toner patch has a length of approximately 10 mm in the main direction and a length of approximately 15 mm in the sub-direction. Further, a test pattern for positional deviation detection includes a plurality of linear patterns parallel and inclined to the main direction, and each linear pattern has a length of approximately 8 mm in the main direction and a length of approximately 1 mm in the sub-direction.

However, in an image forming apparatus including the conventional reflecting optical sensor, it is difficult to shorten the time necessary for detecting a toner density and a positional deviation.

SUMMARY OF THE INVENTION

It is an object to at least partially solve the problems in the conventional technology.

According to an embodiment, provided is an image forming apparatus that forms an image on a moving body using toner. The image forming apparatus includes a pattern creating device that creates a first pattern for toner density detection and a second pattern for positional deviation detection on the moving body, the first pattern and second pattern being disposed to be arrayed in a second direction orthogonal to a first direction in which the moving body moves; a reflecting optical sensor including an emitting system that includes at least three light-emitting elements of which positions at least in the second direction are different and a light-receiving system that includes at least three light-receiving elements that receive light beams that are emitted from the emitting system and reflected from the first pattern and second pattern; and a processing device that obtains toner density information and positional deviation information simultaneously based on an output signal of the light-receiving system.

The above and other objects, features, advantages and technical and industrial significance of this invention will be better understood by reading the following detailed description of presently preferred embodiment of the invention, when considered in connection with the accompanying drawings.

BRIEF DESCRIPTION OF THE DRAWINGS

FIG. 18 is an exemplary diagram for describing a case of realizing different toner density gradations in an analog manner;

FIG. 60 is an exemplary diagram for describing obtained coefficients $\alpha$ and $\beta$;

FIGS. 61A and 61B are first exemplary diagrams for describing a measured value and a calculated value;

DETAILED DESCRIPTION OF THE PREFERRED EMBODIMENTS

Figure 1:
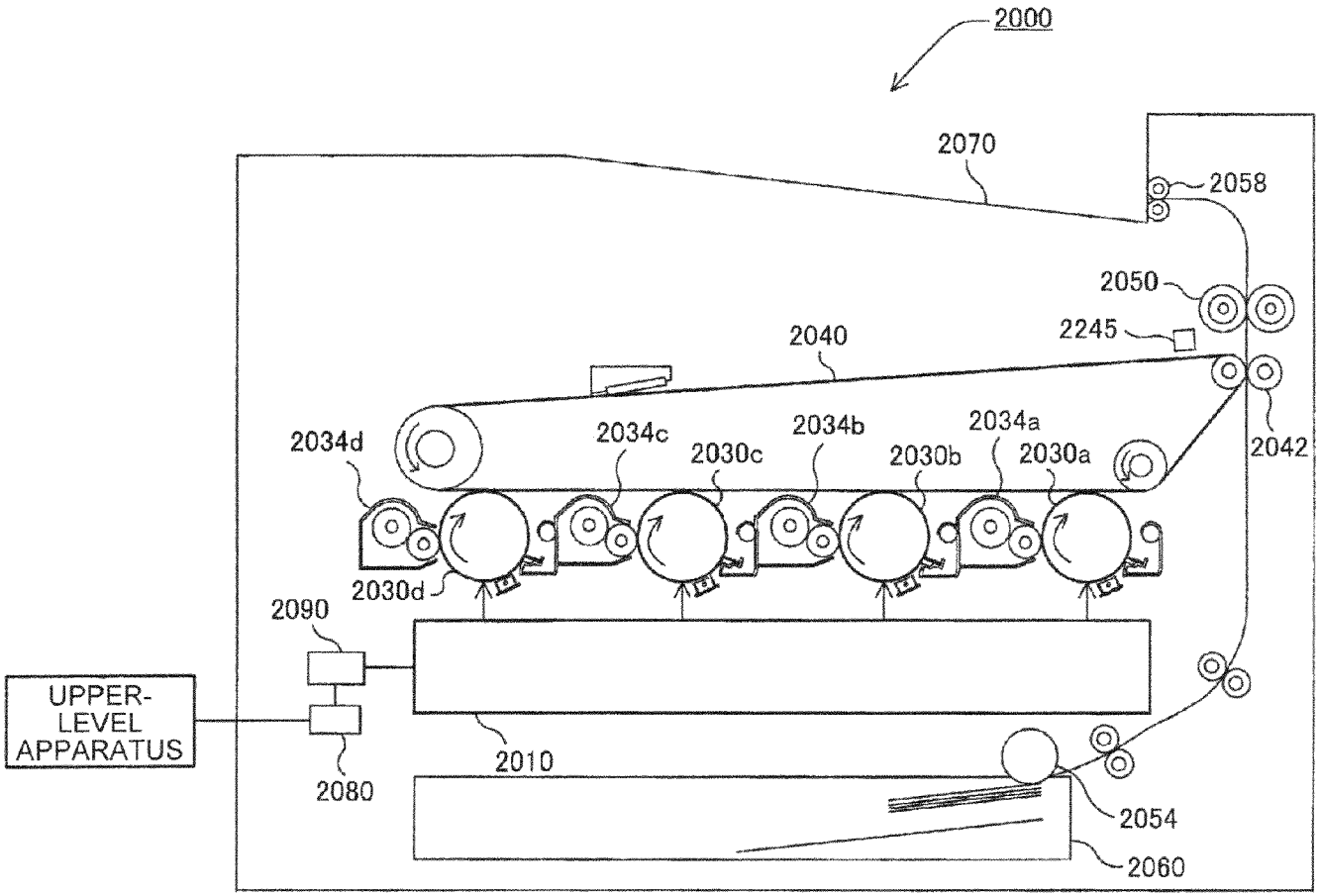
FIG. 1 is an exemplary diagram for describing a schematic configuration of a color printer according to an embodiment.

Hereinafter, an embodiment will be described with reference to FIGS. 1 to 70B. FIG. 1 illustrates a schematic configuration of a color printer 2000 according to an embodiment.

This color printer 2000 is a tandem-type multi-color printer that forms a full-color image by superimposing four colors (black, cyan, magenta, and yellow). The color printer includes an optical scanning device 2010, four photosensitive drums (2030*a*, 2030*b*, 2030*c*, and 2030*d*), four image forming units (2034*a*, 2034*b*, 2034*c*, and 2034*d*), a transfer belt 2040, a transfer roller 2042, a fixing roller 2050, a paper feeding roller 2054, a discharging roller 2058, a paper feed tray 2060, a discharge tray 2070, a communication control device 2080, a reflecting optical sensor 2245, a temperature and humidity sensor (not illustrated), a printer control device 2090 that integrally controls the respective units, and the like.

The communication control device 2080 controls bidirectional communication with a high-level apparatus (for example, a personal computer (PC)) via a network or the like and with an information device (for example, a facsimile apparatus (FAX)) via a public line. Moreover, the communication control device 2080 sends received information to the printer control device 2090.

Figure 2:
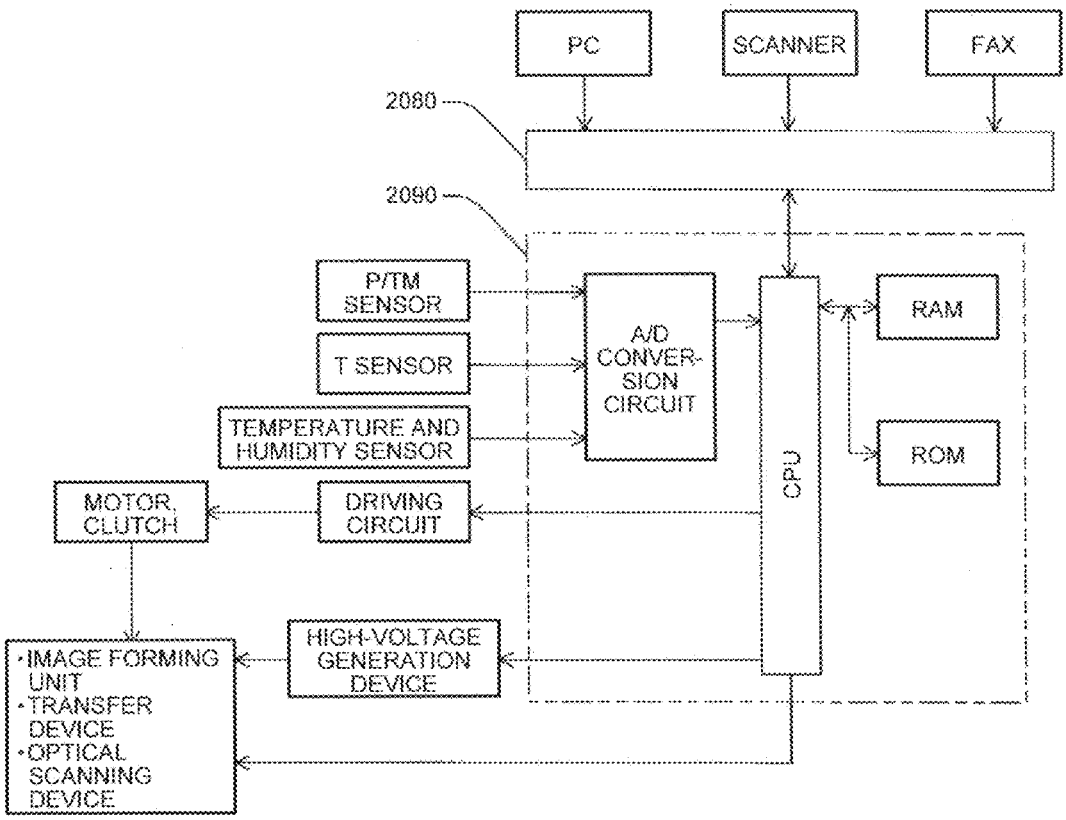
FIG. 2 is an exemplary diagram for describing a printer control device.

The printer control device 2090 includes a CPU, ROM in which a program described in codes that can be decoded by the CPU and various types of data used when executing the program are stored, RAM which is working memory, an A/D conversion circuit that converts analog data into digital data, and the like (see FIG. 2). Moreover, the printer control device 2090 controls respective units according to a request from the high-level apparatus and the information device and sends the image information from the high-level apparatus and the information device to the optical scanning device 2010.

The temperature and humidity sensor detects the temperature and humidity of the color printer 2000 and sends the detection results to the printer control device 2090.

The photosensitive drum 2030*a* and the image forming unit 2034*a* are used as a pair and form an image forming station (hereinafter referred to as a "K-station" for the sake of convenience) that forms a black image.

The photosensitive drum 2030*b* and the image forming unit 2034*b* are used as a pair and form an image forming station (hereinafter referred to as an "M-station" for the sake of convenience) that forms a magenta image.

The photosensitive drum 2030*c* and the image forming unit 2034*c* are used as a pair and form an image forming station (hereinafter referred to as a "C-station" for the sake of convenience) that forms a cyan image.

The photosensitive drum 2030*d* and the image forming unit 2034*d* are used as a pair and form an image forming station (hereinafter referred to as a "Y-station" for the sake of convenience) that forms a yellow image.

All of the photosensitive drums have a photosensitive layer formed on the surface thereof. That is, the surface of each photosensitive drum is a scanning surface. Each photosensitive drum rotates in the direction indicated by an arrow within the plane of FIG. 1 by a rotating mechanism (not illustrated).

Figure 3:
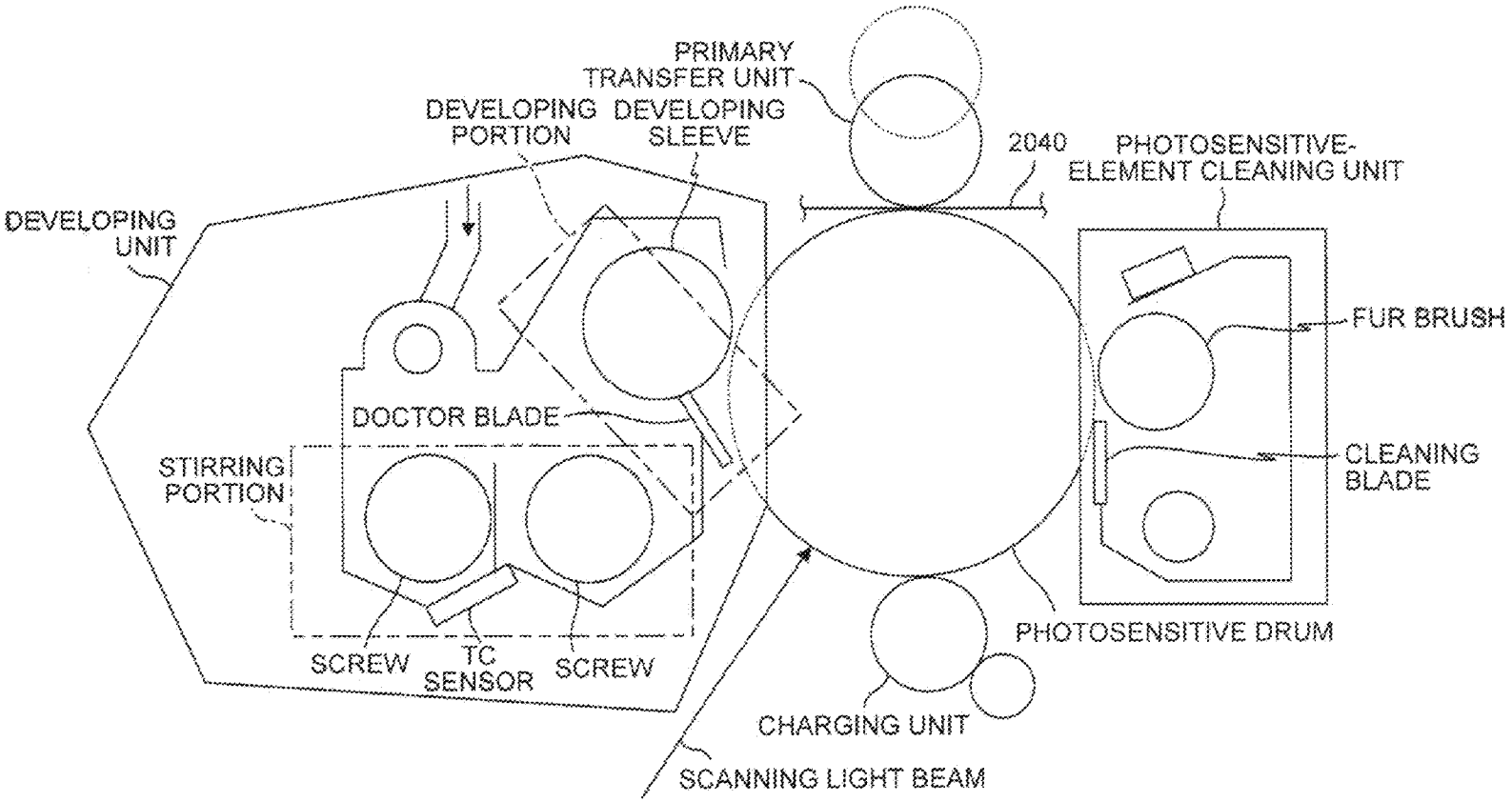
FIG. 3 is an exemplary diagram for describing an image forming unit.
Figure 4:
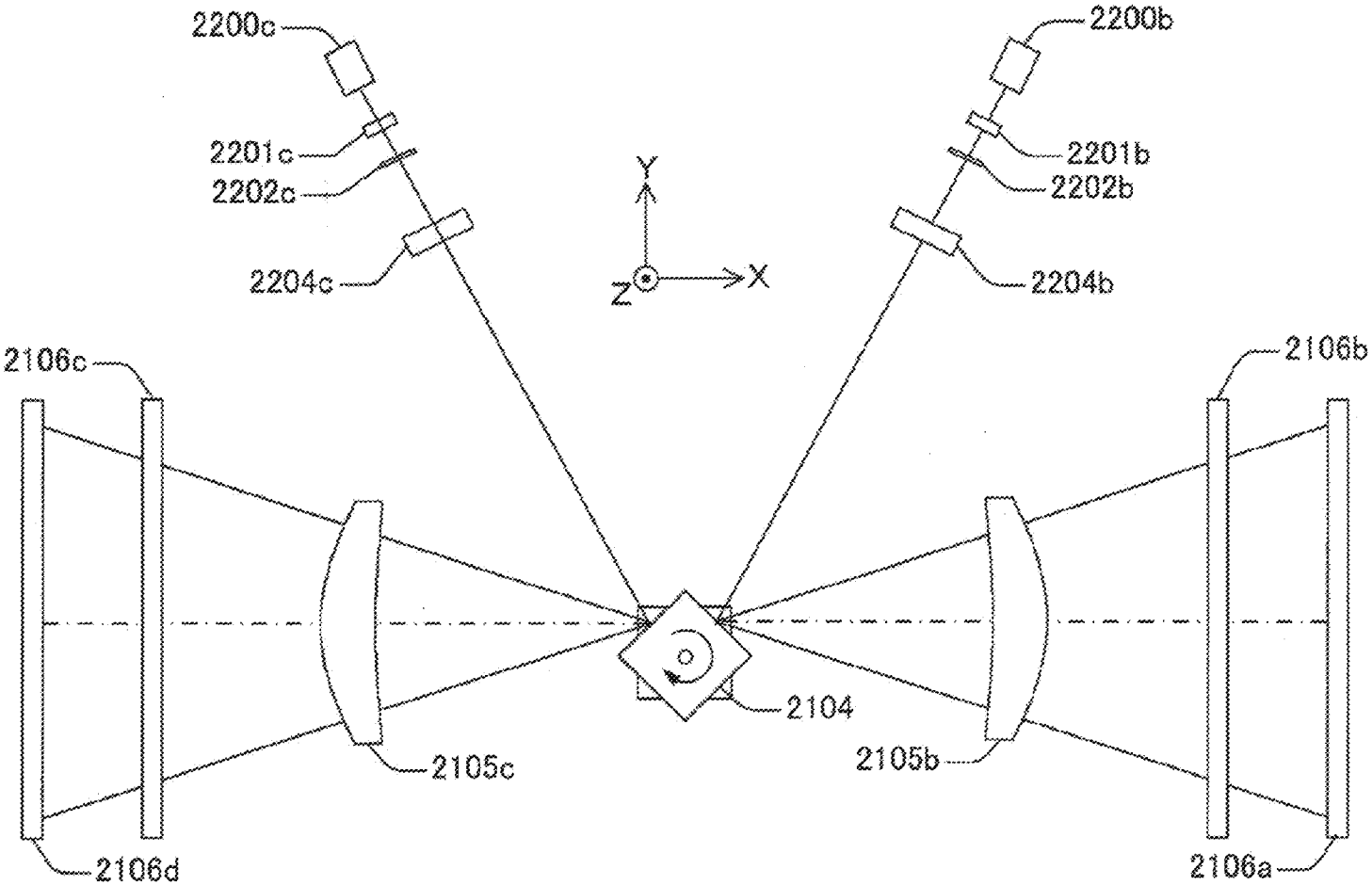
FIG. 4 is a first exemplary diagram for describing a schematic configuration of an optical scanning device.
Figure 5:
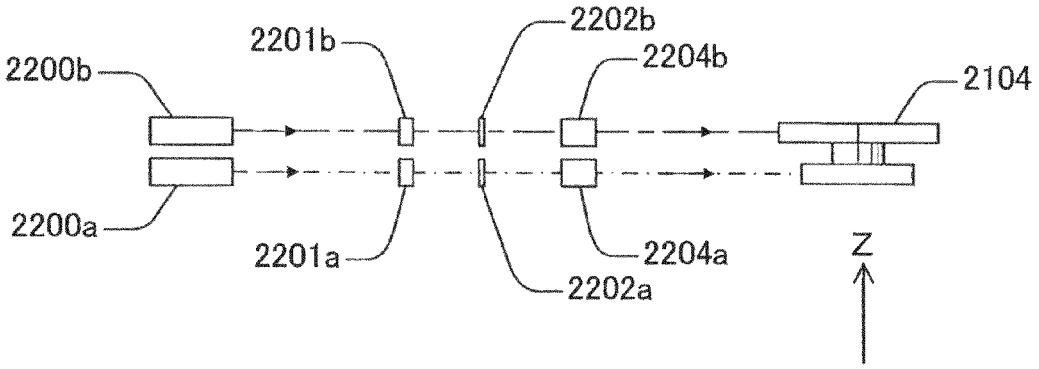
FIG. 5 is a second exemplary diagram for describing a schematic configuration of the optical scanning device.
Figure 6:
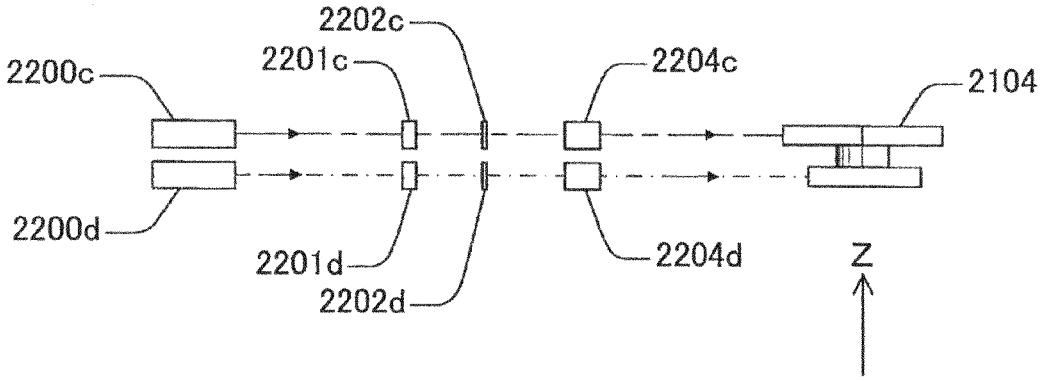
FIG. 6 is a third exemplary diagram for describing a schematic configuration of the optical scanning device.
Figure 7:
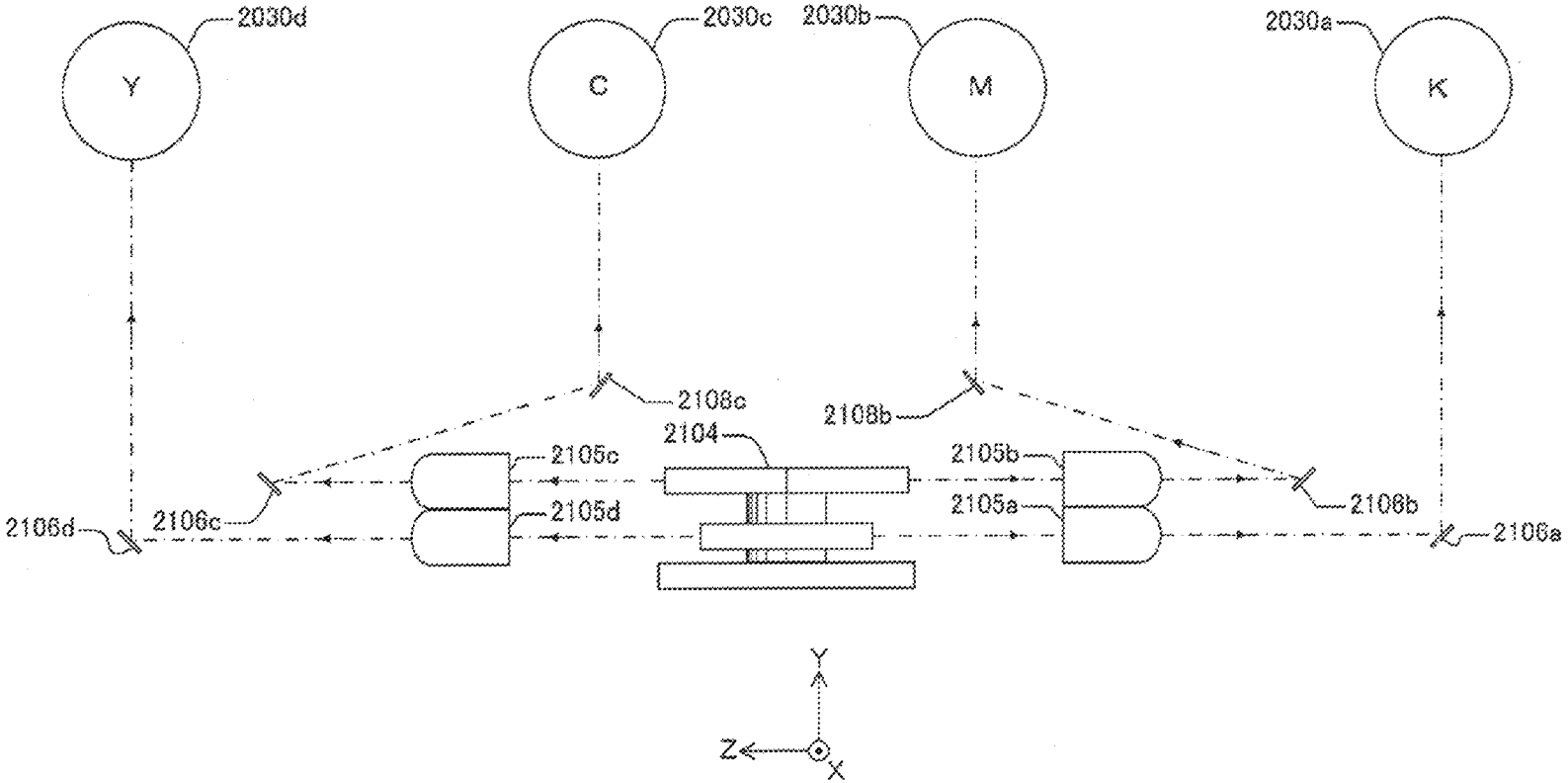
FIG. 7 is a fourth exemplary diagram for describing a schematic configuration of the optical scanning device.

As an example, as illustrated in FIG. 3, each image forming unit includes a charging unit, a developing unit, a primary transfer unit, and a photosensitive-element cleaning unit which are provided around the corresponding photosensitive drum.

In this embodiment, a contact charging roller is used as the charging unit. The charging roller applies a voltage by making contact with the photosensitive drum so that the surface of the photosensitive drum is charged uniformly. A non-contact charging unit such as a non-contact scorotron charger may be used as the charging unit.

The developing unit uses a two-component developer made up of a magnetic carrier and a non-magnetic toner. This developing unit can be roughly classified into a stirring portion and a developing portion that are provided in a developing case.

In the stirring portion, a two-component developer is stirred and conveyed, and is then supplied onto a developing sleeve serving as a developer carrier. This stirring portion includes two parallel screws, and a partition plate is provided between the two screws so that both end portions thereof communicate. Further, a TC sensor for detecting a toner density of developer in the developing unit is attached to the developing case. Since the carrier of the two-component developer is a magnetic substance and the toner is a non-magnetic substance, a permeability-type TC sensor is used as the TC sensor, and the toner density in the developing unit is expressed as the permeability of the developer, that is, a magneto-resistance per unit volume. A mono-component developer may be used as the developer.

In the developing portion, toner within the developer attached to the developing sleeve is transferred to the photosensitive drum. The developing portion includes a developing sleeve that faces the photosensitive drum through an opening of the developing case and a doctor blade disposed so that a leading end thereof approaches the developing sleeve. Moreover, a magnet (not illustrated) is fixed and disposed in the developing sleeve.

In the developing unit, developer is conveyed and circulated while being stirred by two screws, and is then supplied to the developing sleeve. The developer supplied to the developing sleeve is pumped up and held by the magnet. The developer pumped up by the developing sleeve is conveyed with rotation of the developing sleeve and is regulated to an appropriate amount by the doctor blade. A surplus developer is returned to the stirring portion.

The developer conveyed to a developing region that faces the photosensitive drum in this manner is caused to stand up due to the magnet and forms a magnetic brush. In the developing region, a developing bias applied to the developing sleeve forms a developing electric field that moves the toner in the developer to an electrostatic latent image portion on the photosensitive drum. Due to this, the toner in the developer is transferred to the electrostatic latent image portion on the photosensitive drum and visualizes the electrostatic latent image on the photosensitive drum.

When the developer having passed through the developing region is conveyed up to a weak magnetic portion of the magnet, the developer is separated from the developing sleeve and returned to the stirring portion. When such an operation is repeated, and the toner density in the stirring portion decreases, the TC sensor detects the toner density, and toner is supplied from a toner cartridge (not illustrated) to the stirring portion based on the detection results.

Moreover, the primary transfer unit is provided at such a position as to face the corresponding photosensitive drum with the transfer belt 2040 interposed.

In this embodiment, a primary transfer roller is used as the primary transfer unit. The primary transfer roller is provided such that the photosensitive drum is pressed with the transfer belt 2040 interposed. A conductive brush-shaped one, a non-contact corona charger, and the like other than the roller-shaped one may be used as the primary transfer unit.

The photosensitive-element cleaning unit includes a cleaning blade (for example, made from polyurethane rubber) disposed so that a leading end presses the photosensitive drum and a conductive fur brush disposed in contact with the photosensitive drum. A bias voltage is applied to the fur brush from a metallic electric-field roller (not illustrated), and a leading end of a scraper (not illustrated) is pressed to the electric-field roller. Moreover, toner removed from the photosensitive drum by the cleaning blade and the fur brush is stored inside the photosensitive-element cleaning unit and is collected in a waste toner collecting unit (not illustrated).

Returning to FIG. 1, the optical scanning device 2010 scans the surface of the corresponding charged photosensitive drum using a light beam that is modulated for each color based on multi-color image information (image information of black, cyan, magenta, and yellow) from the printer control device 2090. Due to this, an electrostatic latent image corresponding to the image information is formed on the surface of each photosensitive drum. The electrostatic latent image formed in this manner is moved in the direction toward the corresponding developing unit with rotation of the photosensitive drum and is visualized by the developing unit. The image (toner image) to which toner is attached is moved in the direction toward the transfer belt 2040 with rotation of the photosensitive drum. The configuration of the optical scanning device 2010 will be described later.

The toner images of yellow, magenta, cyan, and black are sequentially transferred to the transfer belt 2040 at predetermined timing and superimposed to form a multi-color color image.

A recording sheet is stored in the paper feed tray 2060. The paper feeding roller 2054 is disposed near the paper feed tray 2060, and the paper feeding roller 2054 feeds the recording sheet from the paper feed tray 2060 one by one. The recording sheet is conveyed toward the gap between the transfer belt 2040 and the transfer roller 2042 at predetermined timing. Due to this, the toner image on the transfer belt 2040 is transferred to the recording sheet. The recording sheet to which the toner image is transferred is conveyed to the fixing roller 2050.

In the fixing roller 2050, heat and pressure is applied to the recording sheet, and as a result, toner is fixed to the recording sheet. The recording sheet to which the toner is fixed is conveyed to the discharge tray 2070 with the aid of the discharging roller 2058 and is sequentially stacked on the discharge tray 2070.

The reflecting optical sensor 2245 is disposed near the transfer belt 2040. The reflecting optical sensor 2245 will be described later.

Next, the configuration of the optical scanning device 2010 will be described.

As illustrated in FIGS. 4 to 7, as an example, the optical scanning device 2010 includes four light sources (2200*a*, 2200*b*, 2200*c*, and 2200*d*), four coupling lenses (2201*a*, 2201*b*, 2201*c*, and 2201*d*), four aperture plates (2202*a*, 2202*b*, 2202*c*, and 2202*d*), four cylindrical lenses (2204*a*, 2204*b*, 2204*c*, 2204*d*), an optical deflector 2104, four scanning lenses (2105*a*, 2105*b*, 2105*c*, and 2105*d*), six reflecting mirrors (2106*a*, 2106*b*, 2106*c*, 2106*d*, 2108*b*, and 2108*c*), and a scanning control device (not illustrated), and the like.

In this embodiment, in an XYZ 3-dimensional orthogonal coordinate system, a direction along the longitudinal direction of each photosensitive drum will be described as an X-axis direction, and a direction of the rotation axis of the optical deflector 2104 will be described as a Z-axis direction.

Further, in the following description, for the sake of convenience, a direction corresponding to the main scanning direction will be referred to as a "main scanning corresponding direction," and a direction corresponding to the sub-scanning direction will be referred to as a "sub-scanning corresponding direction."

The light source 2200*a*, the coupling lens 2201*a*, the aperture plate 2202*a*, the cylindrical lens 2204*a*, the scanning lens 2105*a*, and the reflecting mirror 2106*a* are optical members for forming an electrostatic latent image on the photosensitive drum 2030*a*.

The light source 2200*b*, the coupling lens 2201*b*, the aperture plate 2202*b*, the cylindrical lens 2204*b*, the scanning lens 2105*b*, the reflecting mirror 2106*b*, and the reflecting mirror 2108*b* are optical members for forming an electrostatic latent image on the photosensitive drum 2030*b*.

The light source 2200*c*, the coupling lens 2201*c*, the aperture plate 2202*c*, the cylindrical lens 2204*c*, the scanning lens 2105*c*, the reflecting mirror 2106*c*, and the reflecting mirror 2108*c* are optical members for forming an electrostatic latent image on the photosensitive drum 2030*c*.

The light source 2200*d*, the coupling lens 2201*d*, the aperture plate 2202*d*, the cylindrical lens 2204*d*, the scanning lens 2105*d*, and the reflecting mirror 2106*d* are optical members for forming an electrostatic latent image on the photosensitive drum 2030*d*.

Each coupling lens is disposed on an optical path of light beams emitted from the corresponding light source so as to make the light beams become approximately parallel light beams.

Each aperture plate has an opening and shapes the light beam having passed through the corresponding coupling lens.

Each cylindrical lens provides the light beam having passed through the opening of the corresponding aperture plate at a position near a deflecting and reflecting surface of the optical deflector 2104 in relation to the sub-scanning corresponding direction so as to form an image.

The optical deflector 2104 has a polygon mirror having a two-stage structure. Each polygon mirror has a 4-faced deflecting and reflecting surface. The polygon mirrors are disposed so that a light beam from the cylindrical lens 2204*a* and a light beam from the cylindrical lens 2204*d* are deflected in the first-stage (lower stage) polygon mirror, and a light beam from the cylindrical lens 2204*b* and a light beam from the cylindrical lens 2204*c* are deflected in the second-stage (upper stage) polygon mirror. The first and second-stage polygon mirrors are rotated with a phase shift of approximately 45° C., and writing scanning is alternately performed in the first and second stages.

The light beam from the cylindrical lens 2204*a* deflected by the optical deflector 2104 is emitted to the photosensitive drum 2030*a* via the scanning lens 2105*a* and the reflecting mirror 2106*a*, and a beam spot is formed.

Further, the light beam from the cylindrical lens 2204*b* deflected by the optical deflector 2104 is emitted to the photosensitive drum 2030*b* via the scanning lens 2105*b* and two reflecting mirrors (2106*b*, 2108*b*), and a beam spot is formed.

Further, the light beam from the cylindrical lens 2204*c* deflected by the optical deflector 2104 is emitted to the photosensitive drum 2030*c* via the scanning lens 2105*c* and two reflecting mirrors (2106*c*, 2108*c*), and a beam spot is formed.

Further, the light beam from the cylindrical lens 2204*d* deflected by the optical deflector 2104 is emitted to the photosensitive drum 2030*d* via the scanning lens 2105*d* and the reflecting mirror 2106*d*, and a beam spot is formed.

The beam spot on each photosensitive drum moves in the longitudinal direction of the photosensitive drum with rotation of the optical deflector 2104. A moving direction of the beam spot on each photosensitive drum is a "main scanning direction," and a rotation direction of the photosensitive drum is a "sub-scanning direction." A region of each photosensitive drum in which image information is written is referred to as an "effective scanning direction," an "image forming region," or an "effective image region."

Further, an optical system disposed on the optical path between the optical deflector 2104 and each photosensitive drum is referred to as a scanning optical system.

Figure 8:
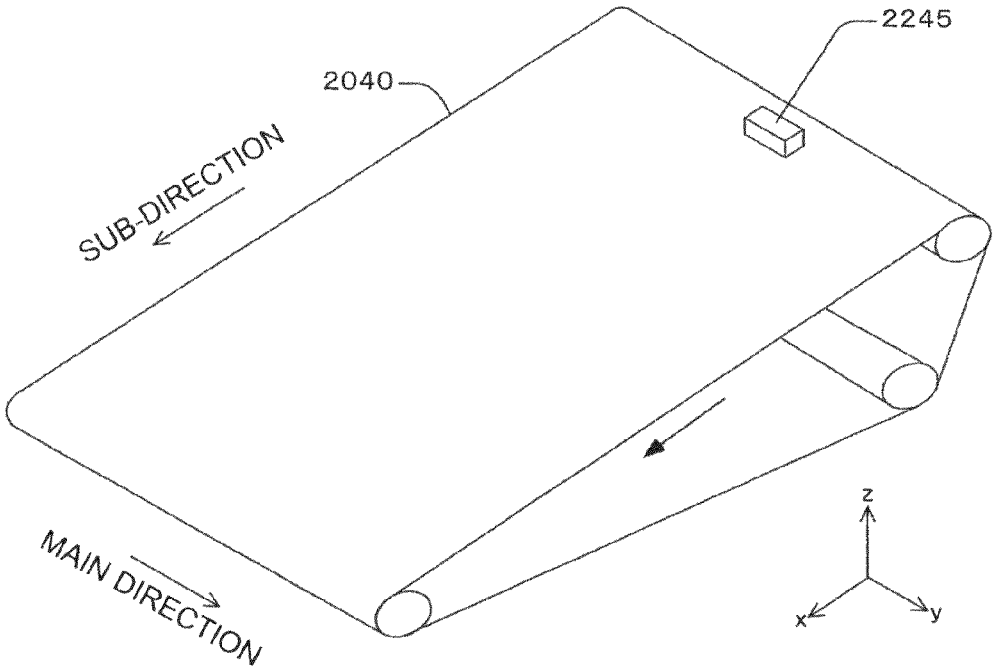
FIG. 8 is a first exemplary diagram for describing an arrangement position of a reflecting optical sensor.
Figure 9:
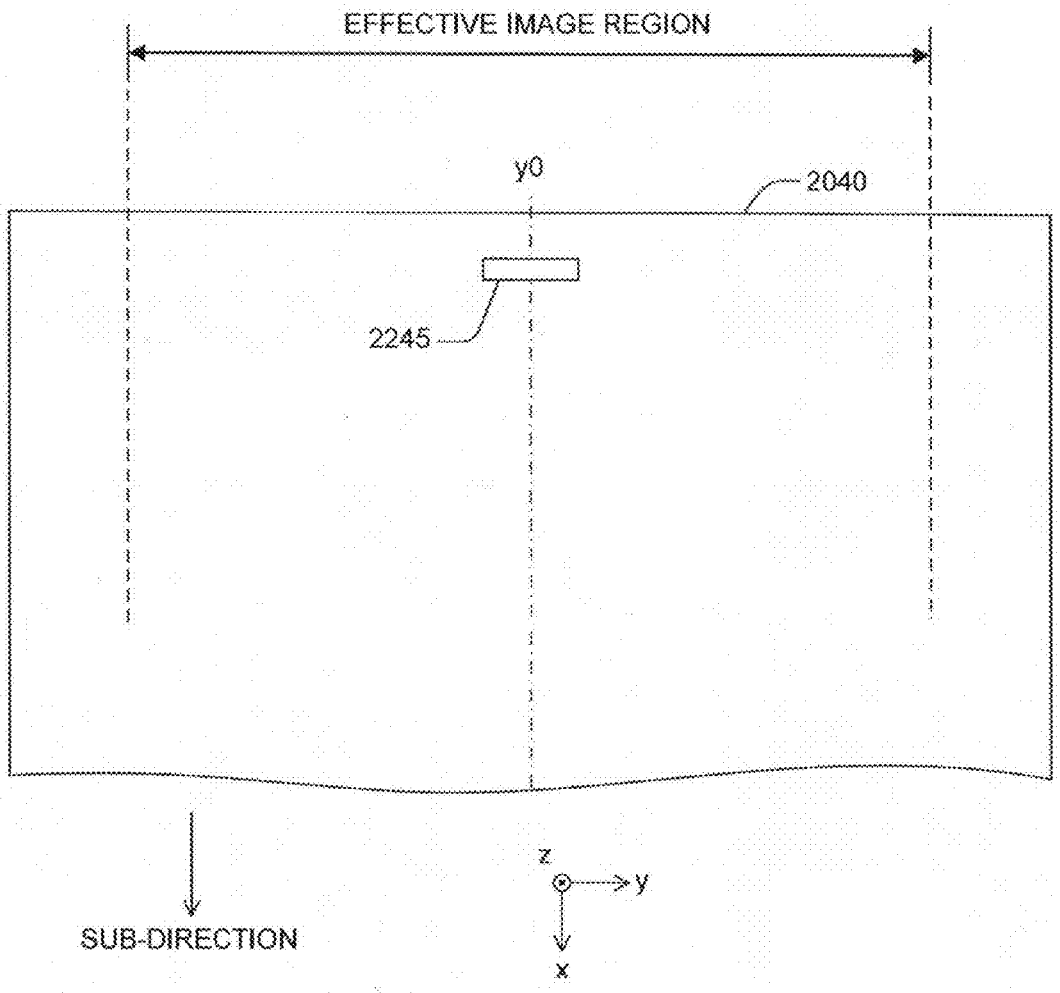
FIG. 9 is a second exemplary diagram for describing an arrangement position of the reflecting optical sensor.
Figure 10:
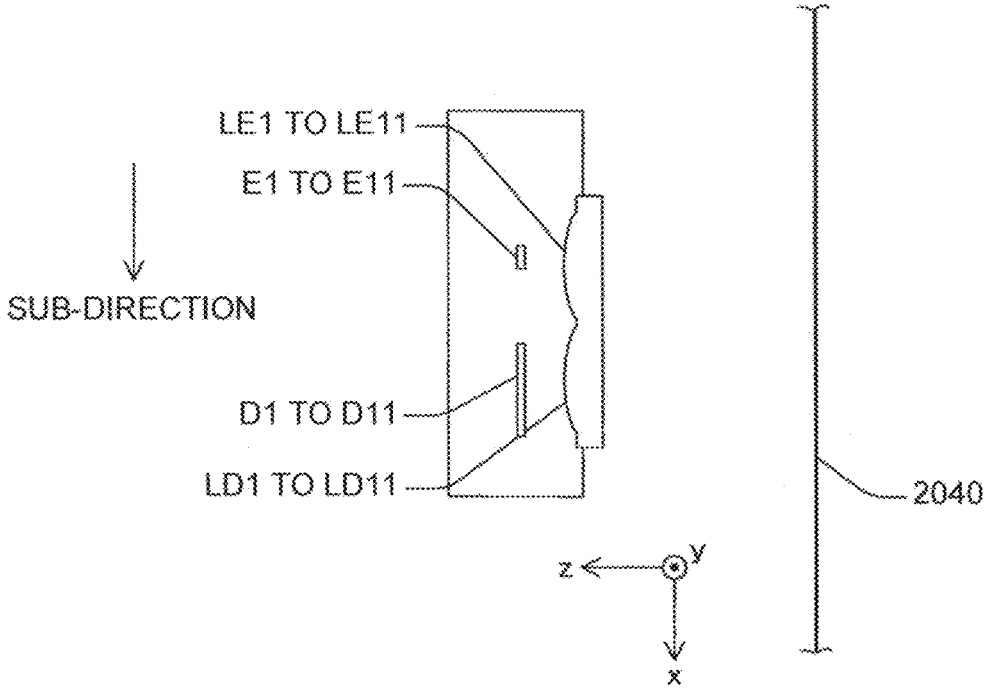
FIG. 10 is a first exemplary diagram for describing the reflecting optical sensor.
Figure 11:
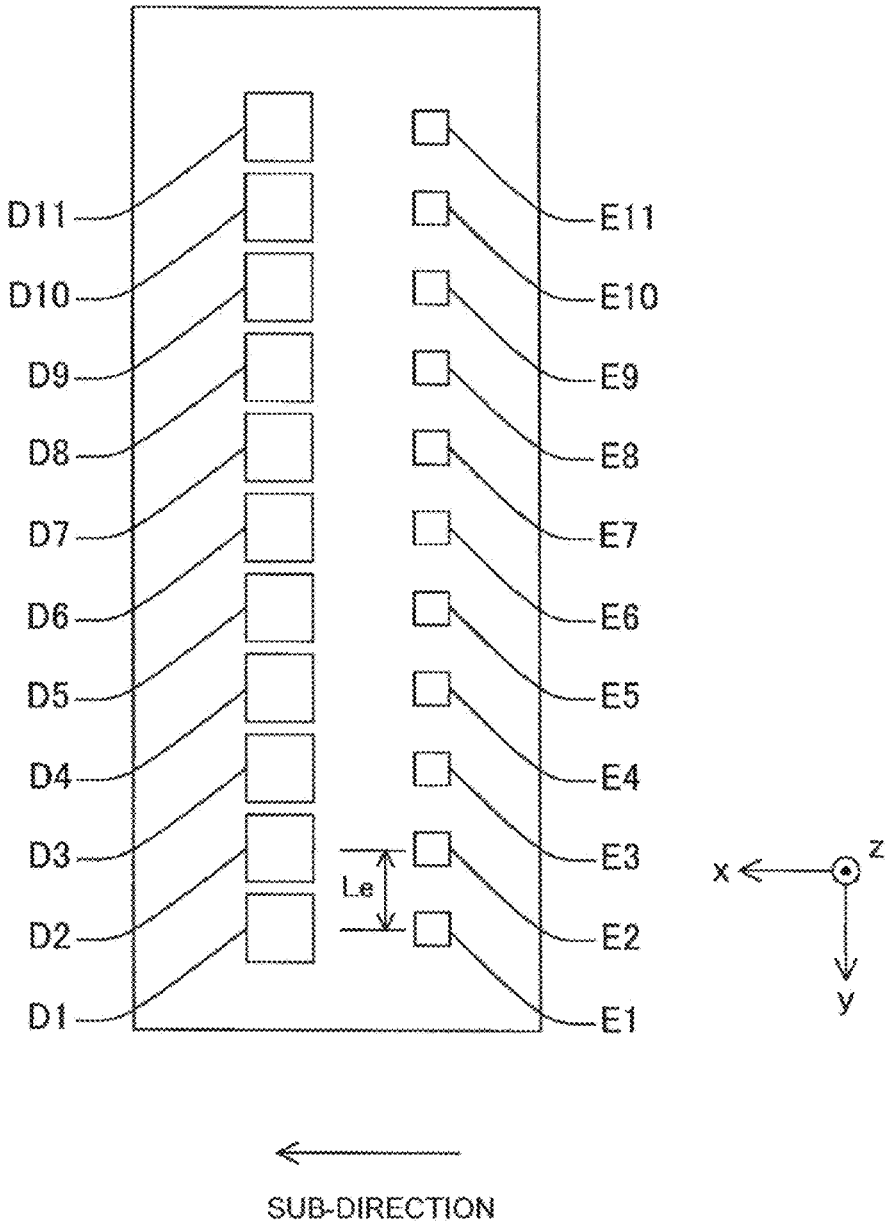
FIG. 11 is a second exemplary diagram for describing the reflecting optical sensor.
Figure 12:
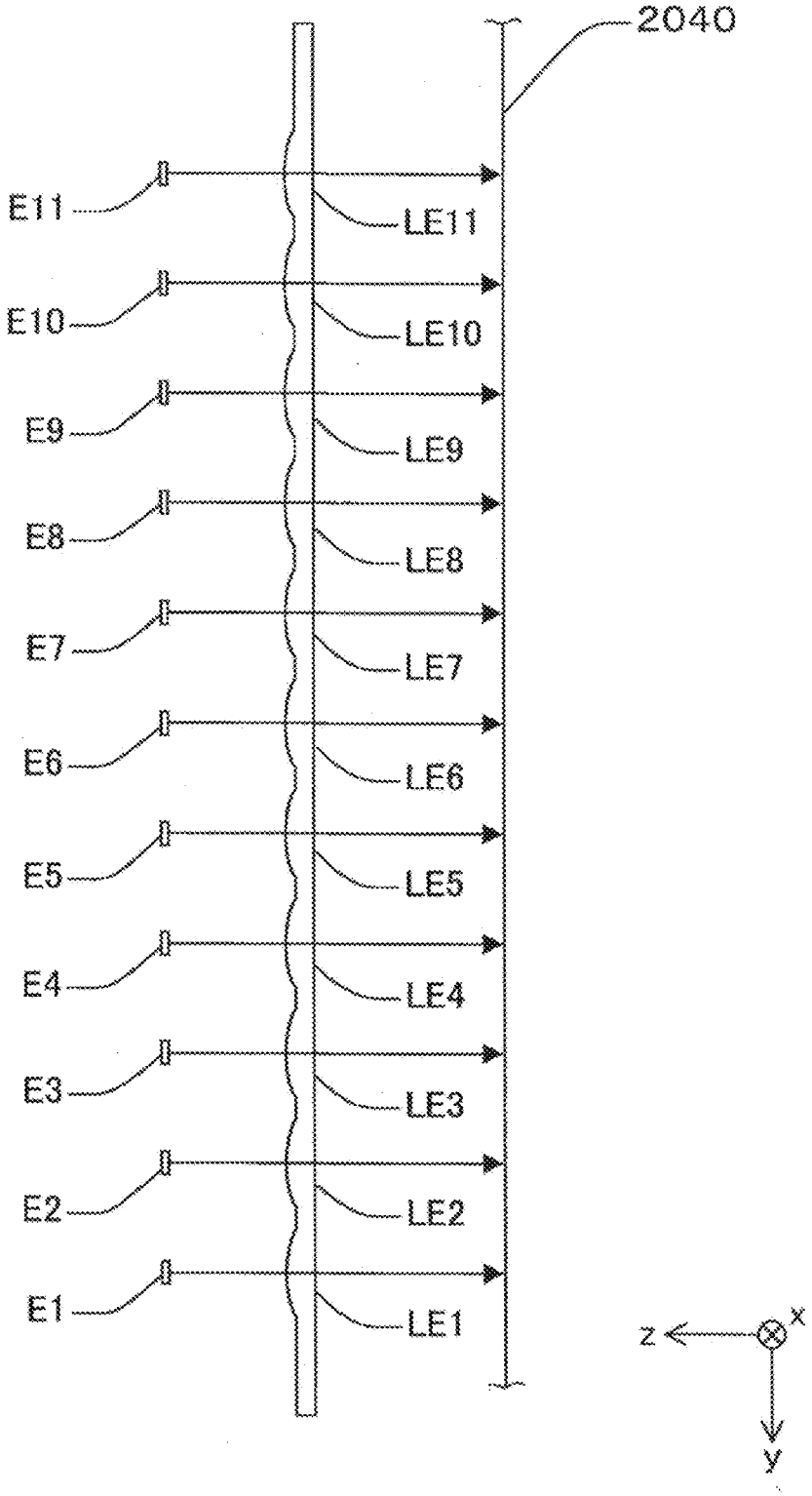
FIG. 12 is a third exemplary diagram for describing the reflecting optical sensor.
Figure 13:
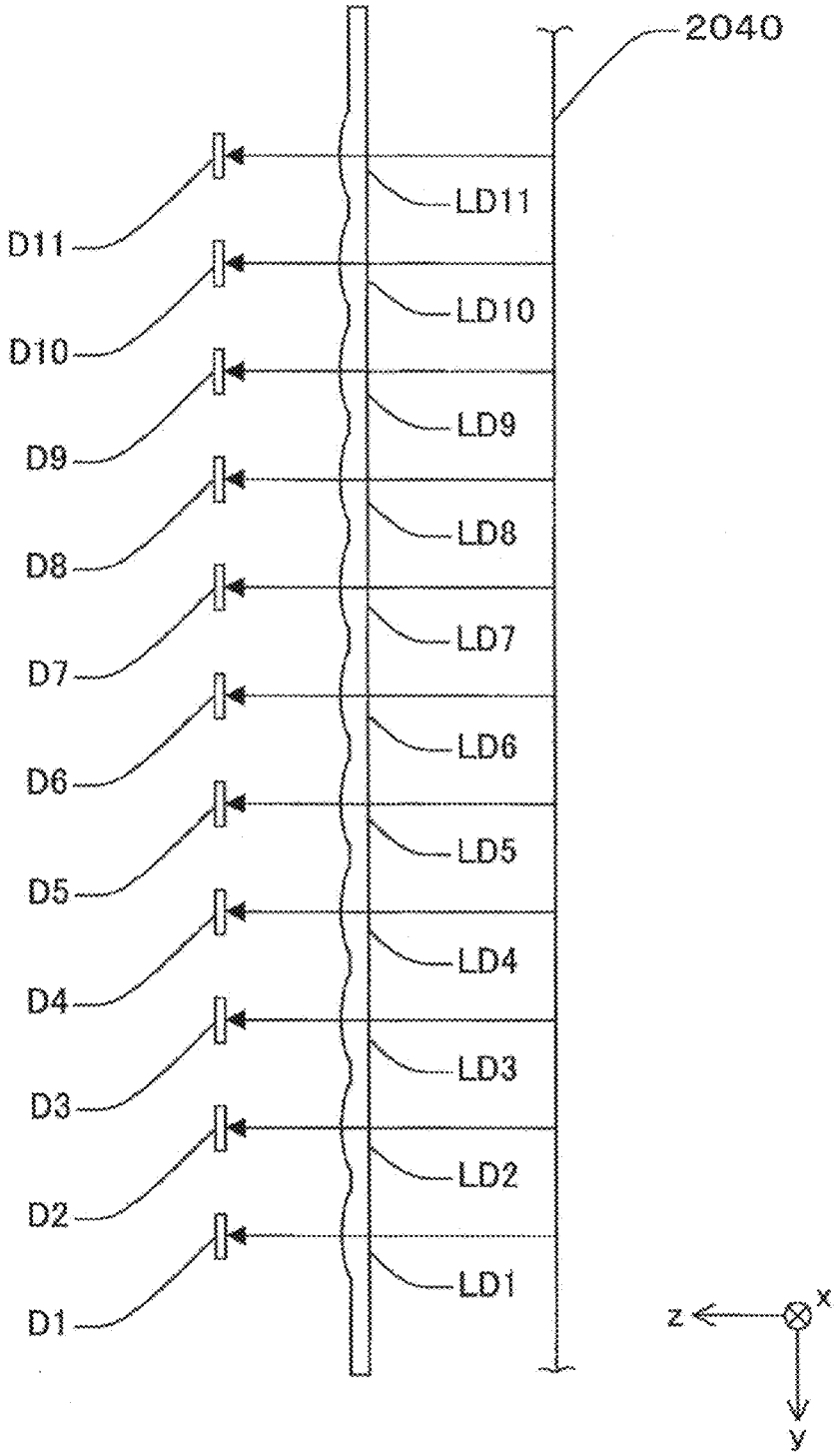
FIG. 13 is a fourth exemplary diagram for describing the reflecting optical sensor.

Next, the reflecting optical sensor 2245 will be described. In this embodiment, as an example, as illustrated in FIG. 8, it is assumed that in an xyz 3-dimensional orthogonal coordinate system, a moving direction of the transfer belt 2040, that is a sub-direction is an x-axis direction, and a main direction is a y-axis direction. It is also assumed that the reflecting optical sensor 2245 is disposed on the positive z-side of the transfer belt 2040. It is also assumed that the reflecting optical sensor 2245 is disposed at a position corresponding to the central position y0 of the transfer belt 2040 in relation to the y-axis direction (see FIG. 9). That is, the reflecting optical sensor 2245 is disposed at the position corresponding to the effective image region.

As illustrated in FIGS. 10 to 13, as an example, the reflecting optical sensor 2245 includes an emitting system including eleven light-emitting elements (E1 to E11), an illumination optical system including eleven illumination microlenses (LE1 to LE11), a light-receiving optical system including eleven light-receiving microlenses (LD1 to LD11), a light-receiving system including eleven light-receiving elements (D1 to D11), and the like.

The eleven light-emitting elements (E1 to E11) are disposed at an equal interval (center-to-center distance) Le along the main direction. A light-emitting diode (LED) can be used as the light-emitting elements. In this embodiment, Le=0.4 mm, for example. In this case, the center-to-center distance between the light-emitting element E1 and E11 is 4 mm (Le×10) in relation to the main direction. Further, the size of each light-emitting element in the main direction is approximately 0.04 mm. Furthermore, a wavelength of a light beam emitted from each light-emitting element is 850 nm. In the following description, for the sake of convenience, a light-emitting element that is lit is also referred to as a "lighting light-emitting element."

The eleven illumination microlenses (LE1 to LE11) individually correspond to the eleven light-emitting elements (E1 to E11).

Each illumination microlens guides the light beam emitted from the corresponding light-emitting element to be focused on the surface of the transfer belt 2040. Each illumination microlens has the same lens diameter, the same radius of lens curvature, and the same lens thickness. Further, the optical axis of each illumination microlens is parallel to a direction orthogonal to a light-exiting surface of the corresponding light-emitting element.

Figure 14:
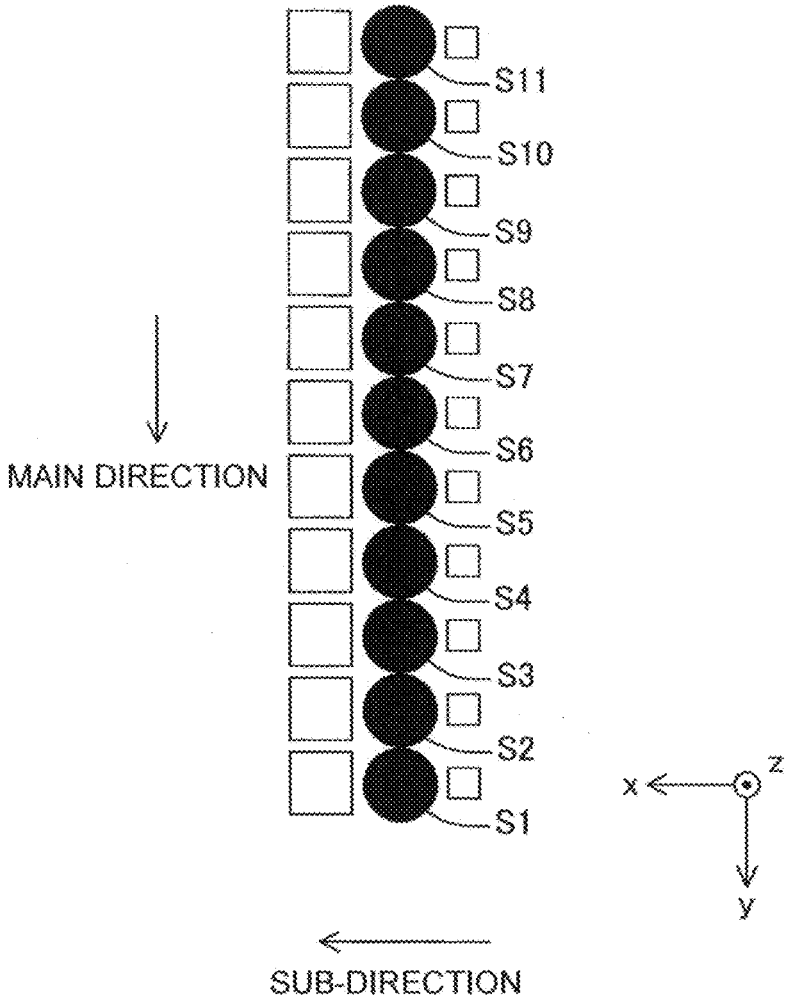
FIG. 14 is a diagram for describing a detection beam.

In this embodiment, to make the description better understood, it is assumed that only the light beams having emitted from each light-emitting element and passed through the corresponding illumination microlenses illuminate the transfer belt 2040 as detection beams (S1 to S11) (see FIG. 14). Moreover, the center of a beam spot (hereinafter also referred to as a "detection beam spot" for the sake of convenience) formed on the surface of the transfer belt 2040 by each detection beam is near the middle of the corresponding light-emitting element and the corresponding light-receiving element in relation to the sub-direction.

The size (diameter) of each detection beam spot is 0.40 mm, for example. This value is the same as the interval Le. The size (diameter) of the detection beam spot in the conventional reflecting optical sensor is generally approximately 2 mm to 3 mm.

Further, in this embodiment, the surface of the transfer belt 2040 is smooth, and a large part of the detection beams emitted to the surface of the transfer belt 2040 is regularly reflected.

The eleven light-receiving elements (D1 to D11) individually correspond to the light-emitting elements (E1 to E11). Each light-receiving element is disposed on the optical path of the light beam which is emitted from the corresponding light-emitting element and regularly reflected from the surface of the transfer belt 2040. Moreover, the center-to-center distance between adjacent two light-receiving elements in the main direction is the same as the interval Le. A photodiode (PD) can be used as the light-receiving elements. Each light-receiving element outputs a signal corresponding to a reception light intensity.

The eleven light-receiving microlenses (LD1 to LD11) individually correspond to the eleven light-receiving elements (D1 to D11) and each focuses the detection beam reflected from the transfer belt 2040 or the toner pattern on the transfer belt 2040. In this case, it is possible to increase the reception light intensity of each light-receiving element. That is, it is possible to improve detection sensitivity. Each light-receiving microlens has the same lens diameter, the same radius of lens curvature, and the same lens thickness.

A spherical lens having a focusing function in relation to the main direction and the sub-direction, a cylindrical lens having a positive power in relation to the sub-direction, an anamorphic lens having different powers in relation to the main direction and the sub-direction, and the like can be used as the microlenses.

In this embodiment, each microlens is a spherical lens, for example. Moreover, in each illumination microlens, an incidence-side optical surface has a focusing power, and an exit-side optical surface does not have a focusing power. Further, in each light-receiving microlens, an exit-side optical surface has a focusing power, and an incidence-side optical surface does not have a focusing power.

Specifically, each illumination microlens has a lens diameter of 0.415 mm, a radius of lens curvature of 0.430 mm, and a lens thickness of 1.229 mm. Each light-receiving microlens has a lens diameter of 0.712 mm, a radius of lens curvature of 0.380 mm, and a lens thickness of 1.419 mm.

In this embodiment, eleven illumination microlenses (LE1 to LE11) and eleven light-receiving microlenses (LD1 to LD11) are integrated to form a microlens array. Due to this, it is possible to improve workability in assembling the microlenses at a predetermined position. Further, it is possible to increase positional accuracy between lens surfaces of a plurality of microlenses. Each lens surface can be formed on a glass substrate or a resin substrate using a processing method such as photolithography or injection molding.

In the following description, light-emitting elements will be collectively denoted as a "light-emitting element Ei" when it is not necessary to distinguish between them. Moreover, an illumination microlens corresponding to the light-emitting element Ei will be denoted as an "illumination microlens LEi." Further, a light beam having been emitted from the light-emitting element Ei and passed through the illumination microlens LEi will be denoted as a "detection beam Si." Furthermore, a light-receiving element corresponding to the light-emitting element Ei will be denoted as a "light-receiving element Di." Furthermore, a light-receiving microlens corresponding to the light-receiving element Di will be denoted as a "light-receiving microlens LDi."

Figure 15:
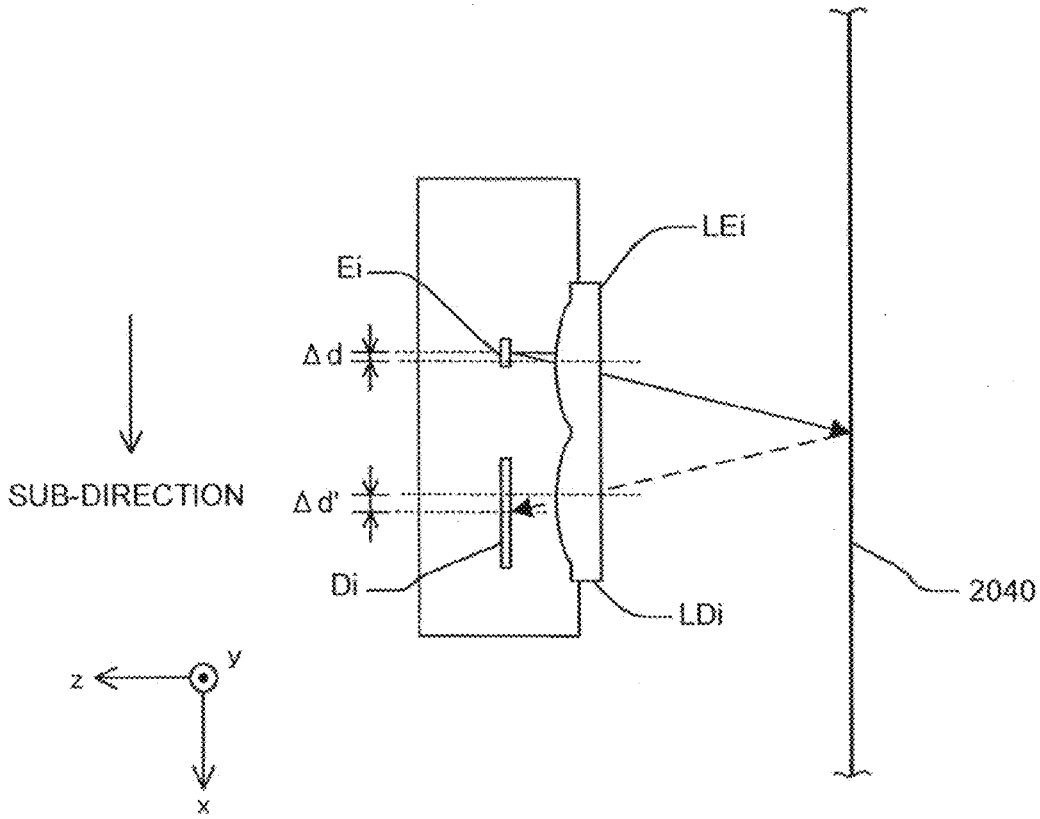
FIG. 15 is a fifth exemplary diagram for describing the reflecting optical sensor.

Moreover, as an example, as illustrated in FIG. 15, the optical axis of each illumination microlens is shifted by Δd (in this example, 0.035 mm) toward a light-receiving system in relation to an axis that passes through the center of the corresponding light-emitting element and is orthogonal to the light-exiting surface of the light-emitting element. Further, the optical axis of each light-receiving microlens is shifted by Δd' (in this example, 0.020 mm) toward an emitting system in relation to an axis that passes through the center of the corresponding light-receiving element and is orthogonal to the light-receiving surface of the light-receiving element. Due to this, it is possible to guide a larger amount of the reflected light to the corresponding light-receiving element.

Moreover, in relation to the sub-direction, a center-to-center distance between the illumination microlens LEi and the light-receiving microlens LDi is 0.445 mm, and a center-to-center distance between the light-emitting element Ei and the light-receiving element Di is 0.500 mm. Further, in relation to the sub-direction, a distance from the light-emitting element Ei to the illumination microlens LEi is 0.800 mm, and a distance from a negative z-side surface of each microlens to the surface of the transfer belt 2040 is 5 mm.

Next, a toner pattern serving as a test pattern which is a detection target object of the reflecting optical sensor 2245 will be described.

Figure 16:
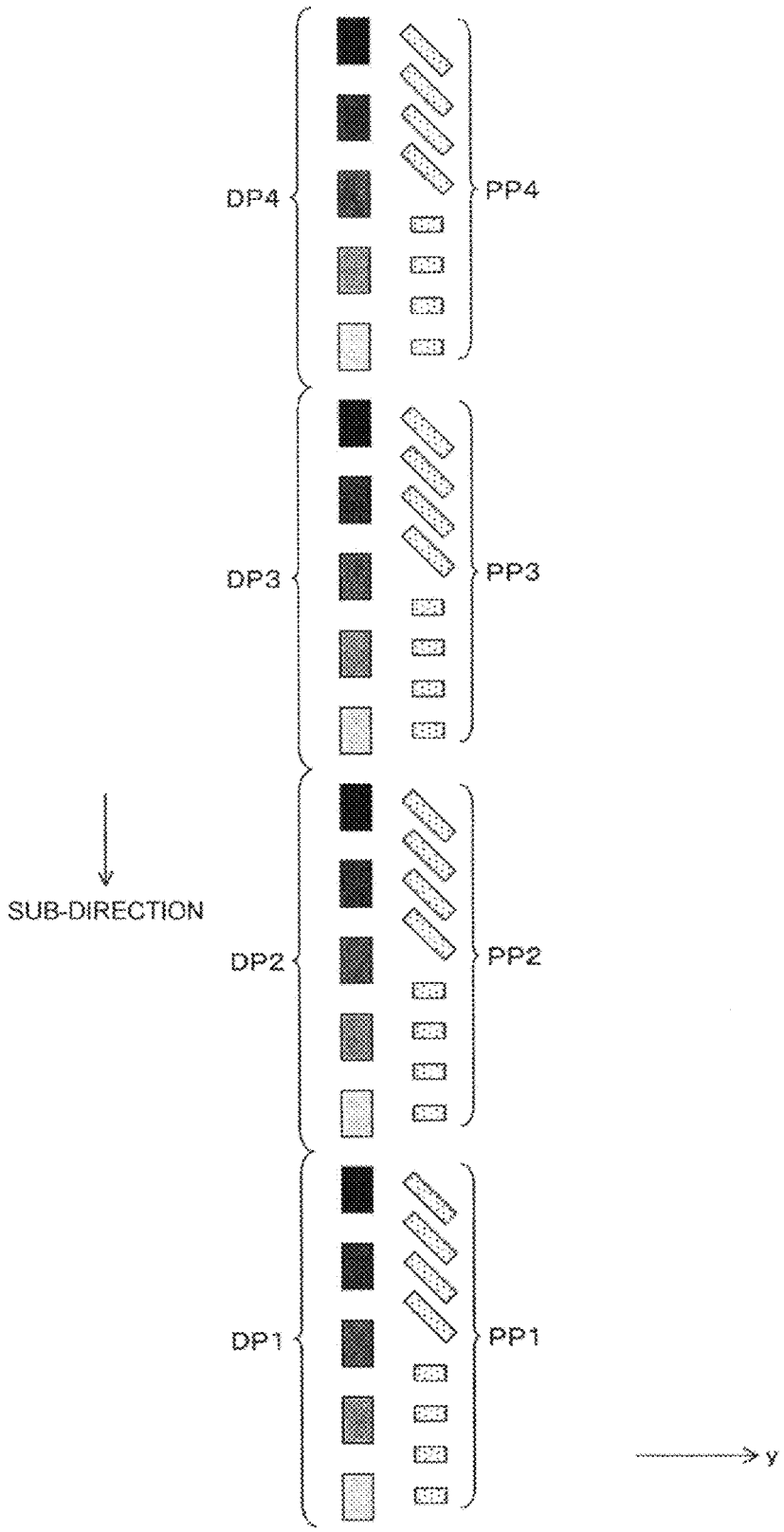
FIG. 16 is an exemplary diagram for describing a toner pattern formed on a transfer belt.

As an example, as illustrated in FIG. 16, this toner pattern includes eight patterns (DP1, DP2, DP3, DP4, PP1, PP2, PP3, and PP4).

DP1 to DP4 are density detection patterns, and PP1 to PP4 are positional deviation detection patterns.

The density detection pattern DP1 is formed using black toner, and the density detection pattern DP2 is formed using magenta toner. Moreover, the density detection pattern DP3 is formed using cyan toner, and the density detection pattern DP4 is formed using yellow toner. The density detection patterns DP1 to DP4 may be collectively referred to as a "density detection pattern DP" when it is not necessary to distinguish between them.

Figure 17:
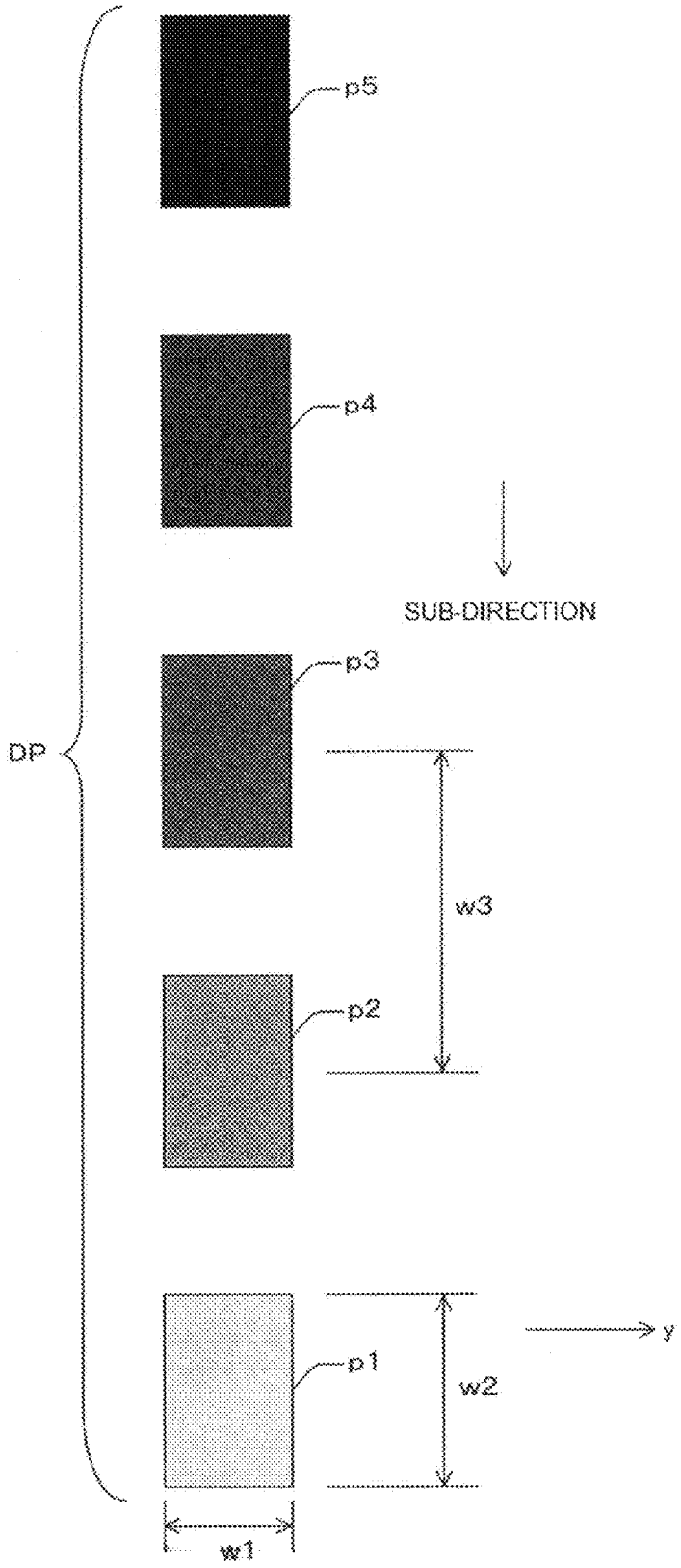
FIG. 17 is an exemplary diagram for describing five rectangular patterns of each density detection pattern.

As illustrated in FIG. 17, as an example, the density detection pattern DP includes five quadrangular patterns (p1 to p5, hereinafter referred to as "rectangular patterns" for the sake of convenience). The five rectangular patterns are arrayed in a line at an equal interval along the sub-direction, and the gradations of the respective toner densities thereof are different as a whole. In this example, the rectangular patterns are denoted by p1, p2, p3, p4, and p5 in ascending order of toner densities. That is, the toner density of the rectangular pattern p1 is lowest, and the toner density of the rectangular pattern p5 is highest. The rectangular pattern p5 is a so-called solid pattern that is created with the maximum toner attachment amount.

As a method of realizing different toner density gradations, there are methods of realizing the same in an analog manner and in a digital manner.

A method of realizing different toner density gradations in an analog manner will be described briefly. For example, a case of forming different density patterns (hereinafter also referred to "analog patterns") by changing an emission duty (Duty) of a semiconductor laser while fixing an emission intensity and a developing bias of the semiconductor laser used in forming electrostatic latent images will be considered.

FIG. 18 illustrates analog patterns of intermediate colors 1, 2, and 3 and a solid analog pattern and illustrates emission duties (Duty) of a semiconductor laser in each dot when a region of 4 dots by 4 dots is cut from an electrostatic latent image on a photosensitive drum. Here, the toner density increases in the order of intermediate color 1<intermediate color 2<intermediate color 3<solid. Further, a number "0" stands for an emission duty (Duty) of 0%, a number "1" stands for an emission duty (Duty) of 25%, a number "2" stands for an emission duty (Duty) of 50%, a number "3" stands for an emission duty (Duty) of 75%, and a number "4" stands for an emission duty (Duty) of 100%. During development, an amount of toner corresponding to an emission intensity, a developing bias, and an emission duty (Duty) of a semiconductor laser is attached. That is, a toner attachment amount has a relation of intermediate color 1<intermediate color 2<intermediate color 3<solid.

Thus, for any density of analog patterns, toner is attached to the entire region of the analog pattern. However, there may be a case where the emission duty (Duty) is extremely small and a case where toner is not attached to one dot region depending on the values of the emission intensity and the developing bias of the semiconductor laser.

Figure 19A:
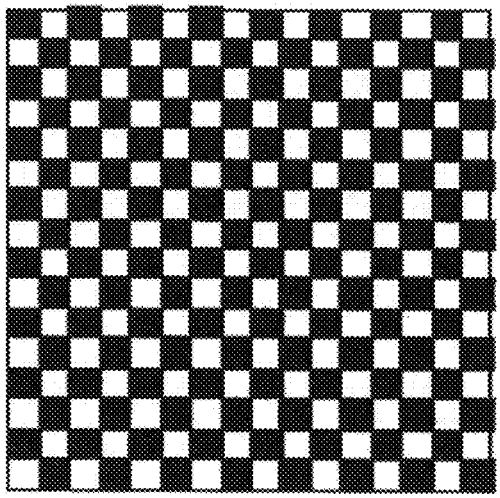
FIGS. 19A and 19B are exemplary diagrams for describing a case of realizing different toner density gradations in a digital manner.
Figure 19B:
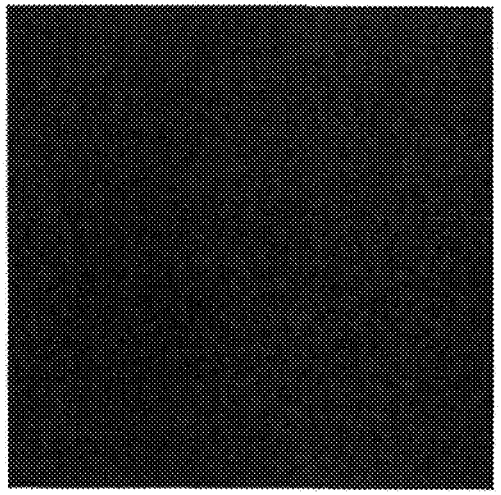
Figure 20A:
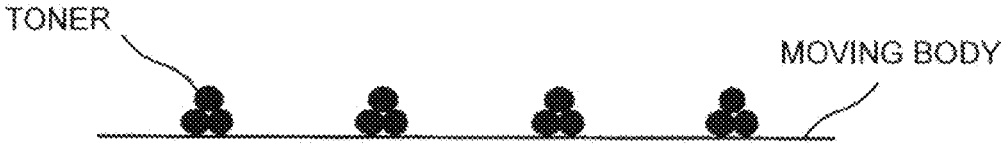
FIGS. 20A to 20C are exemplary diagrams for describing a toner attachment state of rectangular patterns p1, p3, and p5 for the case of realizing different toner density gradations in a digital manner.
Figure 20B:
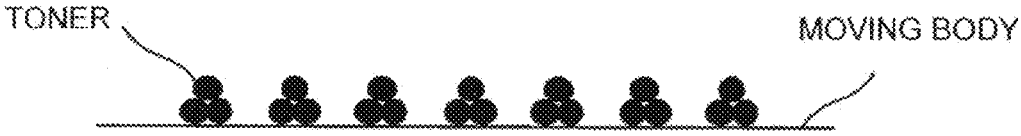
Figure 20C:
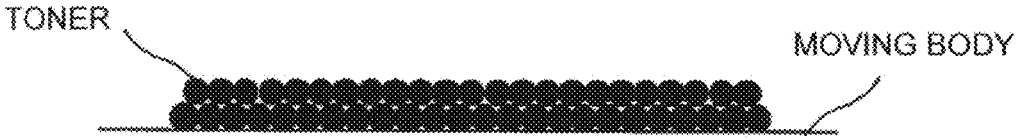

On the other hand, in the method of realizing different toner density gradations in a digital manner, the toner density gradation is made different according to the ratio between an area of a portion to which toner is attached and an area of the background (in this example, the surface of the transfer belt 2040) to which toner is not attached. That is, a so-called dither pattern is obtained. When an intermediate color obtained using a dither pattern is observed by magnifying the same using a magnifying lens or the like, as illustrated in FIG. 19A, in an optional region, it is possible to clearly distinguish between a region where toner is present and a region where toner is not present. FIG. 19B illustrates a solid pattern for that case. Further, a toner attachment state for the rectangular pattern p1 is illustrated in FIG. 20A, a toner attachment state for the rectangular pattern p3 is illustrated in FIG. 20B, and a toner attachment state for the rectangular pattern p5 is illustrated in FIG. 20C.

In this embodiment, an analog method is employed as the method of realizing different toner density gradations as an example.

Further, as an example, a length w1 in the main direction of each rectangular pattern is set to 1 mm, and a length w2 in the sub-direction is set to 2 mm. That is, the length w1 (=1 mm) in the main direction of each rectangular pattern is larger than the sum of the interval Le (=0.4 mm) and the size (=0.4 mm) of the detection beam spot. Moreover, in relation to the sub-direction, the center-to-center distance w3 of adjacent two rectangular patterns is 3 mm. Thus, the size (4×w3+w2) of a density detection pattern DP in the sub-direction is 14 mm.

A conventional density detection test pattern includes a plurality of toner patches arrayed in a line along the sub-direction, and each toner patch has a length of approximately 10 mm in the main direction and a length of approximately 15 mm in the sub-direction.

That is, in this embodiment, the size of the density detection pattern can be greatly decreased as compared to the conventional pattern in both the main direction and the sub-direction. Further, the amount of toner necessary for creating a density detection pattern can be decreased to approximately 1/100 of that of the conventional pattern. Thus, it is possible to greatly decrease the amount of non-contributing toner and to extend a replacement cycle of a toner cartridge.

Figure 21:
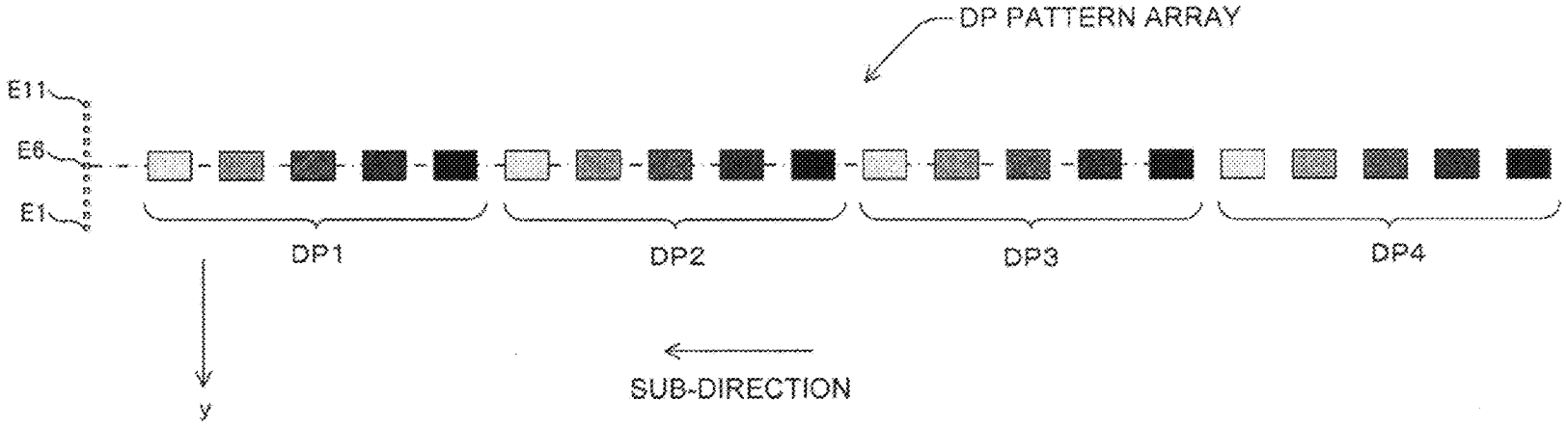
FIG. 21 is an exemplary diagram for describing a positional relation between a DP pattern array and a light-emitting element.
Figure 22:
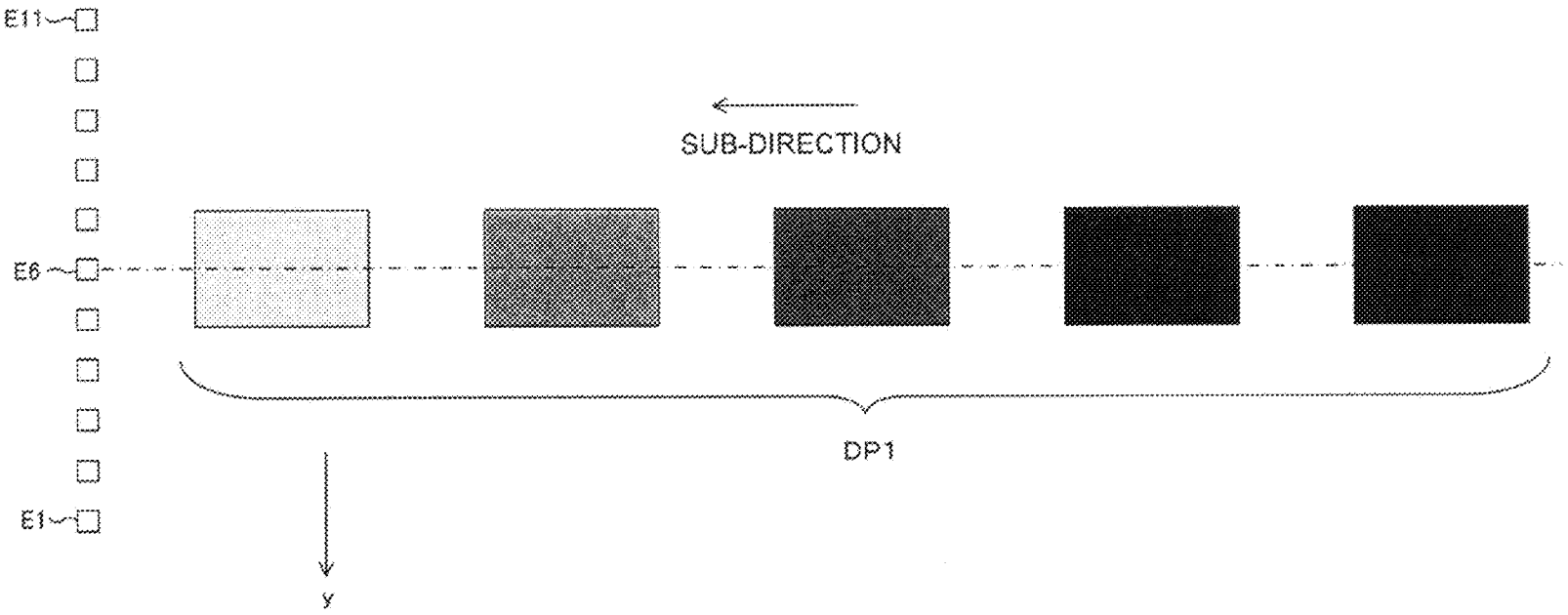
FIG. 22 is an exemplary diagram illustrating a part of FIG. 21 at an enlarged scale.

As an example, as illustrated in FIG. 21, four density detection patterns DP1 to DP4 are arrayed in a line along the sub-direction and are set to be formed at such positions that the patterns are illuminated by a detection beam S6 from the light-emitting element E6. FIG. 22 illustrates a part of FIG. 21 at an enlarged scale. In the following description, for the sake of convenience, an array of four density detection patterns DP1 to DP4 will be also referred to as a "DP pattern array."

Four positional deviation detection patterns PP1 to PP4 are the same patterns. Thus, the positional deviation detection patterns PP1 to PP4 will be also collectively referred to as a "positional deviation detection pattern PP" when it is not necessary to distinguish between them.

Figure 23:
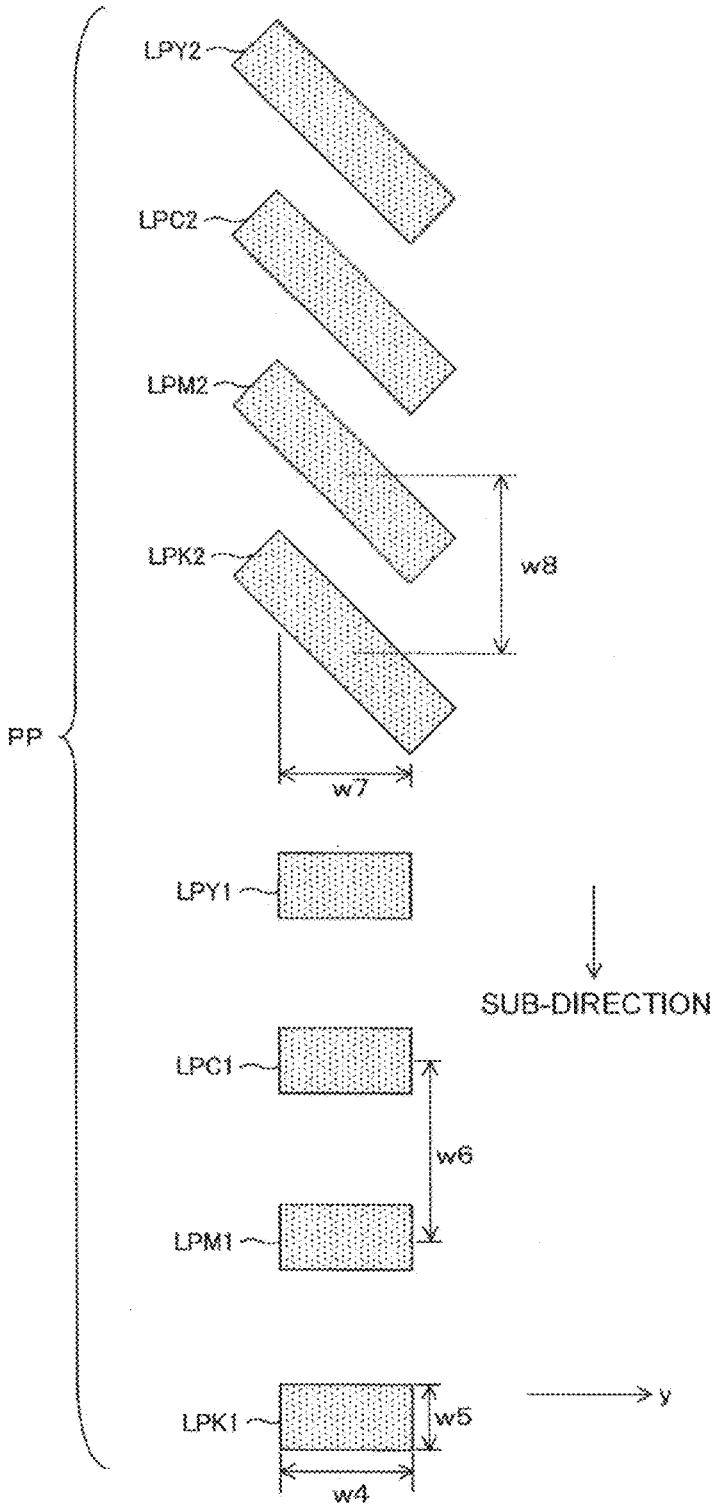
FIG. 23 is an exemplary diagram for describing respective positional deviation detection patterns.

As an example, as illustrated in FIG. 23, a positional deviation detection pattern PP includes eight linear patterns (LPK1, LPK2, LPM1, LPM2, LPC1, LPC2, LPY1, and LPY2) arrayed in a line along the sub-direction.

The linear patterns LPK1 and LPK2 are formed using black toner, and linear patterns LPM1 and LPM2 are formed using magenta toner. Further, the linear patterns LPC1 and LPC2 are formed using cyan toner, and linear patterns LPY1 and LPY2 are formed using yellow toner. In this example, each linear pattern is formed with a so-called solid density as a toner density.

A longitudinal direction of the linear patterns LPK1, LPM1, LPC1, and LPY1 is parallel to the main direction, and a longitudinal direction of the linear patterns LPK2, LPM2, LPC2, and LPY2 is inclined to the main direction. In this example, the inclination angle is set to 45°.

In the following description, linear patterns of which the longitudinal direction is parallel to the main direction will be also referred to as "parallel linear patterns," and linear patterns of which the longitudinal direction is inclined to the main direction will be also referred to as "inclined linear patterns."

Each parallel linear pattern has a length w4 of 1.0 mm in the longitudinal direction and a length w5 of 0.5 mm in the lateral direction. Moreover, a center-to-center distance w6 of adjacent two parallel linear patterns in the sub-direction is set to 1.5 mm.

Further, in each inclined linear pattern, a corner-to-corner distance w7 between two inner corners among the four corners in relation to the main direction is set to 1.0 mm, and a length in the lateral direction is set to 0.5 mm. Moreover, a center-to-center distance w8 of adjacent two inclined linear patterns in the sub-direction is set to 1.5 mm.

A conventional positional deviation detection test pattern includes a plurality of linear patterns that are parallel and inclined to the main direction, and each linear pattern has a length of approximately 8 mm in the main direction and a length of approximately 1 mm in the sub-direction. Moreover, a center-to-center distance of adjacent two linear patterns in the sub-direction is set to approximately 3.5 mm.

Figure 24:
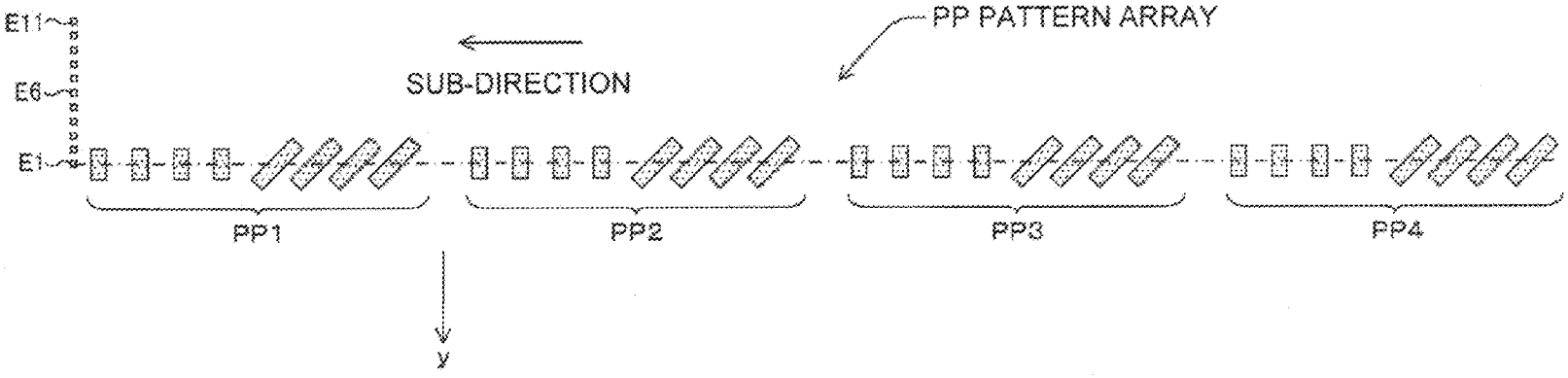
FIG. 24 is an exemplary diagram for describing a positional relation between a PP pattern array and a light-emitting element.
Figure 25:
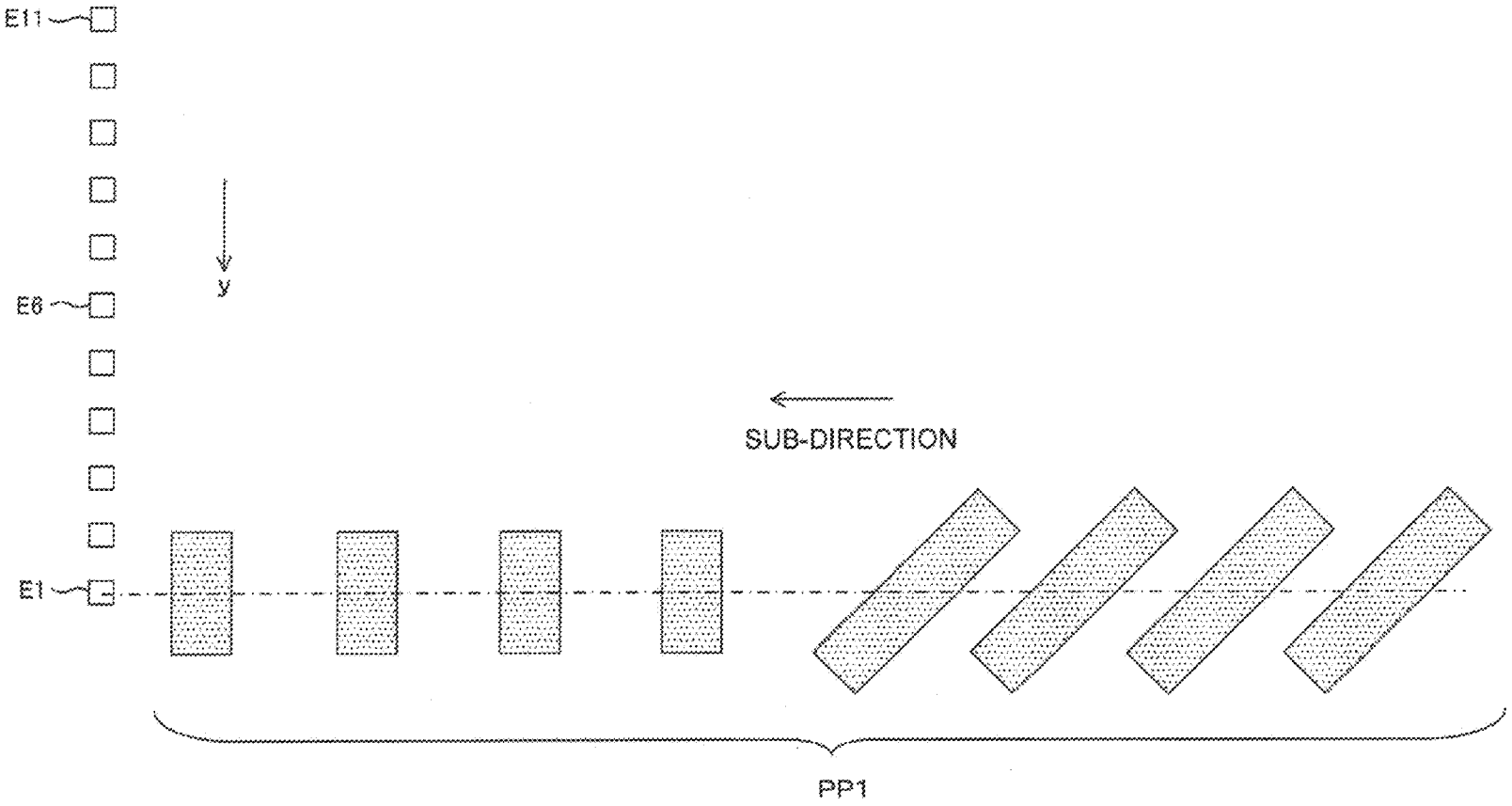
FIG. 25 is an exemplary diagram illustrating a part of FIG. 24 at an enlarged scale.

In this embodiment, as an example, as illustrated in FIG. 24, four positional deviation detection patterns PP1 to PP4 are arrayed in a line along the sub-direction and are set to be formed at such positions that the patterns are illuminated by a detection beam S1 from the light-emitting element E1. FIG. 25 illustrates a part of FIG. 24 at an enlarged scale. In the following description, for the sake of convenience, an array of positional deviation detection patterns PP1 to PP4 will be also referred to as a "PP pattern array."

Figure 26:
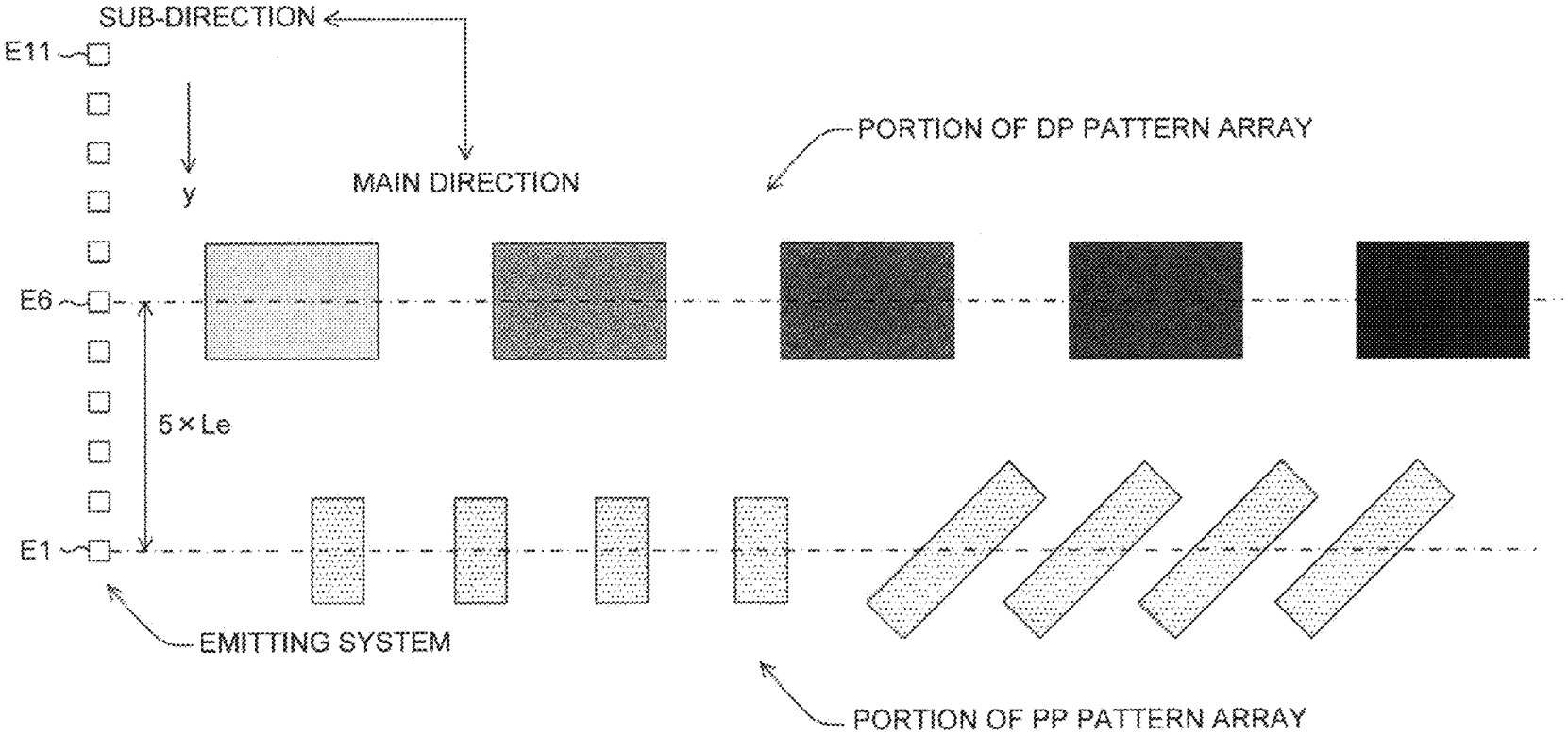
FIG. 26 is a diagram for describing a positional relation between a DP pattern array and a PP pattern array.
Figure 27:
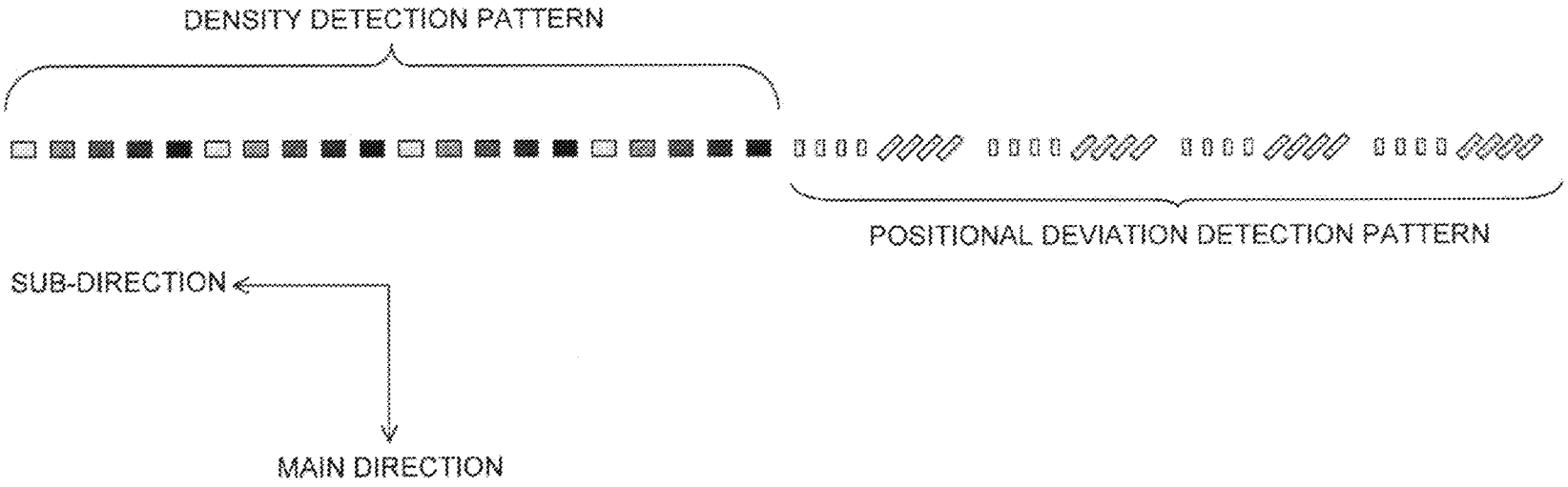
FIG. 27 is an exemplary diagram for describing a conventional positional relation between a density detection pattern and a positional deviation detection pattern.

The PP pattern array is formed at a position separated by 2 mm (=5×Le) toward the positive y-side of the DP pattern array (see FIG. 26). However, in an image forming apparatus that performs a density detection process and a positional deviation detection process using the conventional reflecting optical sensor, the density detection pattern and the positional deviation detection pattern are formed to be arrayed in a line along the sub-direction (see FIG. 27).

The DP pattern array and the PP pattern array will be also collectively referred to as a "pattern array" when it is not necessary to distinguish between them.

Figure 28:
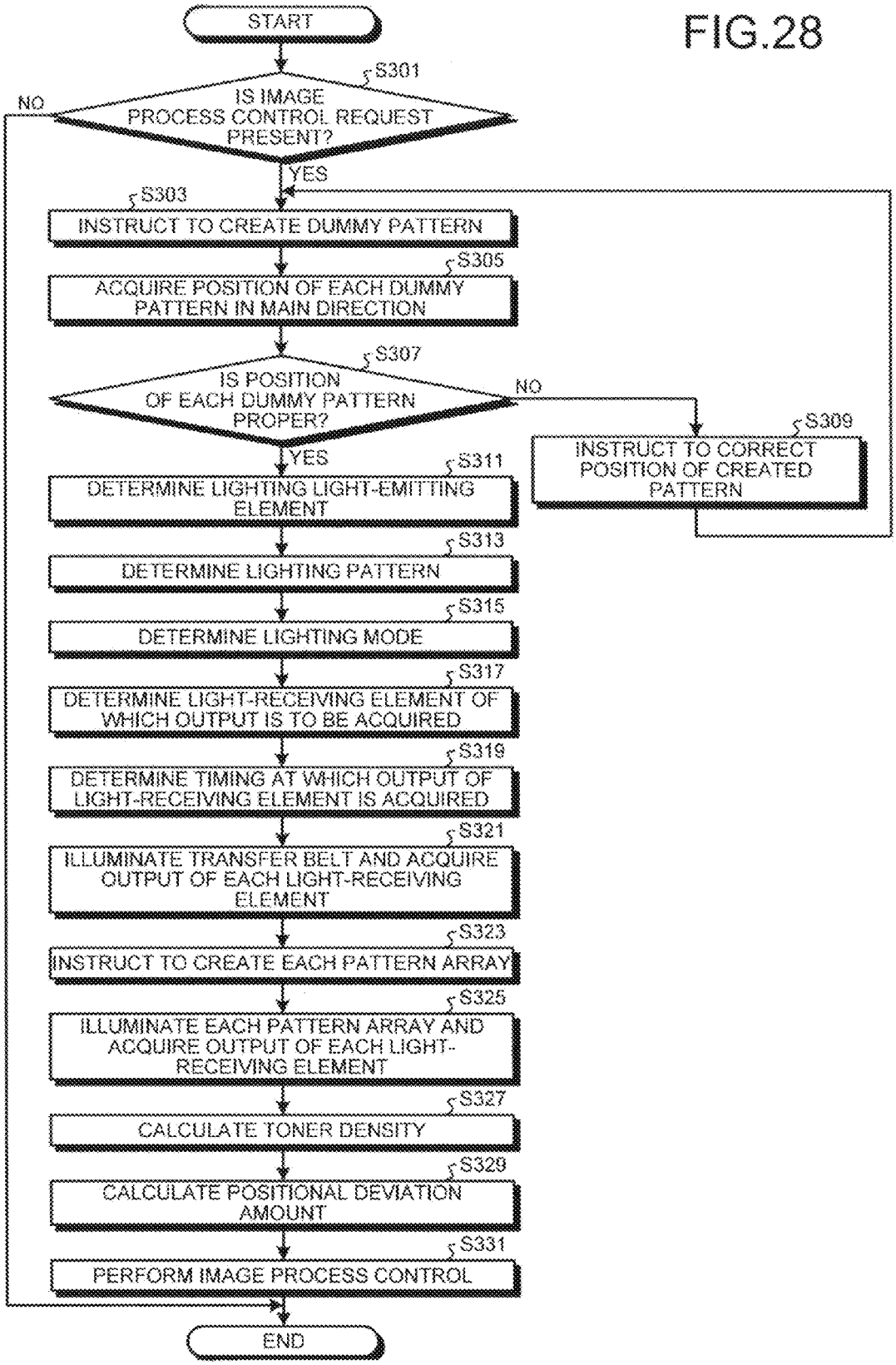
FIG. 28 is an exemplary flowchart for describing image process control that is performed by a printer control device.

Next, a density detection process and a positional deviation detection process that are performed using the reflecting optical sensor 2245 to perform image process control will be described with reference to FIG. 28. In this embodiment, the density detection process and the positional deviation detection process are performed by the printer control device 2090. The flowchart of FIG. 28 corresponds to a series of processing algorithms executed by the printer control device 2090 during the density detection process and the positional deviation detection process. The density detection process and the positional deviation detection process are also referred to as a "detection process."

(1) In step S301, first, it is determined whether there is a request for image process control. In this example, a positive determination result is obtained if an image process control flag is set, and a negative determination result is obtained if an image process control flag is not set.

Immediately after power is turned on, the image process control flag is set (a) when a stop period of the photosensitive drum is 6 hours or more, (b) when the temperature of the apparatus is changed by 10° C. or more, (c) when a relative humidity of the apparatus is changed by 50% or more, and the like. During printing, the image process control flag is set (d) when the number of printed copies reaches a predetermined number, (e) when the number of rotations of the developing sleeve reaches a predetermined number, (f) when a travel distance of the transfer belt reaches a predetermined distance, and the like.

When a negative determination result is obtained in step S301, the density detection process and the positional deviation detection process are not performed. On the other hand, when a positive determination result is obtained in step S301, the image process control flag is reset, and the flow proceeds to step S303. In this example, it is assumed that a user requests to form a plurality of continuous images, and the image process control flag is set at timing before an (m−1)-th image of the plurality of images is formed after the m-th image of the plurality of images is formed.

(2) In step S303, the scanning control device is instructed to create a dummy pattern DKDP for identifying a formation position of a DP pattern array in the main direction and a dummy pattern LDPK for identifying a formation position of a PP pattern array in the main direction.

Each dummy pattern is an oblong pattern which is formed using a black toner having a solid density. The dummy pattern DKDP has a length of 1.0 mm in the main direction and a length of 0.5 mm in the sub-direction. The dummy pattern LDPK has a length of 1.0 mm in the main direction and a length of 0.45 mm in the sub-direction. The color, the toner density, and the shape of each dummy pattern are not limited to these.

In this example, the dummy pattern DKDP is formed such that the central position thereof is identical to the central position of the DP pattern array in relation to the main direction. Further, the dummy pattern LDPK is formed such that the central position thereof is identical to the central position of the PP pattern array in relation to the main direction.

The scanning control device controls the light source 2200*a* so that an electrostatic latent image of the dummy pattern DKDP is formed at the center of an effective image region of the photosensitive drum 2030*a*, and an electrostatic latent image of the dummy pattern LDPK is formed at a position separated by 2 mm toward the positive y-side from the center.

Figure 29:
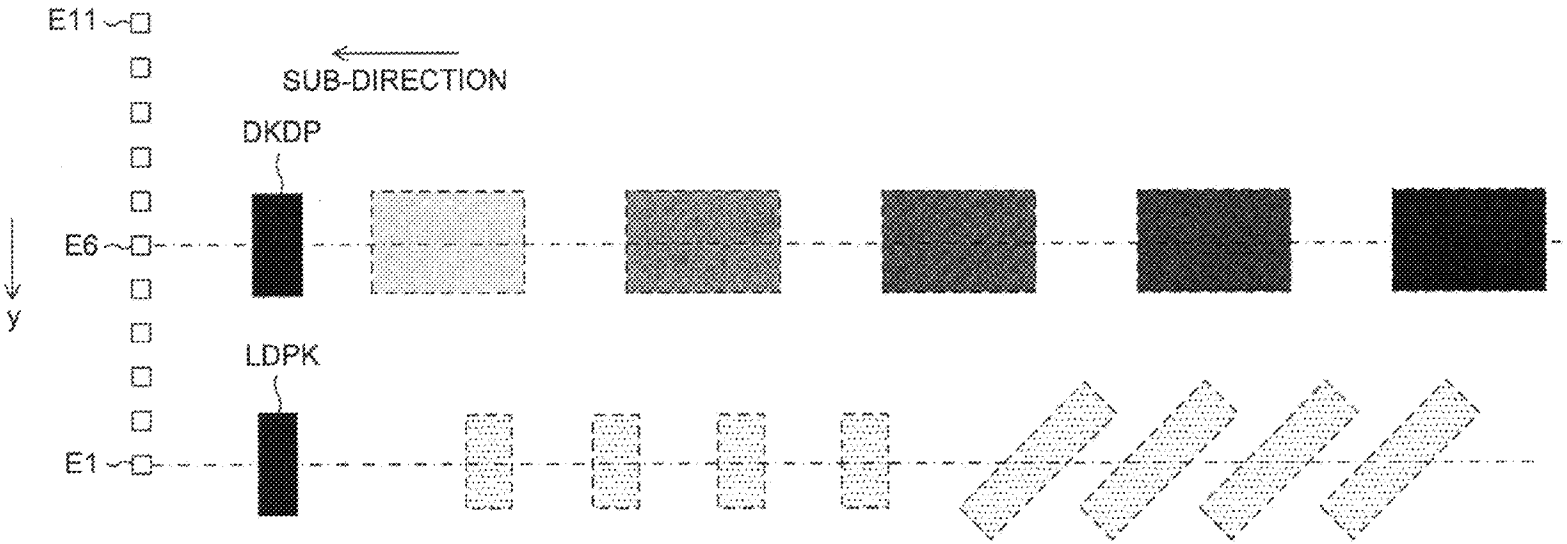
FIG. 29 is an exemplary diagram for describing respective dummy patterns.

Moreover, each electrostatic latent image is developed by the corresponding developing unit and is transferred to the transfer belt 2040 at predetermined timing. As a result, the dummy pattern DKDP and the dummy pattern LDPK are formed on the transfer belt 2040 (see FIG. 29). Image forming conditions and the like necessary for forming each dummy pattern are stored in advance in the ROM of the printer control device 2090.

(3) In step S305, subsequently, the position of each dummy pattern in relation to the main direction is obtained.

However, the positions in the main direction of the DP pattern array and the PP pattern array with respect to the reflecting optical sensor 2245 may be different from intended positions due to deviation of a formation position of each pattern array, a skew of the transfer belt, and the like. Thus, it is necessary to acquire the position of each pattern array in relation to the main direction in advance.

Figure 30:
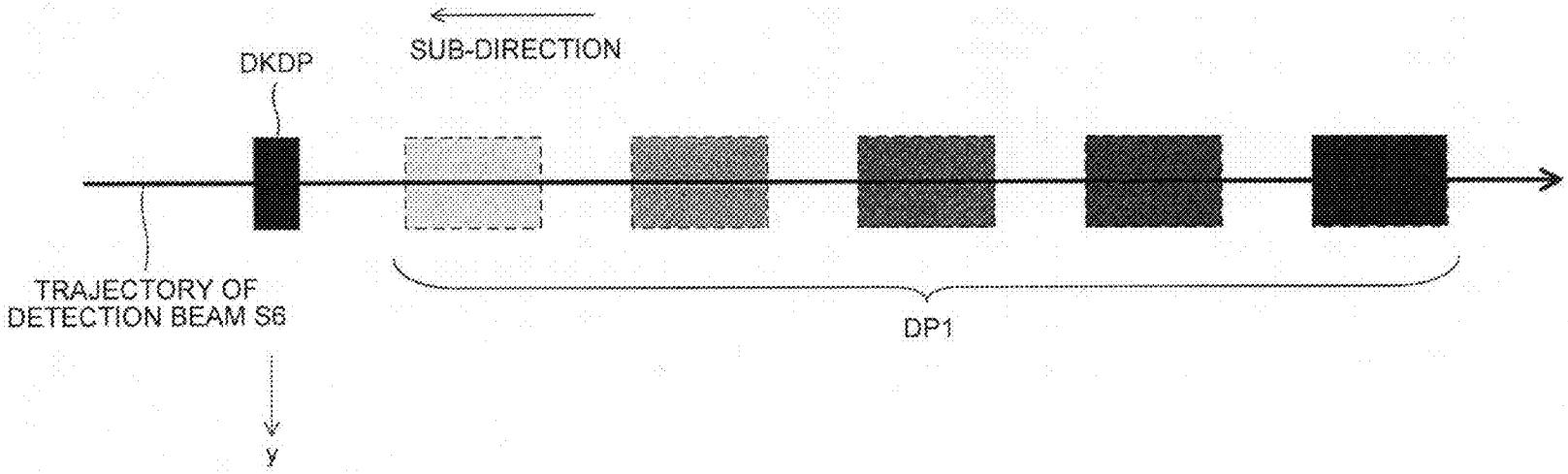
FIG. 30 is an exemplary diagram for describing a trajectory of a detection beam S6.

The dummy pattern DKDP will be described. In this example, the dummy pattern DKDP is set to be formed at such a position that the pattern is illuminated by the detection beam S6. FIG. 30 illustrates a trajectory of the detection beam S6 when the dummy pattern DKDP is formed as it is set.

Figure 31:
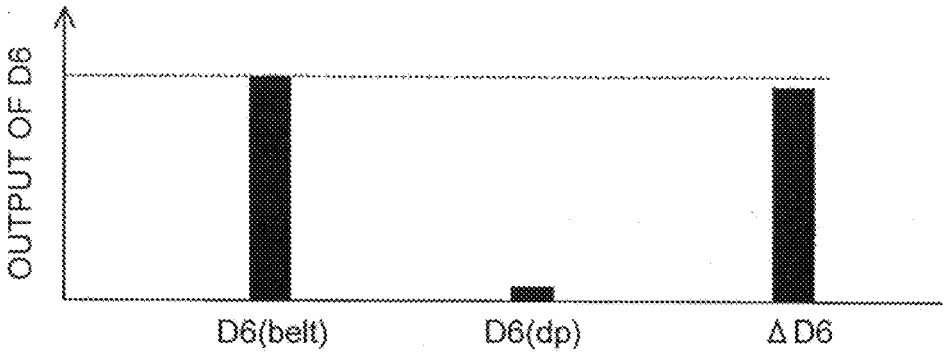
FIG. 31 is a first exemplary diagram for describing a method of calculating a central position of a dummy pattern DKDP in the main direction.
Figure 32:
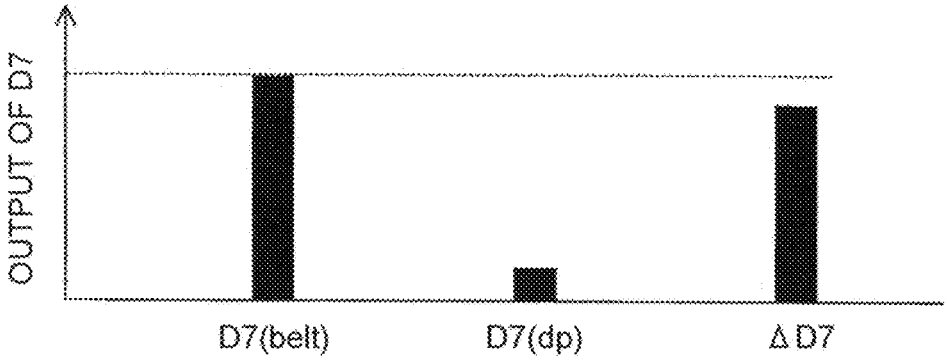
FIG. 32 is a second exemplary diagram for describing a method of calculating a central position of a dummy pattern DKDP in the main direction.
Figure 33:
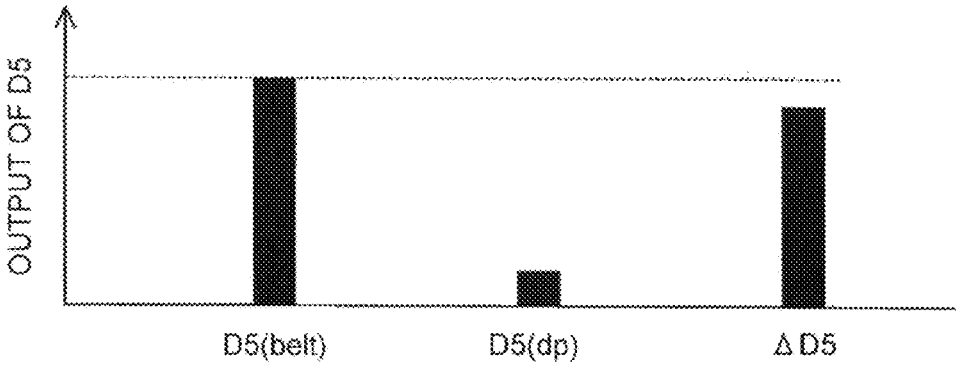
FIG. 33 is a third exemplary diagram for describing a method of calculating a central position of a dummy pattern DKDP in the main direction.

FIGS. 31 to 33 illustrate an example of the output of the light-receiving element when the dummy pattern DKDP moves to such a position that the pattern faces the reflecting optical sensor 2245. FIG. 31 illustrates the output (indicated by D6(*dp*)) of the light-receiving element D6 when only the light-emitting element E6 is lit, FIG. 32 illustrates the output (indicated by D7(*dp*)) of the light-receiving element D7 when only the light-emitting element E7 is lit, and FIG. 33 illustrates the output (indicated by D5(*dp*)) of the light-receiving element D5 when only the light-emitting element E5 is lit.

D6(belt) in FIG. 31 indicates the output of the light-receiving element D6 when the detection beam S6 illuminates the transfer belt, D7(belt) in FIG. 32 indicates the output of the light-receiving element D7 when the detection beam S7 illuminates the transfer belt, and D5(belt) in FIG. 33 indicates the output of the light-receiving element D5 when the detection beam S5 illuminates the transfer belt.

Moreover, ΔD6 in FIG. 31 indicates a difference between D6(belt) and D6(*dp*), ΔD7 in FIG. 32 indicates a difference between D7(belt) and D7(*dp*), and ΔD5 in FIG. 33 indicates a difference between D5(belt) and D5(*dp*).

Here, the differences are in a relation of ΔD6>ΔD7 and ΔD6>ΔD5.

In this case, it is considered that since the entire detection beam S6 is emitted to the dummy pattern DKDP and is scattered or absorbed by the dummy pattern DKDP, D6(*dp*) has a very smaller value than D6(belt). On the other hand, it is considered that since the detection beam S7 is emitted to both the transfer belt and the dummy pattern DKDP, a small amount of light is scattered or absorbed by the dummy pattern DKDP, and thus, a relation of ΔD6>ΔD7 is obtained. Similarly, it is considered that since the detection beam S5 is emitted to both the transfer belt and the dummy pattern DKDP, a small amount of light is scattered or absorbed by the dummy pattern DKDP, and thus, a relation of ΔD6>ΔD5 is obtained.

Figure 34:
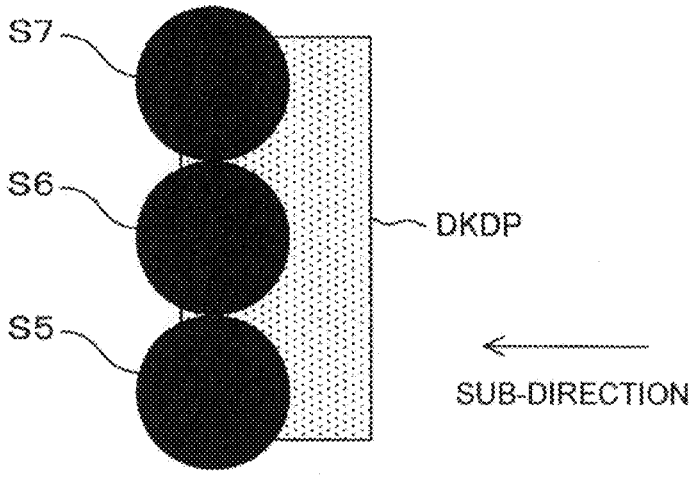
FIG. 34 is an exemplary diagram for describing the central position of the dummy pattern DKDP in the main direction determined from FIGS. 31 to 33.

In this case, as an example, as illustrated in FIG. 34, it can be estimated that the center of the dummy pattern DKDP is approximately at the same position as the light-emitting element E6 in relation to the main direction. In this example, since D5(belt)≈D6(belt)≈D7(belt), the estimation may start with D6(*dp*) which is smallest among D5(*dp*), D6(*dp*), and D7(*dp*). In this example, since the center of the dummy pattern DKDP is set to be identical to the center of the DP pattern array in relation to the main direction, it can be estimated that the center of the DP pattern array is approximately at the same position as the light-emitting element E6 in relation to the main direction.

Figure 35:
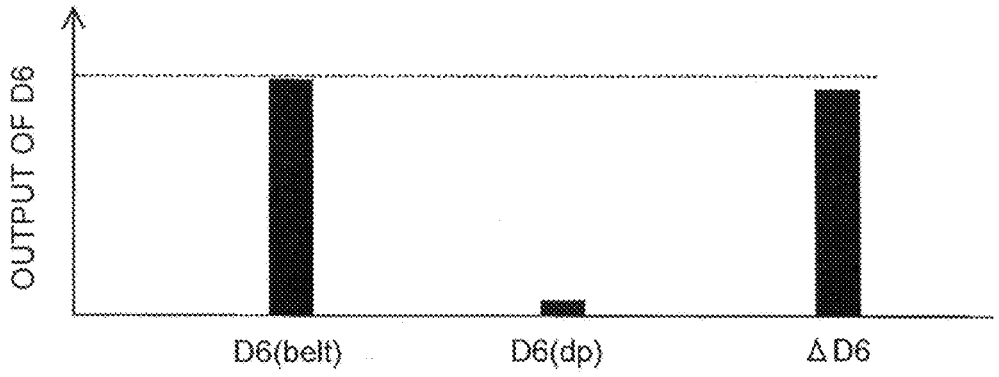
FIG. 35 is a fourth exemplary diagram for describing a method of calculating a central position of a dummy pattern DKDP in the main direction.
Figure 36:
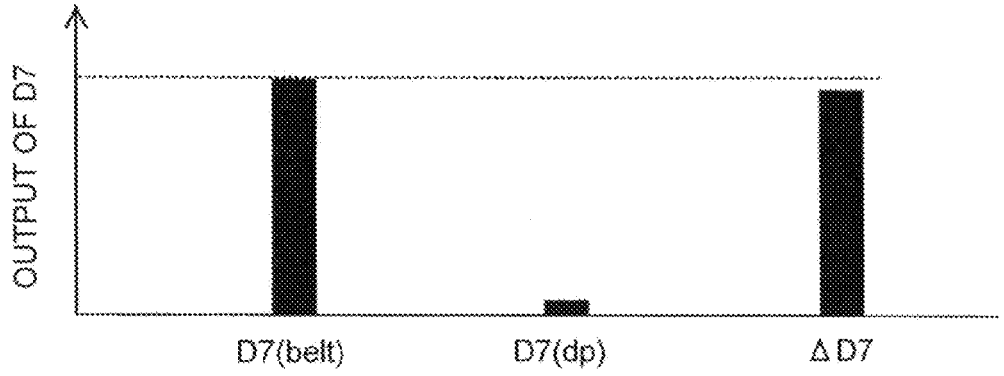
FIG. 36 is a fifth exemplary diagram for describing a method of calculating a central position of a dummy pattern DKDP in the main direction.
Figure 37:
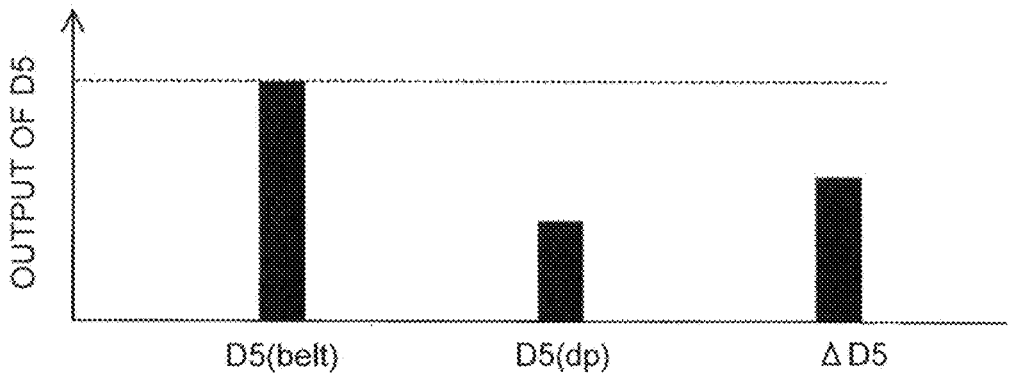
FIG. 37 is a sixth exemplary diagram for describing a method of calculating a central position of a dummy pattern DKDP in the main direction.
Figure 38:
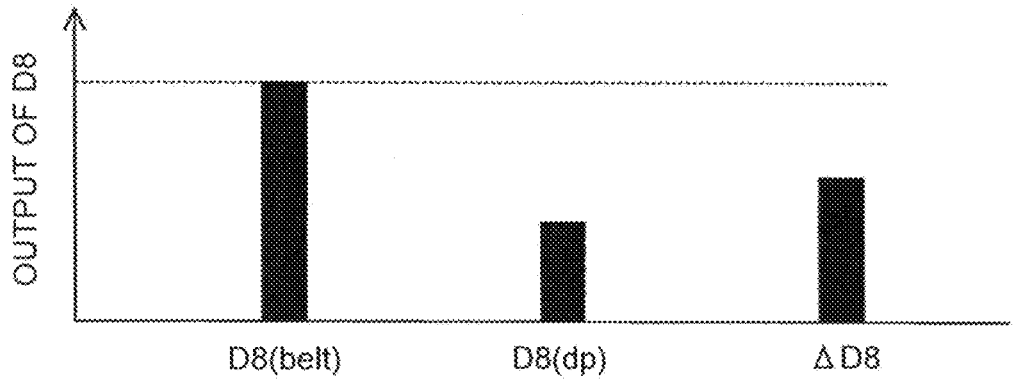
FIG. 38 is a seventh exemplary diagram for describing a method of calculating a central position of a dummy pattern DKDP in the main direction.

FIGS. 35 to 38 illustrate another example of the output of the light-receiving element when the dummy pattern DKDP moves to such a position that the pattern faces the reflecting optical sensor 2245. FIG. 35 illustrates D6(*dp*) when only the light-emitting element E6 is lit, FIG. 36 illustrates D7(*dp*) when only the light-emitting element E7 is lit, FIG. 37 illustrates D5(*dp*) when only the light-emitting element E5 is lit, and FIG. 38 illustrates the output (indicated by D8(*dp*)) of the light-receiving element D8 when only the light-emitting element E8 is lit.

D8(belt) in FIG. 38 indicates the output of the light-receiving element D8 when the detection beam S8 illuminates the transfer belt, and ΔD8 is a difference between D8(belt) and D8(*dp*).

Figure 39:
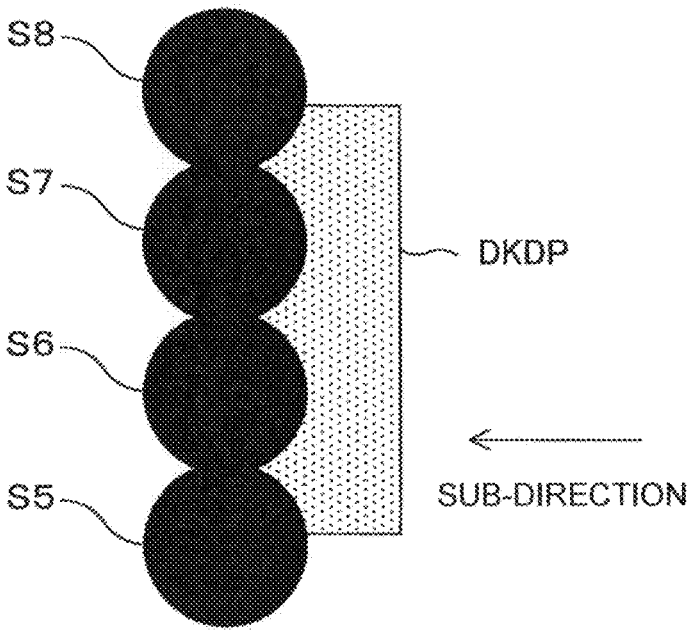
FIG. 39 is an exemplary diagram for describing the central position of the dummy pattern DKDP in the main direction determined from FIGS. 35 to 38.

In this example, the differences are in a relation of ΔD6≈ΔD7>ΔD5≈ΔD8. In this case, as an example, as illustrated in FIG. 39, it can be estimated that the center of the dummy pattern DKDP is at an intermediate position between the light-emitting element E6 and the light-emitting element E7 in relation to the main direction. Thus, it can be estimated that the center of the DP pattern array is at an intermediate position between the light-emitting element E6 and the light-emitting element E7 in relation to the main direction.

Further, even when the light-emitting element E6 is lit, if the output distribution of the light-receiving system is the same as the output distribution of the light-receiving system when the transfer belt 2040 is illuminated, it is determined that the dummy pattern DKDP is not present within an allowable range due to a certain sudden event.

The central position of the dummy pattern LDPK in the main direction can be obtained based on the same way of thinking. However, in this example, since the light-receiving element D1 is a light-receiving element at the positive y-side end, and the light-emitting element E1 is a light-emitting element at the positive y-side end, a relation between the lighting light-emitting element and the output of each light-receiving element is obtained in advance as an output profile for each central position of the dummy pattern LDPK in the main direction. When it is determined that the central position of the dummy pattern LDPK in the main direction is closer to the positive y-side than the light-emitting element E1, the central position of the dummy pattern LDPK in the main direction is obtained with reference to the output profile.

Moreover, since the center of the dummy pattern LDPK is set to be identical to the center of the PP pattern array in relation to the main direction, it is possible to estimate the central position of the PP pattern array in the main direction from the acquisition result of the central position of the dummy pattern LDPK in the main direction.

Further, even when the light-emitting element E1 is lit, if the output distribution of the light-receiving system is the same as the output distribution of the light-receiving system when the transfer belt 2040 is illuminated, it is determined that the dummy pattern LDPK is not present within an allowable range due to a certain sudden event.

(4) In step S307, subsequently, it is determined whether the position of each dummy pattern in the main direction is proper.

In this example, when it is determined that at least one of the dummy pattern DKDP and the dummy pattern LDPK is not present within an allowable range, a negative determination result is obtained, and the flow proceeds to step S309.

(5) In step S309, the formation position of the dummy pattern which is determined not to be present within an allowable range is corrected, and the flow returns to step S303.

On the other hand, when it is determined in step S307 that both the dummy pattern DKDP and the dummy pattern LDPK are present within an allowable range, a positive determination result is obtained in step S307, and the flow proceeds to step S311.

(6) In step S311, a lighting light-emitting element for each pattern array is determined. In this example, a case where a portion of the light-emitting elements is lit and a case where all light-emitting elements are lit may be considered.

In the case where a portion of the light-emitting elements is lit, the lighting light-emitting element can be determined based on the position of the pattern array in the main direction, estimated in step S305.

The DP pattern array will be described. For example, when it is estimated that the center of the DP pattern array is approximately at the same position as the light-emitting element E6 in relation to the main direction, only the light-emitting element E6 is determined as the lighting light-emitting element. This is because even when the light-emitting elements E5 and E7 are lit, a portion of the detection beams S5 and S7 may not illuminate the rectangular pattern. Thus, light utilization efficiency is low, and the light rarely affects detection accuracy.

When the DP pattern array moves in the sub-direction, and there is a possibility that the detection beam S6 falls out of the rectangular pattern, three light-emitting elements E5 to E7 may be determined as lighting light-emitting elements by adding the light-emitting elements E5 and E7 on both sides of the light-emitting element E6 to secure a margin. The amount of margin can be determined according to the characteristics (a formation position deviation state of the toner pattern, a skew state of the photosensitive drum and the transfer belt, and the like) of the color printer 2000.

Further, for example, when it is estimated that the center of the DP pattern array is at an intermediate position between the light-emitting element E6 and the light-emitting element E7 in relation to the main direction, two light-emitting elements E6 and E7 can be determined as the lighting light-emitting elements. This is because even when the light-emitting elements E5 and E8 are lit, a portion of the detection beams S5 and S8 may not illuminate the rectangular pattern. Thus, light utilization efficiency is low, and the light rarely affects detection accuracy. In this case, since a computation result is obtained for each light-emitting element, by averaging the computation results obtained for the light-emitting elements E6 and E7, it is possible to increase detection accuracy.

When the DP pattern array moves in the sub-direction, and there is a possibility that the detection beams S6 and S7 fall out of the rectangular pattern, four light-emitting elements E5 to E8 may be determined as lighting light-emitting elements by adding the light-emitting elements E5 and E8 on both sides of the light-emitting elements E6 and E7 to secure a margin.

Further, any one of the light-emitting elements E6 and E7 may be selected, and only the selected light-emitting element may be lit.

The lighting light-emitting element is determined for the PP pattern array based on the same way of thinking.

On the other hand, when all light-emitting elements are lit, all light-emitting elements included in the reflecting optical sensor 2245 are used.

(7) In step S313, subsequently, a lighting pattern is determined for each pattern array.

As a lighting pattern, when there are a plurality of lighting light-emitting elements, these lighting light-emitting elements may be lit or unlit concurrently and may be lit or unlit sequentially.

For example, when a light-emitting element En and a light-emitting element Em ($n \neq m$) are lit concurrently to illuminate one rectangular pattern with a detection beam Sn and a detection beam Sm, if a reflected light based on the detection beam Sn and a reflected light based on the detection beam Sm are received by the same light-receiving element, it is difficult to divide these reflected lights. However, when the light-emitting element En and the light-emitting element Em are sequentially lit or unlit to illuminate one rectangular pattern individually with the detection beam Sn and the detection beam Sm, even if the reflected light based on the detection beam Sn and the reflected light based on the detection beam Sm are received by the same light-receiving element, it is possible to divide these reflected lights due to a difference in the reception timing.

On the other hand, if the reflected light based on the detection beam Sn and the reflected light based on the detection beam Sm are not received by the same light-receiving element, it is possible to light the light-emitting element En and the light-emitting element Em at the same time. Naturally, in this case, the light-emitting element En and the light-emitting element Em may be sequentially lit or unlit.

In this example, a period necessary for lighting or unlighting all of the lighting target light-emitting elements once is referred to as a "line period." Lighting or unlighting a plurality of light-emitting elements at the same time provides an advantage that the line period can be decreased as compared to lighting or unlighting a plurality of light-emitting elements sequentially.

Whether reflected lights based on a plurality of detection beams are received by the same light-receiving element depends on a positional relation of a plurality of light-emitting elements to be lit, diffuse reflection characteristics (an angular distribution of a reflected light) of a rectangular pattern, and the like.

The DP pattern array will be described. For example, when two light-emitting elements E6 and E7 are determined as the lighting light-emitting elements, such a layout that a reflected light based on the detection beam S6 can be received by the light-receiving elements D6 and D7, and a reflected light based on the detection beam S7 can be also received by the light-receiving elements D6 and D7 is employed. Thus, when the light-emitting elements E6 and E7 are lit concurrently, it is difficult to divide the reflected lights received by the light-receiving elements D6 and D7 into the reflected light based on the detection beam S6 and the reflected light based on the detection beam S7. In this case, it is necessary to cause the light-emitting elements E6 and E7 to be lit or unlit sequentially (in this case, alternately).

Further, for example, when four light-emitting elements E5 to E8 are determined as lighting light-emitting elements, the light-emitting elements are lit or unlit in the order of E5, E6, E7, E8, E5, E6, and so on.

The lighting pattern is determined for the PP pattern array based on the same way of thinking.

(8) In step S315, subsequently, a lighting mode is determined for each pattern array. As a lighting mode, a light-emitting element may be lit always and may be lit in a pulsating manner.

The DP pattern array will be described. For example, when only one light-emitting element E6 is determined as the lighting light-emitting element, the light-emitting element may be lit always and may be lit in a pulsating manner.

On the other hand, for example, when two light-emitting elements E6 and E7 are determined as lighting light-emitting elements, the light-emitting elements E6 and E7 need to be lit or unlit sequentially (in this case, alternately), and each light-emitting element is lit in a pulsating manner.

In this case, when there are a number of lighting target light-emitting elements and these light-emitting elements are lit or unlit sequentially, each light-emitting element is lit in a pulsating manner. On the other hand, in other cases, one of a mode where each light-emitting element is lit always and a mode where each light-emitting element is lit in a pulsating manner may be selected.

The always-lighting mode provides an advantage that the number of times when a light-emitting element is lit or unlit can be decreased and a driving circuit can be simplified. The pulsating lighting mode provides an advantage that a lit period can be decreased, deterioration of a light-emitting element can be suppressed, and a lifespan can be extended. Further, the pulsating lighting mode also provides an advantage that an increase of temperature of a light-emitting element can be suppressed.

The lighting mode is determined for the PP pattern array based on the same way of thinking.

All of the lighting light-emitting element, the lighting pattern, and the lighting mode may be selectable; and at least one of them may be determined in advance. Although the former case makes a driving circuit complex, various operations are possible in various image forming apparatuses. In the latter case, for example, if the lighting pattern and the lighting mode are determined in advance, it is possible to simplify a driving circuit and to reduce the cost. In this case, since the lighting light-emitting element can be selected appropriately according to the length of a target pattern in the main direction and the performance of the image forming apparatus, practicability is improved.

(9) In step S317, subsequently, a light-receiving element of which the output is to be acquired is determined for each pattern array. In determining the light-receiving element of which the output is to be acquired, the output of a portion of the light-receiving elements may be acquired, and the output of all light-receiving elements may be acquired.

When the output of a portion of light-receiving elements is acquired, the light-receiving element of which the output is to be acquired may be determined based on a determination result on the lighting light-emitting element.

The DP pattern array will be described. For example, a case where only one light-emitting element E6 is determined as the lighting light-emitting element will be described.

Figure 40A:
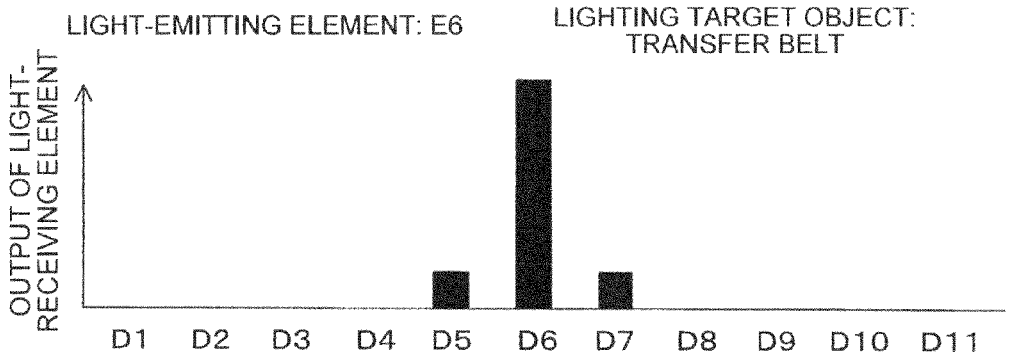
FIG. 40A is an exemplary diagram for describing an output distribution of a light-receiving system when a light-emitting element E6 is lit and a lighting target object is a transfer belt.
Figure 40B:
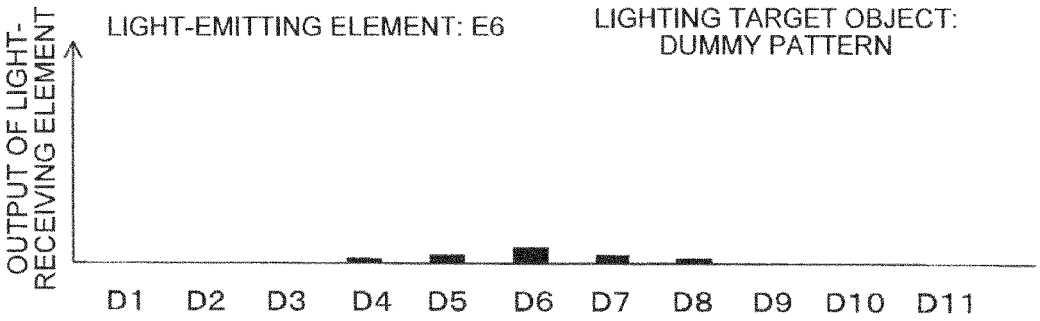
FIG. 40B is an exemplary diagram for describing an output distribution of a light-receiving system when a dummy pattern DKDP is at the position illustrated in FIG. 34, a light-emitting element E6 is lit, and a lighting target object is a dummy pattern DKDP.

FIG. 40A illustrates the output of light-receiving elements when the detection beam S6 illuminates the transfer belt; and FIG. 40B illustrates the output of light-receiving elements when the detection beam S6 illuminates the dummy pattern DKDP. In this case, since the output of the light-receiving elements D1 to D3 and D9 to D11 is 0, five light-receiving elements D4 to D8 are necessary.

Moreover, when the light-emitting elements E6 and E7 are determined as lighting light-emitting elements and these light-emitting elements are lit or unlit sequentially, the light-receiving elements D4 to D8 are necessary for the light-emitting element E6, the light-receiving elements D5 to D9 are necessary for the light-emitting element E7, and as a result, six light-receiving elements D4 to D9 are necessary.

The light-receiving element of which the output is to be acquired is determined for the PP pattern array in the same manner.

However, when the output of unnecessary light-receiving elements is not acquired, it is possible to reduce the amount of data and to reduce the amount of computation.

Naturally, when all light-emitting elements are determined as lighting light-emitting elements, the output of all light-receiving elements is acquired. Further, the output of all light-receiving elements may be acquired regardless of the lighting light-emitting element.

(10) In step S319, subsequently, the timing at which the output of the light-receiving element is acquired is determined.

The DP pattern array will be described. For example, a case where only one light-emitting element E6 is determined as a lighting light-emitting element and is always lit will be described. In this case, the output is acquired from five light-receiving elements D4 to D8.

Figure 41:
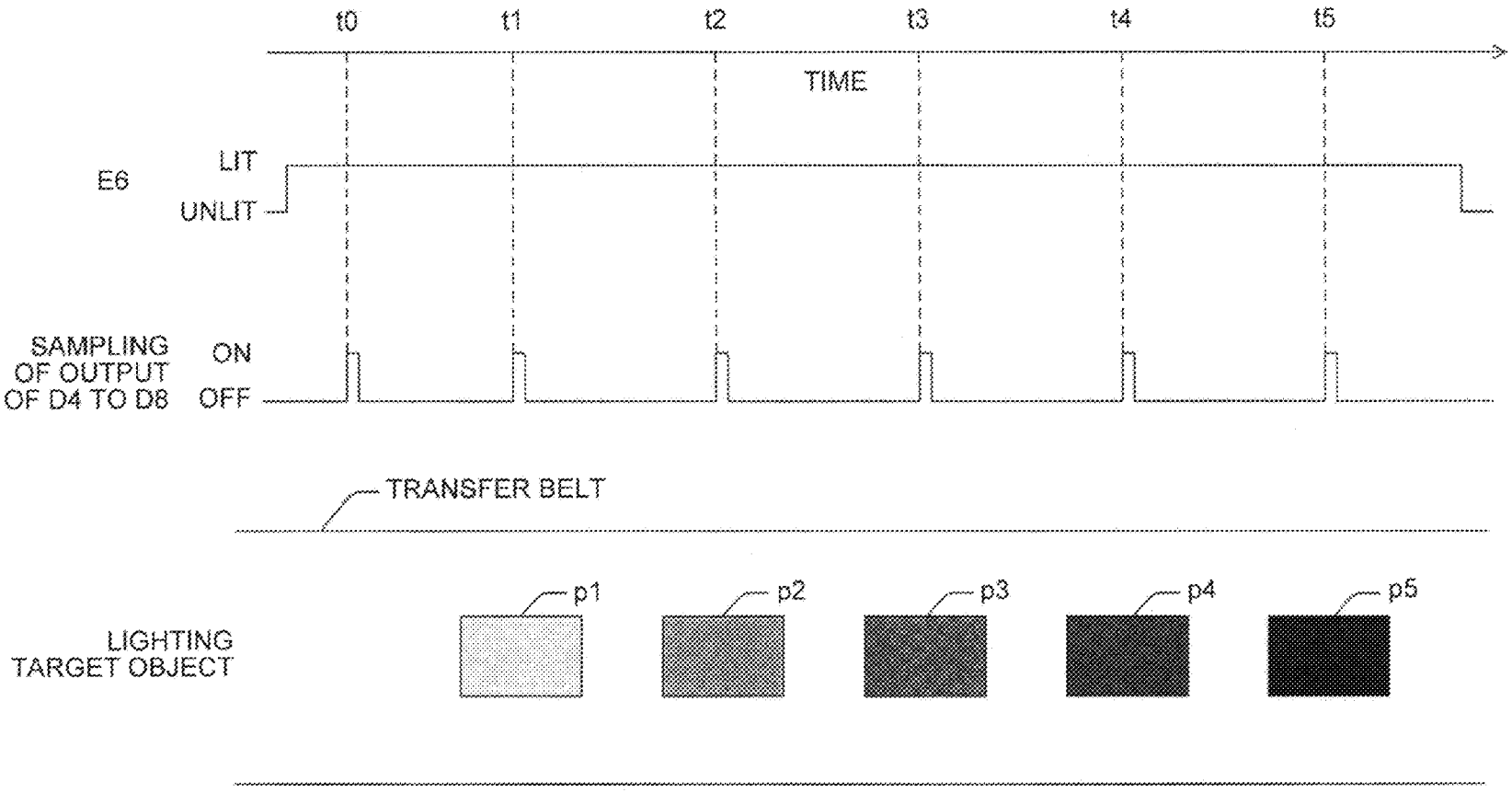
FIG. 41 is an exemplary diagram for describing a first example of sampling timing of a DP pattern array.

FIG. 41 illustrates the lighting or unlighting timing of the light-emitting element E6 and the sampling timing of the output of the light-receiving elements D4 to D8.

Figure 42:
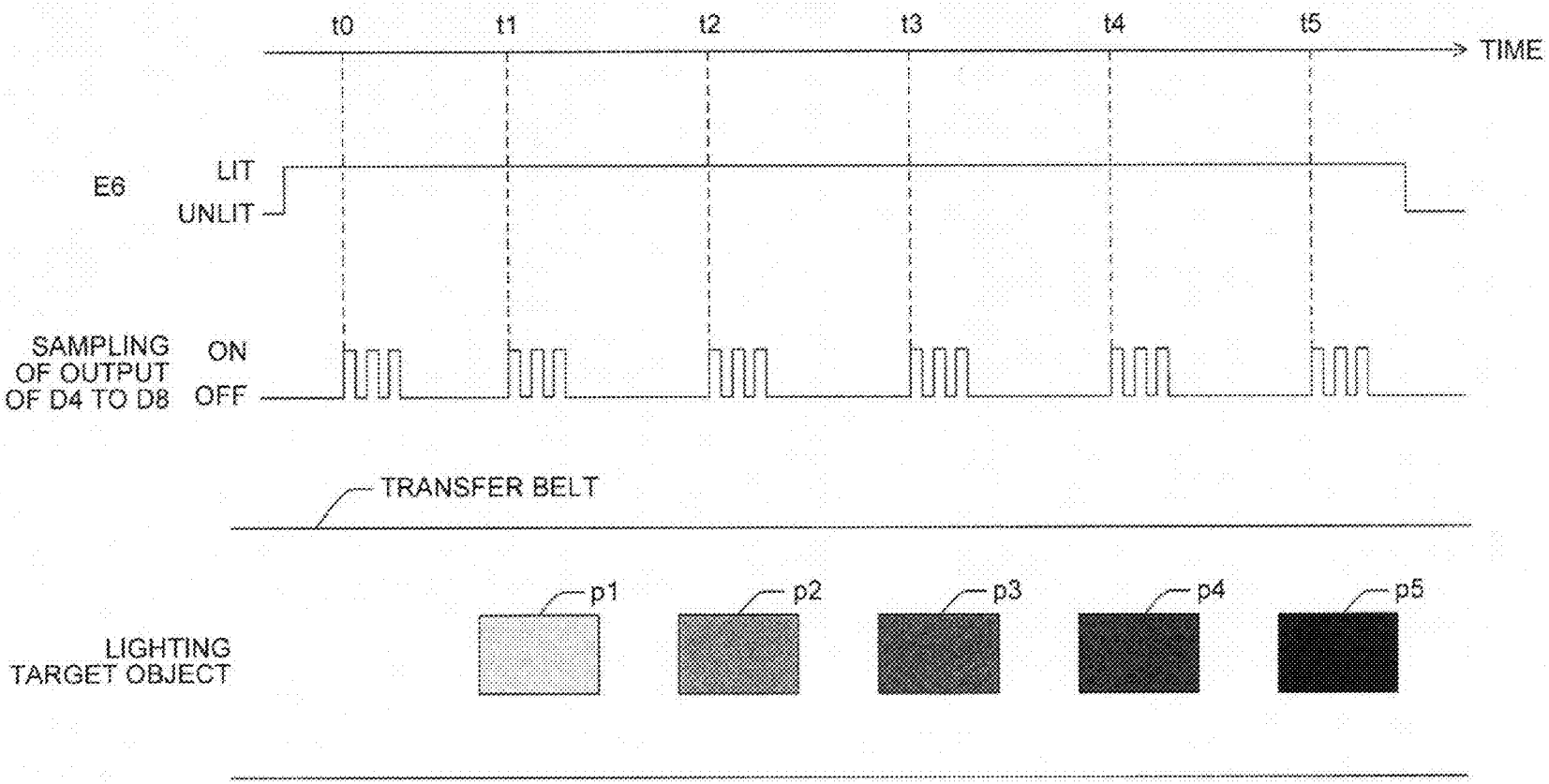
FIG. 42 is an exemplary diagram for describing a second example of sampling timing of a DP pattern array.

As an example, as illustrated in FIG. 42, several times of sampling may be performed with respect to one rectangular pattern. In this case, since a plurality of computation results are obtained for each rectangular pattern, by averaging the computation results, it is possible to improve detection accuracy.

Figure 43:
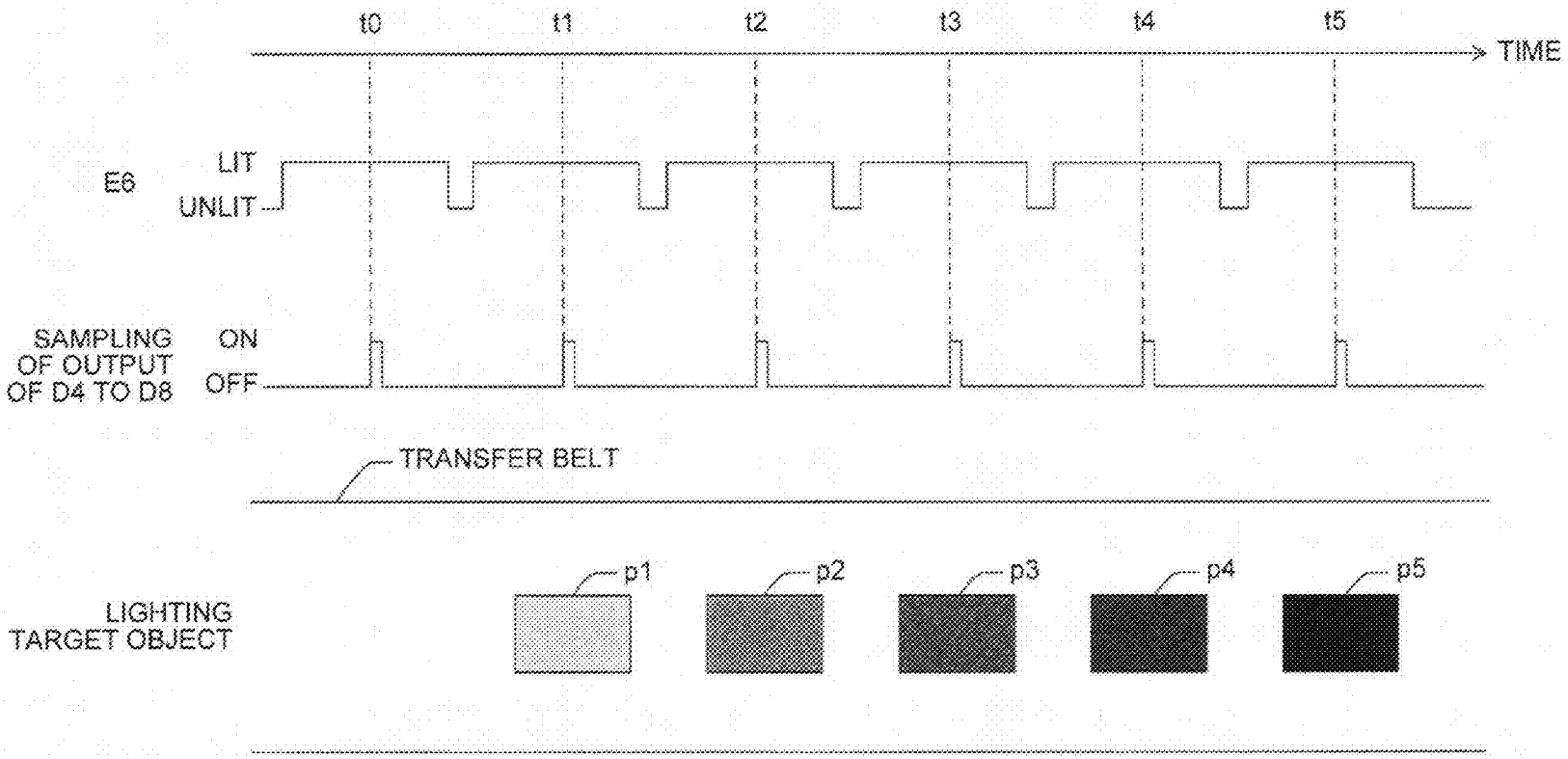
FIG. 43 is an exemplary diagram for describing a third example of sampling timing of a DP pattern array.
Figure 44:
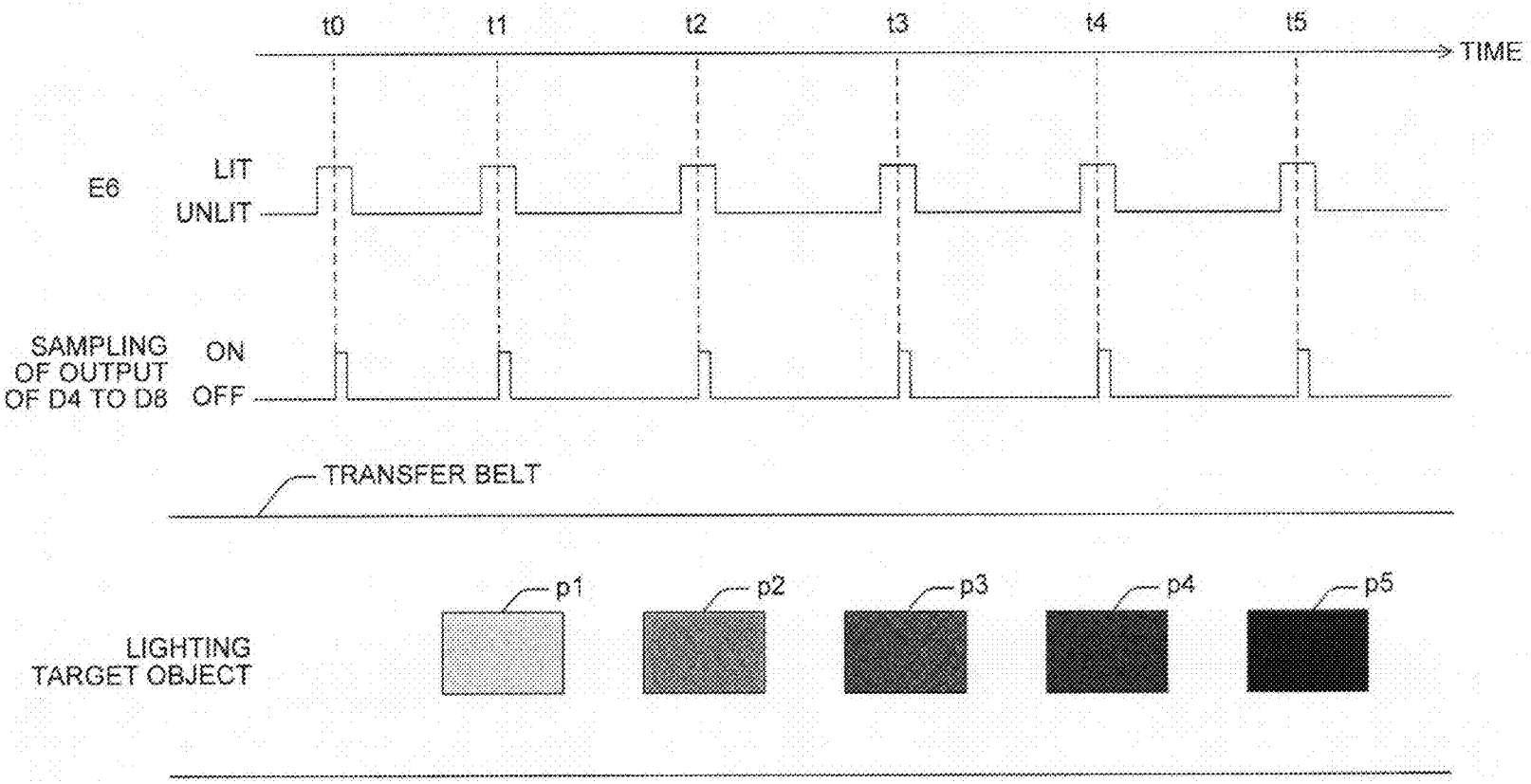
FIG. 44 is an exemplary diagram for describing a fourth example of sampling timing of a DP pattern array.
Figure 45:
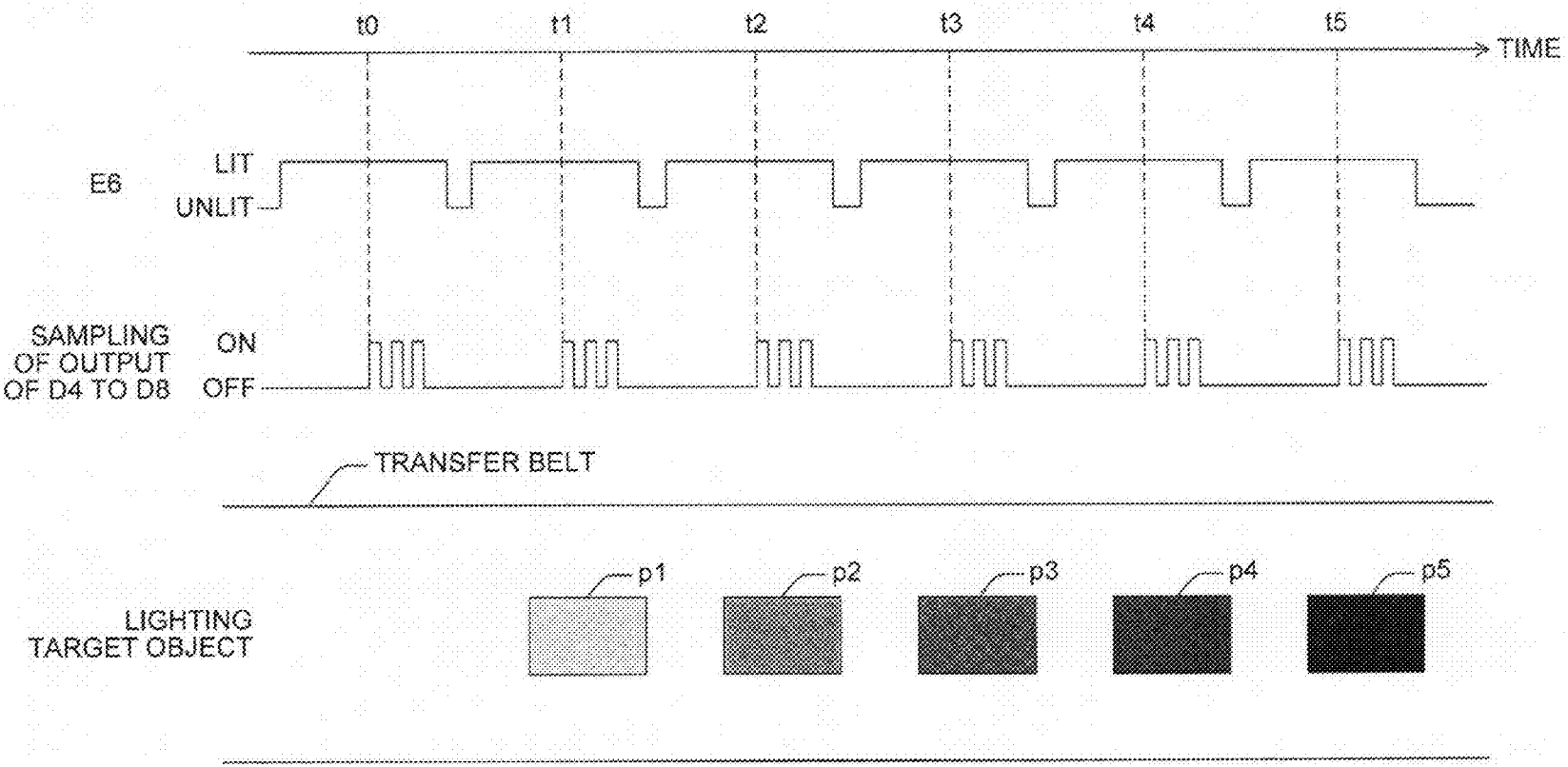
FIG. 45 is an exemplary diagram for describing a fifth example of sampling timing of a DP pattern array.

Further, as an example, as illustrated in FIG. 43, the light-emitting element E6 may be lit in a pulsating manner in synchronization with the timing at which each rectangular pattern passes through an illumination region of the detection beam S6. Moreover, in this case, as an example, as illustrated in FIG. 44, a lighting period may be shorter than the period in which the rectangular pattern passes through the illumination region of the detection beam S6. Accordingly, it is possible to further suppress an increase in the temperature of the light-emitting element. Further, in this case, as an example, as illustrated in FIG. 45, several times of sampling may be performed with respect to one rectangular pattern.

Figure 46:
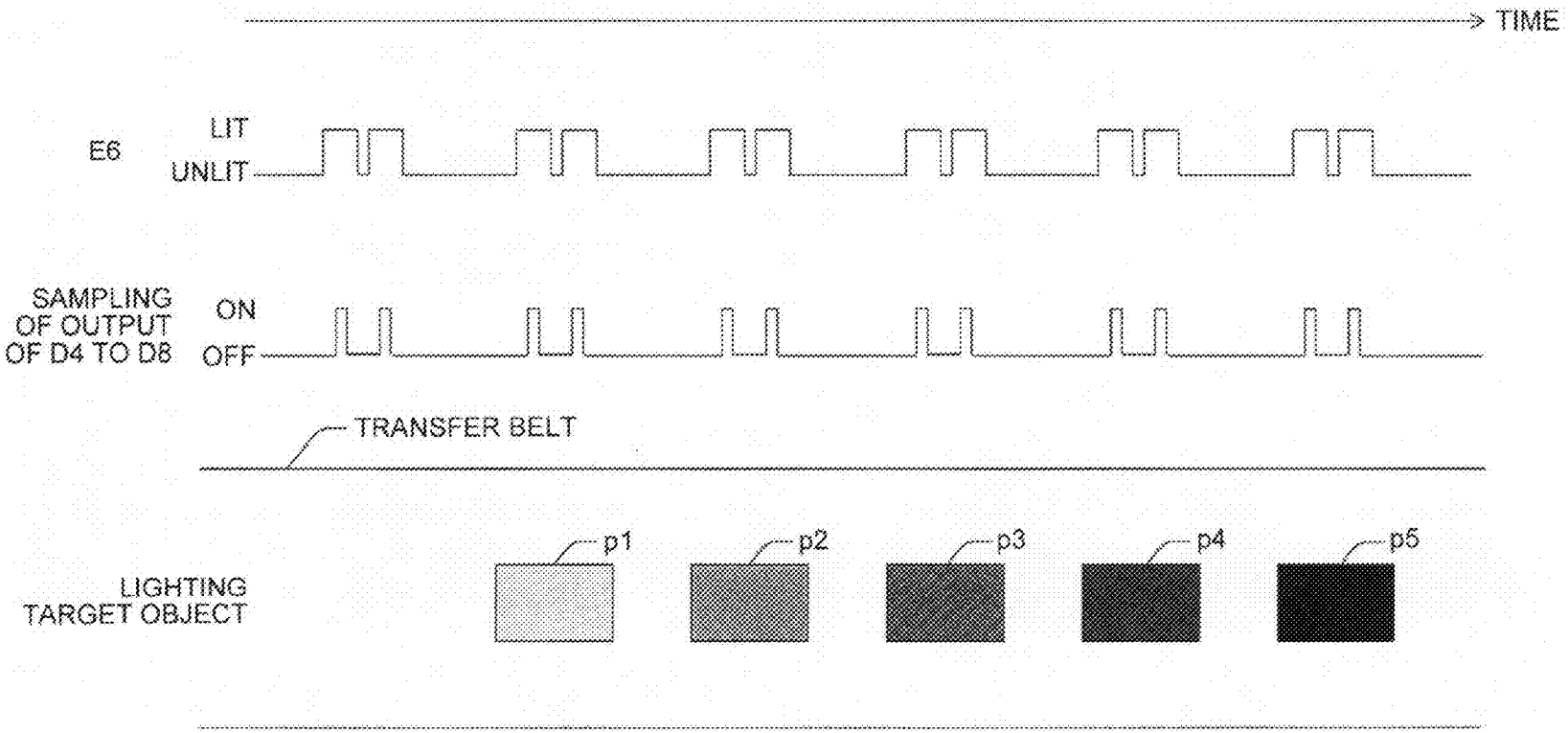
FIG. 46 is an exemplary diagram for describing a sixth example of sampling timing of a DP pattern array.
Figure 47:
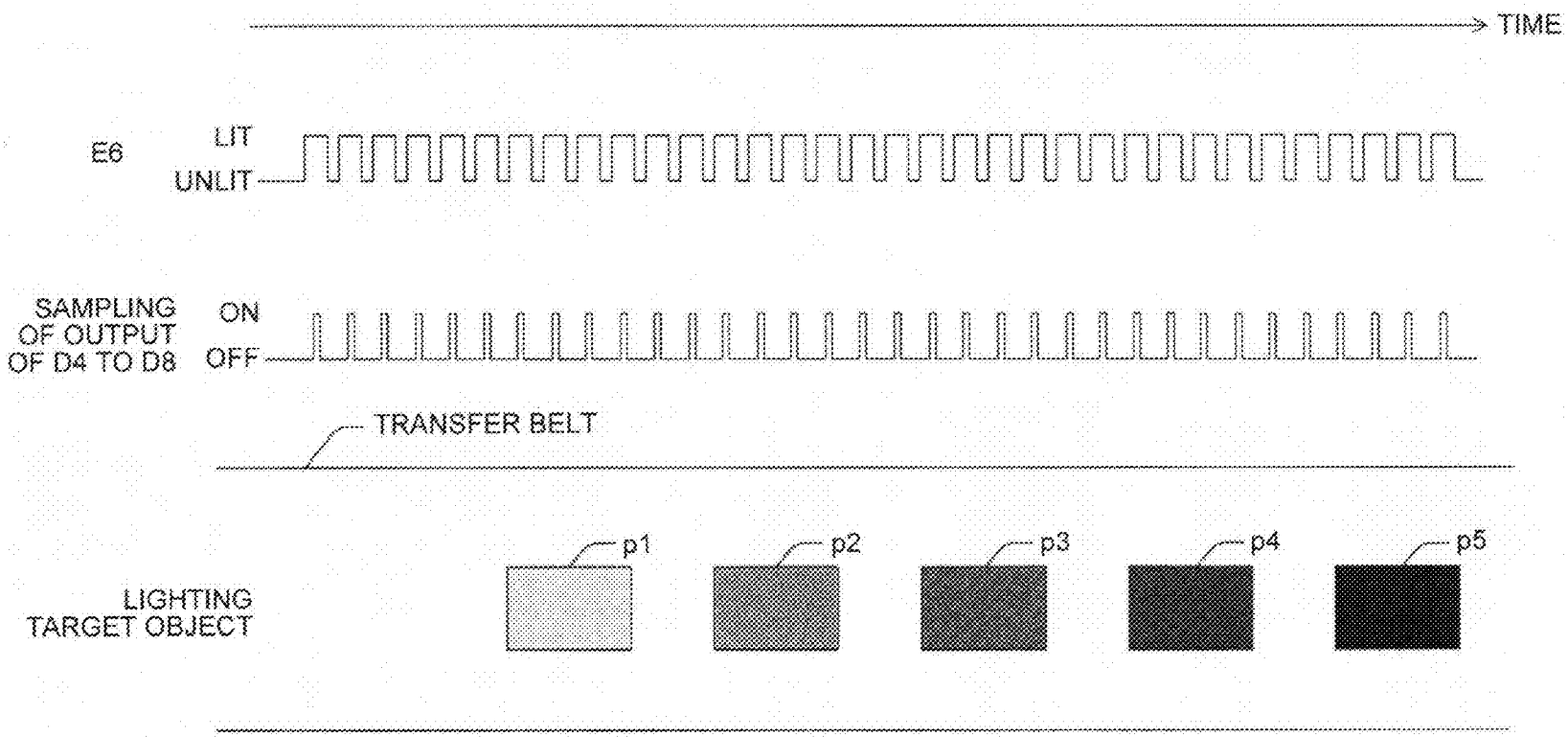
FIG. 47 is an exemplary diagram for describing a seventh example of sampling timing of a DP pattern array.

Furthermore, as an example, as illustrated in FIGS. 46 and 47, the light-emitting element may be lit or unlit several times with respect to one rectangular pattern. Further, sampling may be performed for each lighting or unlighting of the light-emitting element.

Next, a case where two light-emitting elements E6 and E7 are determined as lighting light-emitting elements will be described. In this case, the output is acquired from six light-receiving elements D4 to D9.

Figure 48:
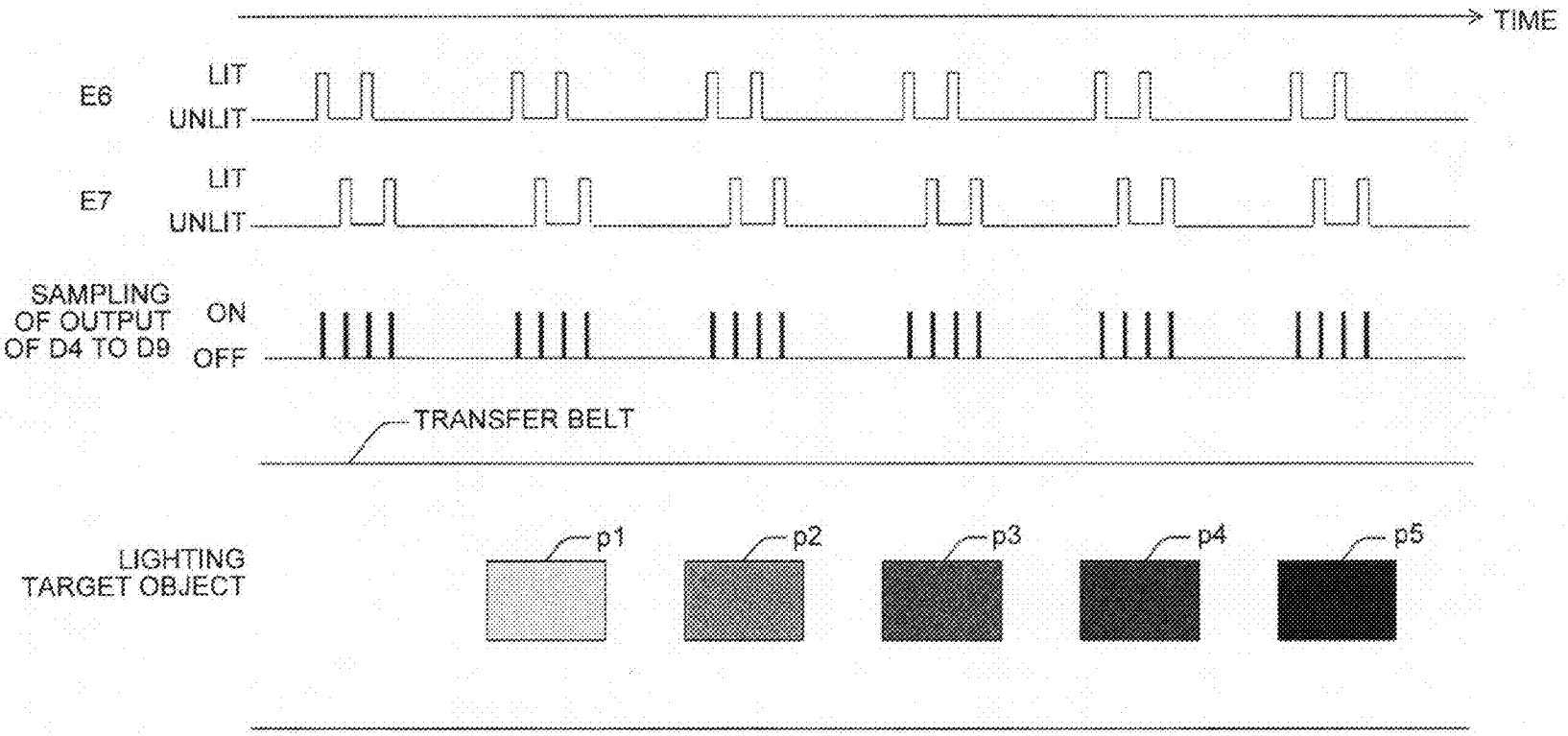
FIG. 48 is an exemplary diagram for describing an eighth example of sampling timing of a DP pattern array.

FIG. 48 illustrates the lighting or unlighting timing of the light-emitting element E6, the lighting or unlighting timing of the light-emitting element E7, and the sampling timing of the output of the light-receiving elements D4 to D9. In this case, since four computation results are obtained for each rectangular pattern, by averaging the computation results, it is possible to improve detection accuracy.

Figure 49:
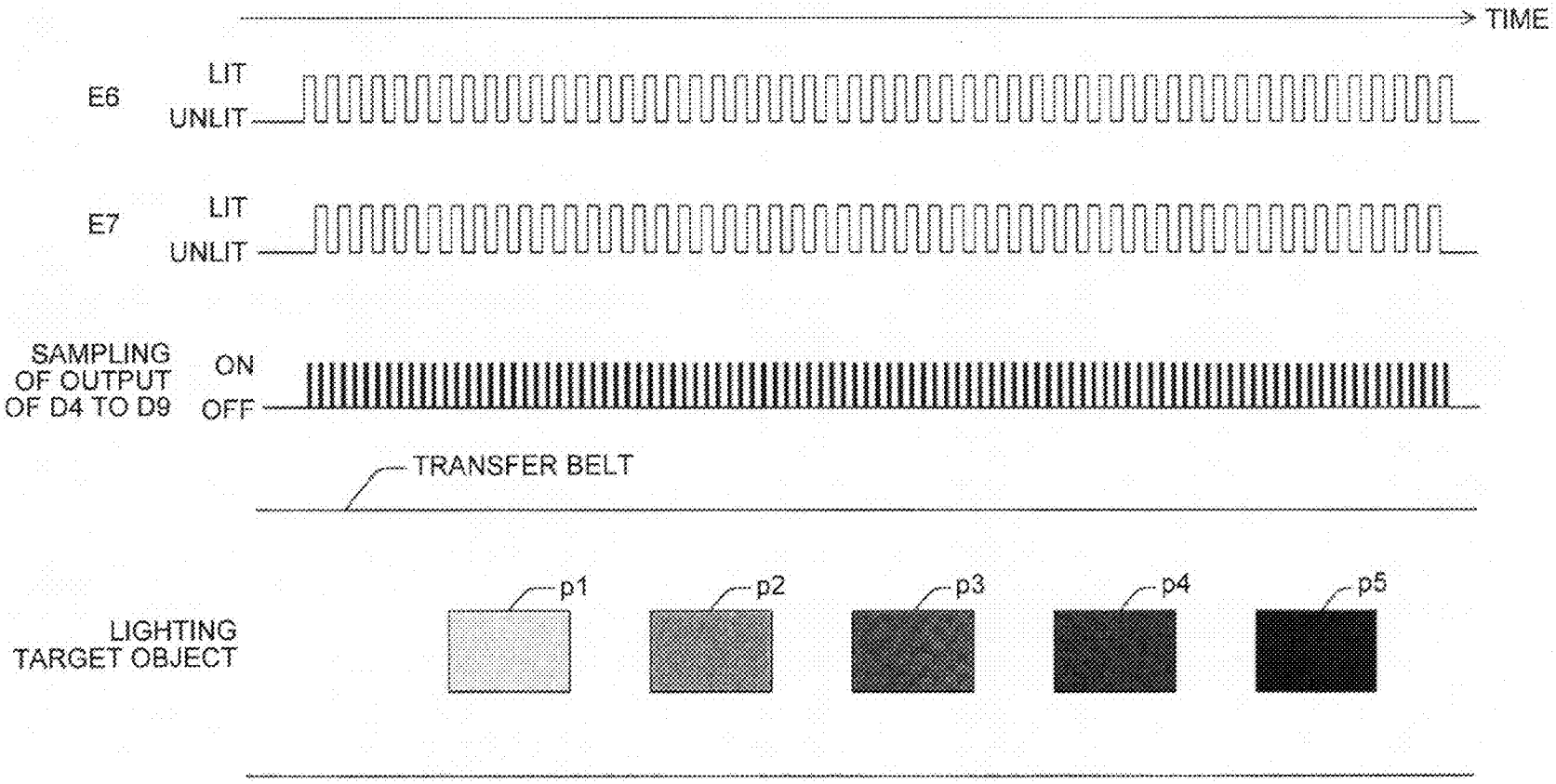
FIG. 49 is an exemplary diagram for describing a ninth example of sampling timing of a DP pattern array.

As an example, as illustrated in FIG. 49, the line period may be decreased. In this case, it is possible to increase the number of times of sampling and to further improve detection accuracy.

However, as for the timing at which the output of the light-receiving element is acquired, when the number of times of sampling for each rectangular pattern as required by the image forming apparatus is set, various acquisition timings can be set according to the determination content on the light-emitting element.

The PP pattern array will be described. For example, a case where only one light-emitting element E1 is determined as a lighting light-emitting element will be described.

Figure 50:
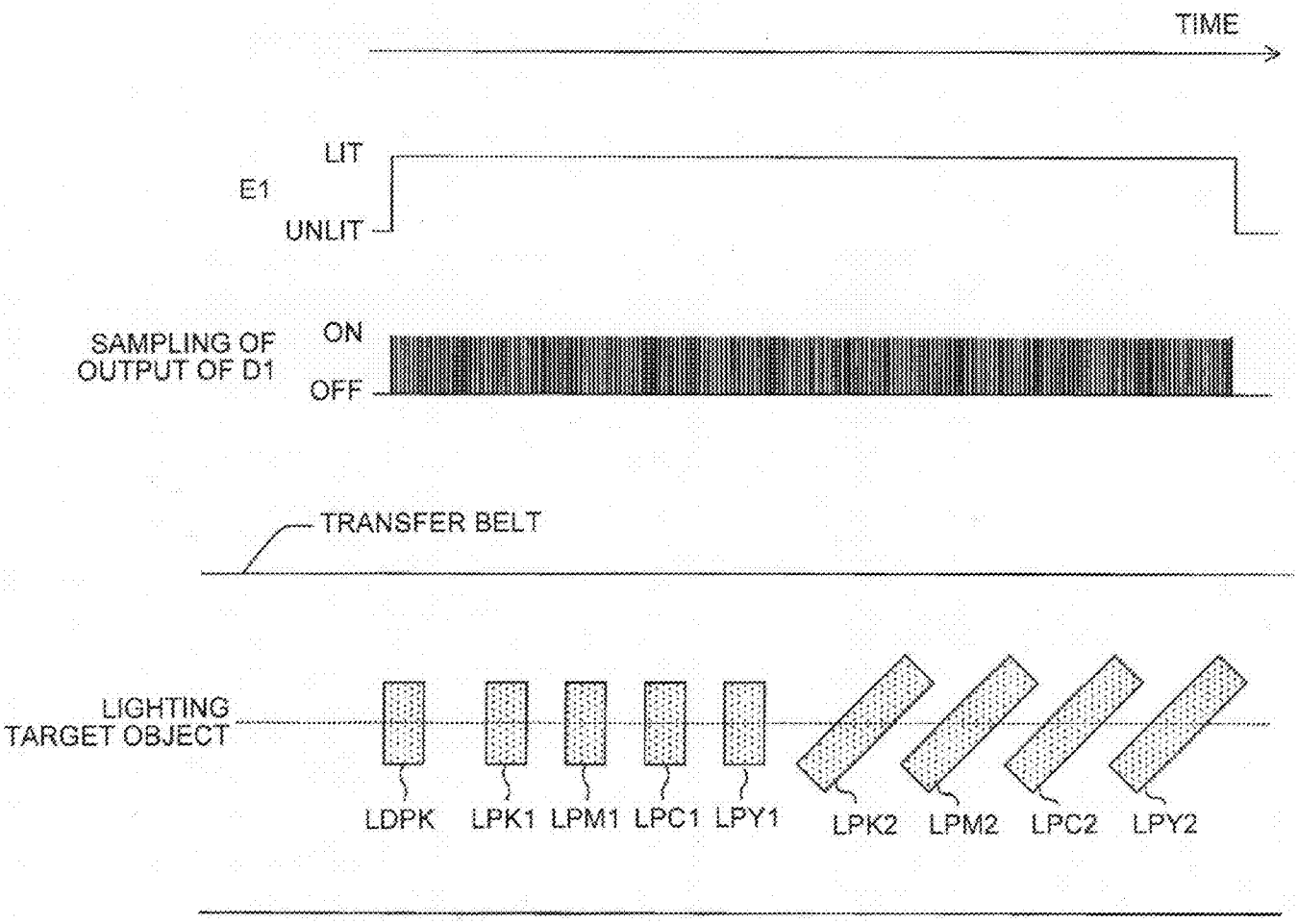
FIG. 50 is an exemplary diagram for describing a first example of sampling timing of a PP pattern array.

FIG. 50 illustrates a case where the light-emitting element E1 is always lit, and sampling of the output of the light-receiving element D1 is performed in synchronization with the lighting of the light-emitting element E1. The number of items of data per unit time of the output of the light-receiving element D1 depends on the sampling rate of the light-receiving element D1.

Figure 51:
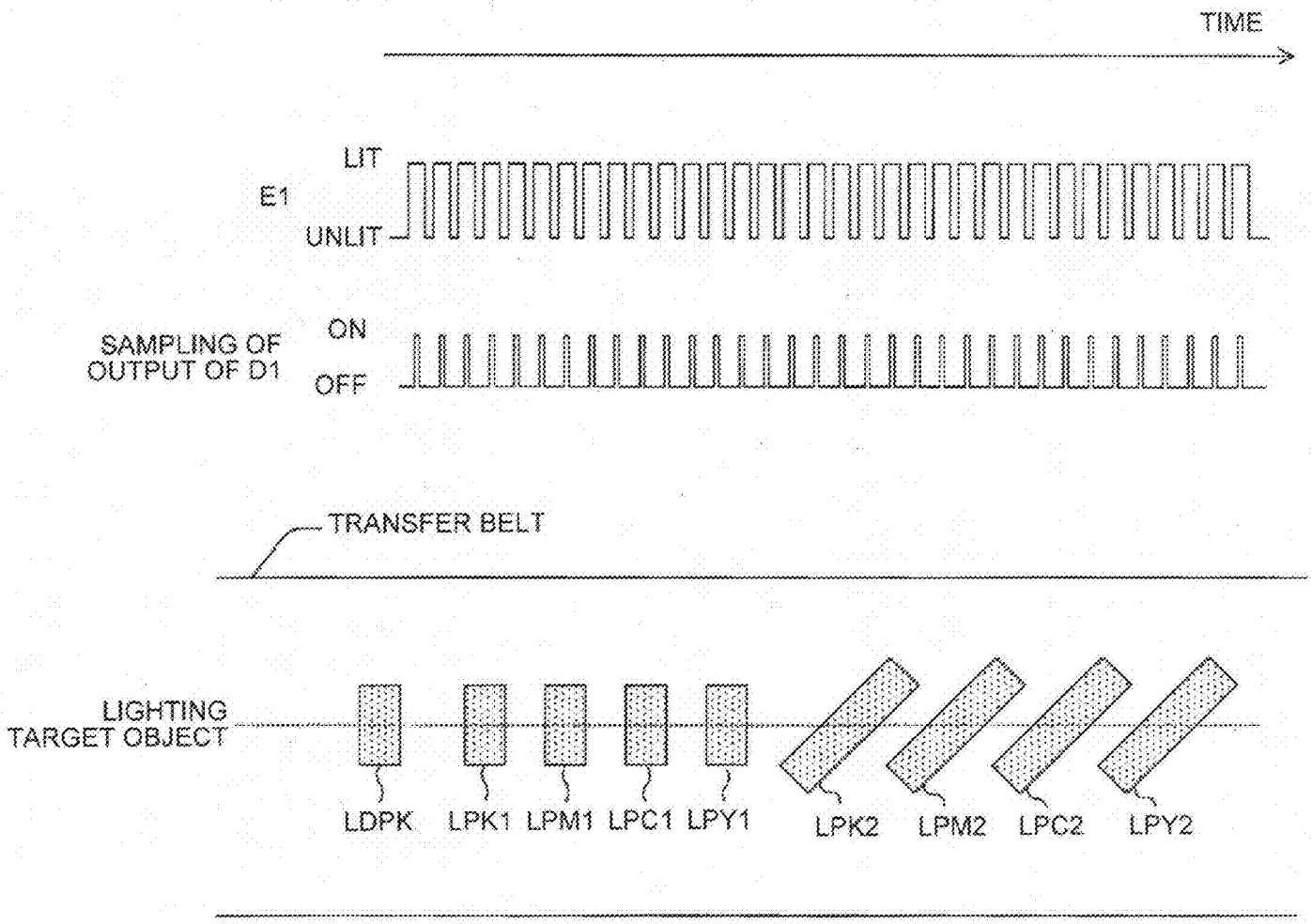
FIG. 51 is an exemplary diagram for describing a second example of sampling timing of a PP pattern array.

FIG. 51 illustrates the sampling timing of the output of the light-receiving element D1 when the light-emitting element E1 is lit in a pulsating manner. Sampling is always performed in synchronization with the lighting timing of the light-emitting element E1.

However, as for the timing at which the output of the light-receiving element is acquired, when the number of times of sampling for each linear pattern as required by the image forming apparatus in order to perform satisfactory positional deviation detection is set, various acquisition timings can be set according to the determination content on the light-emitting element.

(11) In step S321, subsequently, the transfer belt is illuminated with a detection beam, and the output of each light-receiving element is acquired.

For example, as for the DP pattern array, the transfer belt is illuminated with the detection beam S6, and the output of the light-receiving elements D4 to D8 is acquired. Moreover, as for the PP pattern array, the transfer belt is illuminated with the detection beam S1, and the output of the light-receiving elements D1 to D3 is acquired.

(12) In step S323, subsequently, the scanning control device is instructed to create the DP pattern array and the PP pattern array.

In response to this, the scanning control device forms an electrostatic latent image of the density detection pattern DP1 on the photosensitive drum 2030*a*, an electrostatic latent image of the density detection pattern DP2 on the photosensitive drum 2030*b*, an electrostatic latent image of the density detection pattern DP3 on the photosensitive drum 2030*c*, and an electrostatic latent image of the density detection pattern DP4 on the photosensitive drum 2030*d* based on the estimated position of the DP pattern array.

At the same time, the scanning control device forms electrostatic latent images of the linear patterns LPK1 and LPK2 of each PP pattern array on the photosensitive drum 2030*a*, electrostatic latent images of the linear patterns LPM1 and LPM2 of each PP pattern array on the photosensitive drum 2030*b*, electrostatic latent images of the linear patterns LPC1 and LPC2 of each PP pattern array on the photosensitive drum 2030*c*, and electrostatic latent images of the linear patterns LPY1 and LPY2 of each PP pattern array on the photosensitive drum 2030*d* based on the estimated position of the PP pattern array.

Figure 52:
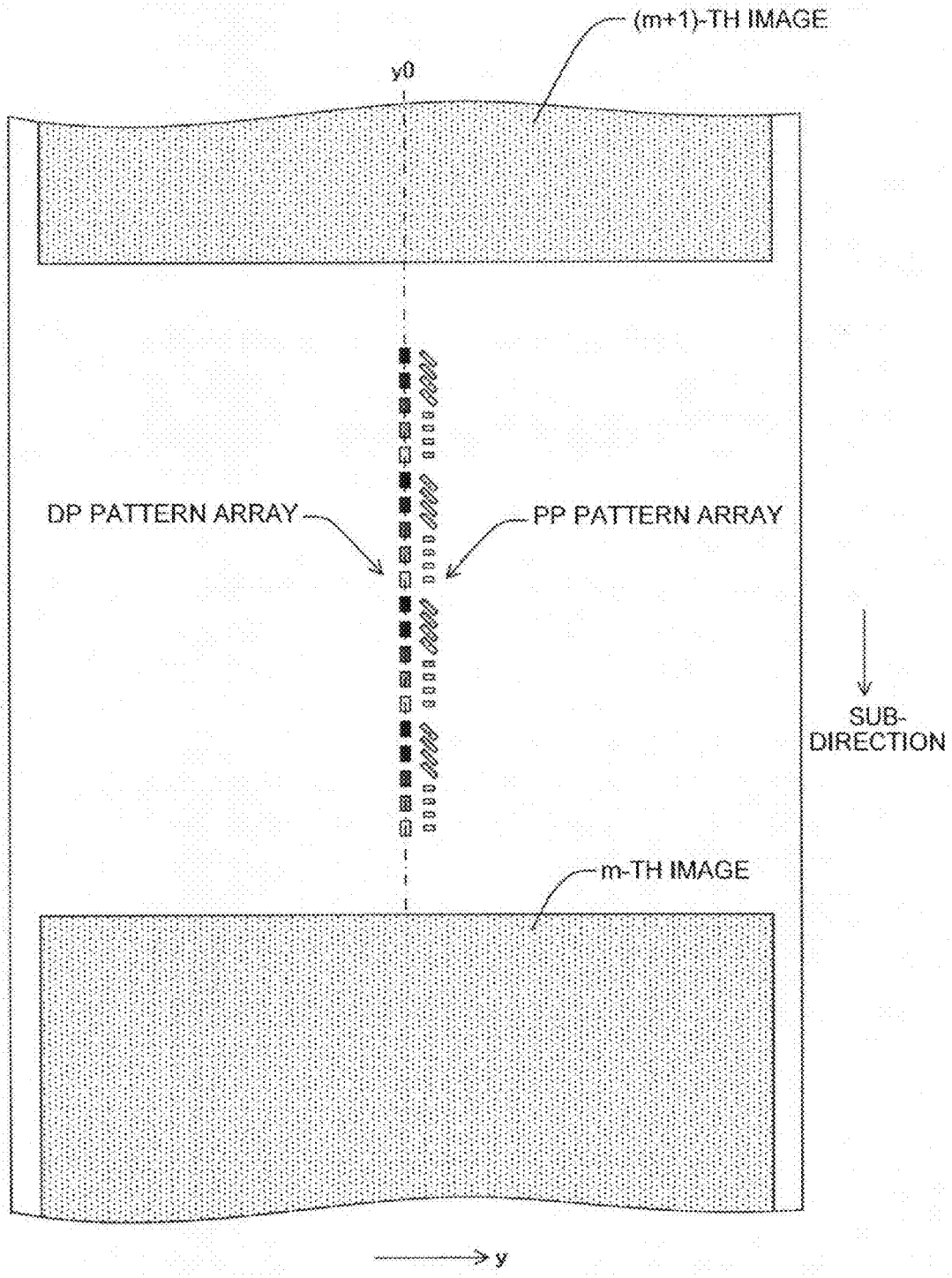
FIG. 52 is an exemplary diagram for describing formation timing of respective pattern arrays.

Moreover, each electrostatic latent image is developed by the corresponding developing unit and is transferred to the transfer belt 2040 at predetermined timing. As a result, the DP pattern array and the PP pattern array are formed subsequently to the m-th image on the transfer belt 2040 (see FIG. 52).

The image forming conditions and the like necessary for forming each pattern are stored in advance in the ROM of the printer control device 2090. Moreover, a density conversion lookup table (LUT) for converting the output of the reflecting optical sensor into a toner density is also stored in advance in the ROM.

(13) In step S325, subsequently, the DP pattern array and the PP pattern array are illuminated with a detection beam, and the output of each light-receiving element is acquired. Since the output of each light-receiving element corresponds to a reception light intensity on each light-receiving element, in the following description, the output of the light-receiving element will be also referred to as a "reception light intensity" for the sake of convenience.

(14) In step S327, subsequently, a toner density of each rectangular pattern of the DP pattern array is calculated.

Figure 53:
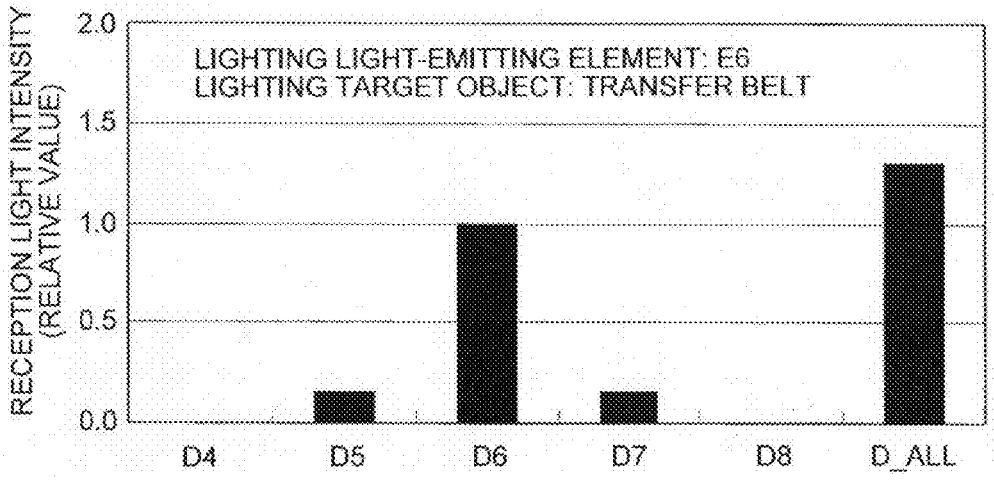
FIG. 53 is an exemplary diagram for describing an output distribution of respective light-receiving elements when a light-emitting element E6 is lit and a lighting target object is a transfer belt.

A reception light intensity distribution for the DP pattern array acquired in step S321 is illustrated in FIG. 53, and a reception light intensity distribution acquired in step S325 is illustrated in FIGS. 54 to 58. In the reception light intensity distributions, the reception light intensity of the light-receiving element D6 when the transfer belt 2040 is illuminated with the detection beam S6 is normalized to "1." Further, D_ALL is the sum of reception light intensities of five light-receiving elements D4 to D8.

FIG. 53 illustrates a reception light intensity distribution of the light-receiving elements D4 to D8 when the detection beam S6 illuminates the transfer belt 2040.

Figure 54:
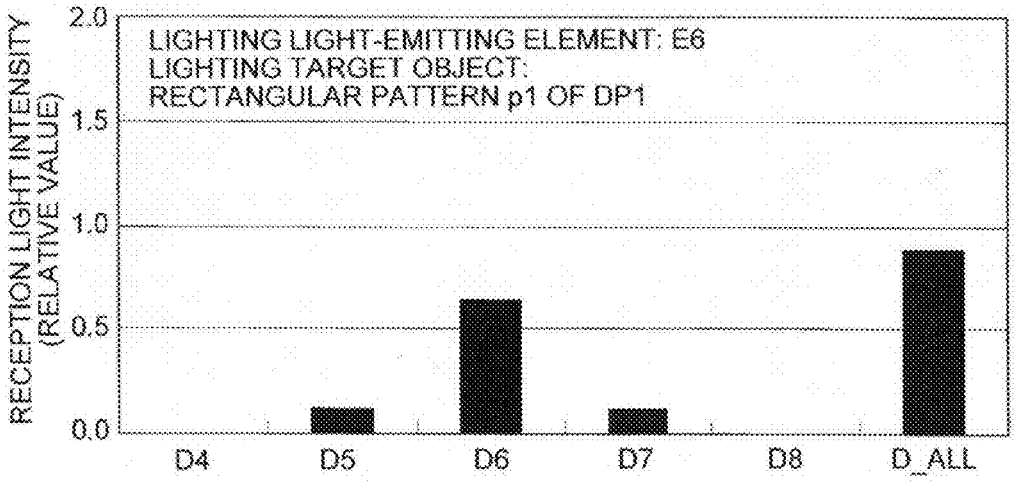
FIG. 54 is an exemplary diagram for describing a reception light intensity distribution of respective light-receiving elements when a light-emitting element E6 is lit and a lighting target object is a rectangular pattern p1 of a density detection pattern DP1.

FIG. 54 illustrates a reception light intensity distribution of the light-receiving elements D4 to D8 when the detection beam S6 illuminates the rectangular pattern p1 of the density detection pattern DP1.

Figure 55:
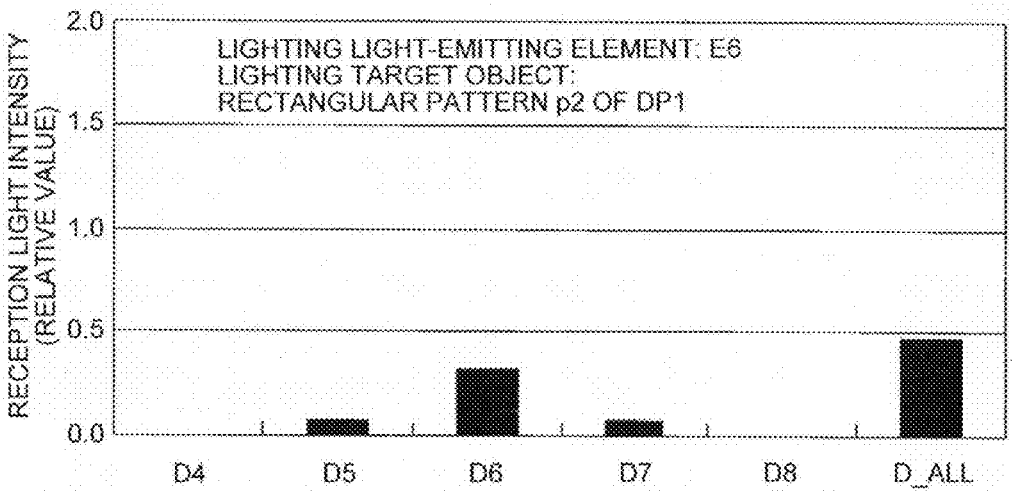
FIG. 55 is an exemplary diagram for describing a reception light intensity distribution of respective light-receiving elements when a light-emitting element E6 is lit and a lighting target object is a rectangular pattern p2 of a density detection pattern DP1.

FIG. 55 illustrates a reception light intensity distribution of the light-receiving elements D4 to D8 when the detection beam S6 illuminates the rectangular pattern p2 of the density detection pattern DP1.

Figure 56:
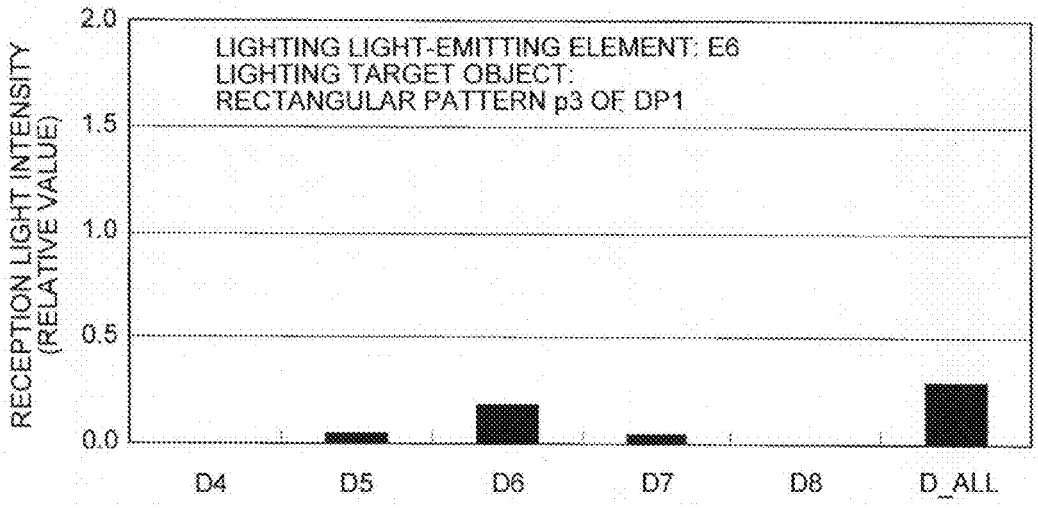
FIG. 56 is an exemplary diagram for describing a reception light intensity distribution of respective light-receiving elements when a light-emitting element E6 is lit and a lighting target object is a rectangular pattern p3 of a density detection pattern DP1.

FIG. 56 illustrates a reception light intensity distribution of the light-receiving elements D4 to D8 when the detection beam S6 illuminates the rectangular pattern p3 of the density detection pattern DP1.

Figure 57:
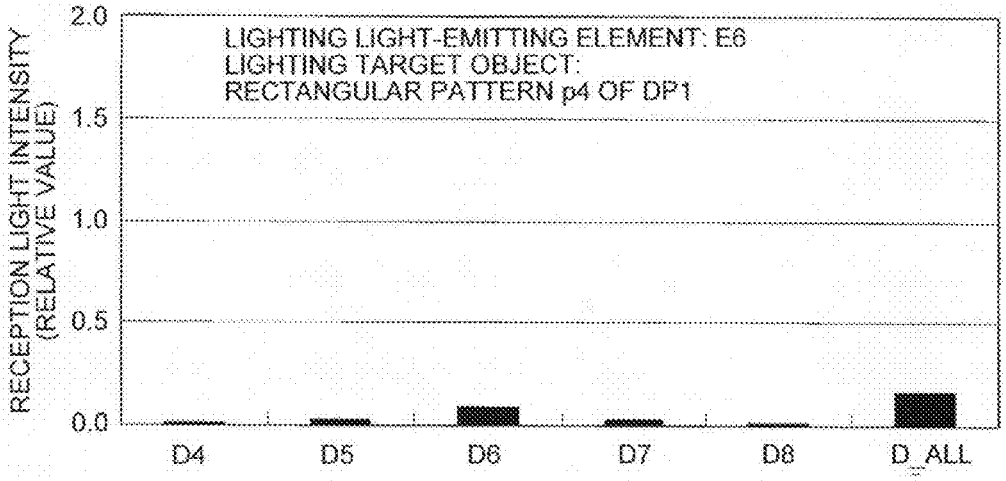
FIG. 57 is an exemplary diagram for describing a reception light intensity distribution of respective light-receiving elements when a light-emitting element E6 is lit and a lighting target object is a rectangular pattern p4 of a density detection pattern DP1.

FIG. 57 illustrates a reception light intensity distribution of the light-receiving elements D4 to D8 when the detection beam S6 illuminates the rectangular pattern p4 of the density detection pattern DP1.

Figure 58:
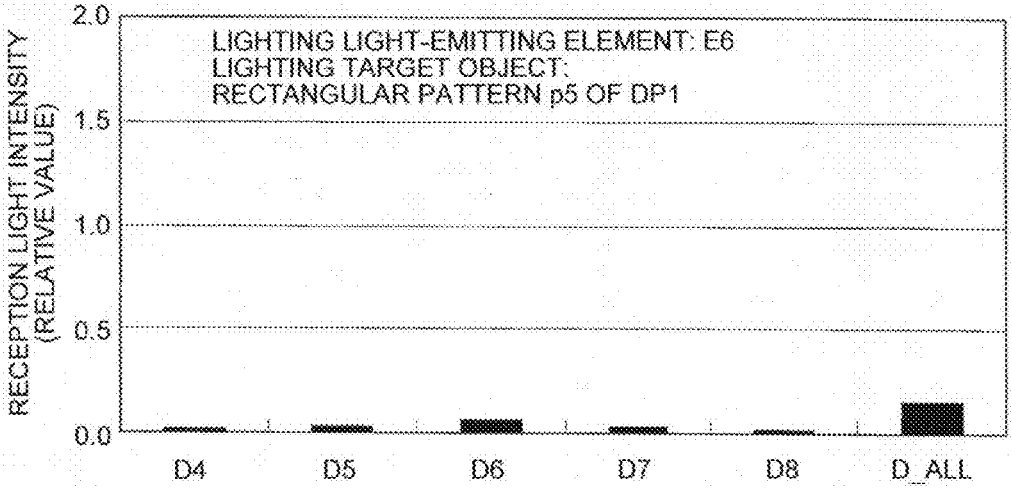
FIG. 58 is an exemplary diagram for describing a reception light intensity distribution of respective light-receiving elements when a light-emitting element E6 is lit and a lighting target object is a rectangular pattern p5 of a density detection pattern DP1.

FIG. 58 illustrates a reception light intensity distribution of the light-receiving elements D4 to D8 when the detection beam S6 illuminates the rectangular pattern p5 of the density detection pattern DP1.

The detection beam emitted to the surface of a rectangular pattern is regularly reflected and diffusely reflected. In the following description, for the sake of convenience, a regularly reflected beam will be also referred to as a "regular reflected light," and a diffusely reflected beam will be also referred to as a "diffuse reflected light."

Figure 59A:
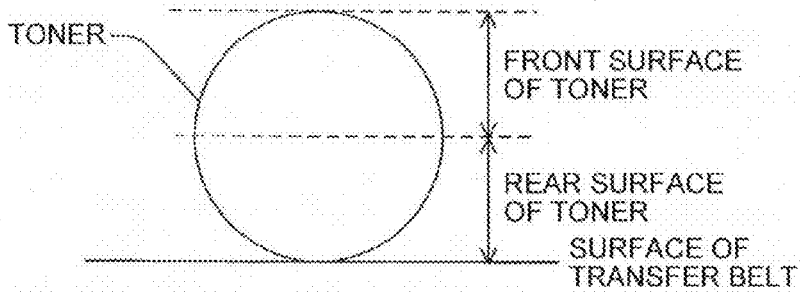
FIGS. 59A to 59D are exemplary diagrams for describing a reflected light from toner.
Figure 59B:
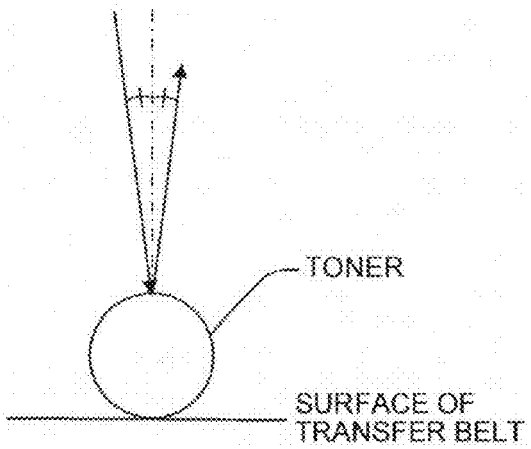

However, when it is assumed that the detection beam emitted from the light-emitting element is a group of light beams from the perspective of geometrical optics and toner has a true sphere shape as illustrated in FIG. 59A, a regular reflected light from toner can be considered as a light beam regularly reflected from an optional one point on a front surface (light-emitting element-side) of the true sphere as illustrated in FIG. 59B.

Figure 59C:
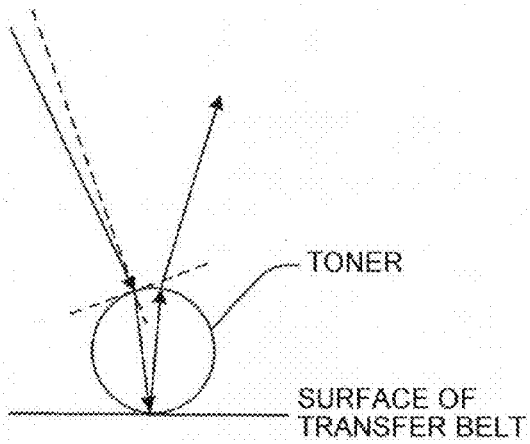
Figure 59D:
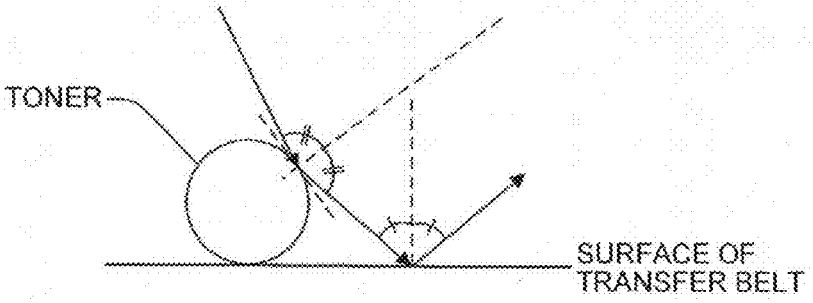

Moreover, a diffuse reflected light from toner is a light beam which is refracted from the front and rear surfaces of the toner, reflected from the transfer belt, refracted again from the rear and front surfaces of the toner, and reaches the light-receiving element as illustrated in FIG. 59C. Further, as illustrated in FIG. 59D, a light beam, which is regularly reflected from the front surface of the toner and reflected from the transfer belt, and reaches the light-receiving element, is also a diffuse reflected light from the toner. The amount of the regular reflected light from the toner is significantly smaller than the amount of the diffuse reflected light from the toner.

Among the reception light intensity of each light-receiving element, a reception light intensity of a light beam that satisfies the condition illustrated in FIG. 59B is a reception light intensity of a regular reflected light from the rectangular pattern. Further, among the reception light intensity of each light-receiving element, the reception light intensity of a light beam which is refracted from the front surface of toner and enters into the toner at least once and the reception light intensity of a light beam which is regularly reflected from the front surface of the toner and reflected from the transfer belt become the reception light intensity of the diffuse reflected light from the rectangular pattern. Furthermore, the light beam refracted from the front surface of the toner includes a light beam that undergoes multiple reflections inside the toner. The reflected light of such a light beam contributes to the reception light intensity of the diffuse reflected light from the rectangular pattern if the reflected light is received by each light-receiving element.

(14-1) Using a reception light intensity (first reference reception light intensity Ds1) of each light-receiving element when the detection beam S3 illuminates the transfer belt, a reception light intensity (second reference reception light intensity Ds2) of each light-receiving element when the detection beam S3 illuminates the rectangular pattern p5, and coefficients α and β having a value from 0 to 1, the reception light intensity of a light-receiving element that receives light reflected from the rectangular pattern is expressed as α×Ds1+β×Ds2 for each rectangular pattern. Moreover, the coefficients α and β are calculated concurrently from a measured value of the reception light intensity of the light-receiving element that receives the light reflected from the rectangular pattern, the first reference reception light intensity Ds1, and the second reference reception light intensity Ds2.

In this example, as an example, the case of the rectangular pattern p4 of the density detection pattern DP1 will be described.

A reception light intensity of the light-receiving element D1 when a lighting target object is the transfer belt will be denoted as $D1_{Belt}$, a reception light intensity of the light-receiving element D2 will be denoted as $D2_{Belt}$, a reception light intensity of the light-receiving element D3 will be denoted as $D3_{Belt}$ a reception light intensity of the light-receiving element D4 will be denoted as $D4_{Belt}$, and a reception light intensity of the light-receiving element D5 will be denoted as $D5_{Belt}$.

Moreover, a reception light intensity of the light-receiving element D1 when a lighting target object is a solid pattern will be denoted as $D1_p$, a reception light intensity of the light-receiving element D2 will be denoted as $D2_p$, a reception light intensity of the light-receiving element D3 will be denoted as $D3_p$, a reception light intensity of the light-receiving element D4 will be denoted as $D4_p$, and a reception light intensity of the light-receiving element D5 will be denoted as $D5_p$.

Furthermore, a reception light intensity of the light-receiving element D1 when a lighting target object is the rectangular pattern p4 will be denoted as $D1_{p4}$, a reception light intensity of the light-receiving element D2 will be denoted as $D2_{p4}$, a reception light intensity of the light-receiving element D3 will be denoted as $D3_{p4}$, a reception light intensity of the light-receiving element D4 will be denoted as $D4_{p4}$, and a reception light intensity of the light-receiving element D5 will be denoted as $D5_{p4}$.

Further, $D1_{p4}'$ to $D5_{p4}'$ are defined by the following equations (1) to (5). Here, 0≤k1≤1 and 0≤k2≤1.

$$D1_{p4}'=k1\cdot D1_{Belt}+k2\cdot D1_p \quad (1)$$

$$D2_{p4}'=k1\cdot D2_{Belt}+k2\cdot D2_p \quad (2)$$

$$D3_{p4}'=k1\cdot D3_{Belt}+k2\cdot D3_p \quad (3)$$

$$D4_{p4}'=k1\cdot D4_{Belt}+k2\cdot D4_p \quad (4)$$

$$D5_{p4}'=k1\cdot D5_{Belt}+k2\cdot D5_p \quad (5)$$

Next, δD1 to δD5 are defined by the following equations (6) to (10).

$$\delta D1=(D1_{p4}-D1_{p4}')^2\div D1_{p4}^2 \quad (6)$$

$$\delta D2=(D2_{p4}-D2_{p4}')^2\div D2_{p4}^2 \quad (7)$$

$$\delta D3=(D3_{p4}-D3_{p4}')^2\div D3_{p4}^2 \quad (8)$$

$$\delta D4=(D4_{p4}-D4_{p4}')^2\div D4_{p4}^2 \quad (9)$$

$$\delta D5=(D5_{p4}-D5_{p4}')^2\div D5_{p4}^2 \quad (10)$$

Moreover, the values of k1 and k2 when the value of δD illustrated in the following equation (11) amounts to the minimum are set to the coefficients α and β. That is, the coefficients α and β are obtained using a method of weighted least squares.

$$\delta D=\delta D1+\delta D2+\delta D3+\delta D4+\delta D5 \quad (11)$$

The coefficients α and β for the rectangular patterns p1 to p5 obtained in this manner are illustrated in FIG. 60. In the figure, DP1_p1 to DP1_p5 stand for the rectangular patterns p1 to p5 of the density detection pattern DP1.

FIG. 61A illustrates a reception light intensity distribution calculated using the coefficients α and β and a measured reception light intensity distribution when the lighting target object is the rectangular pattern p1.

FIG. 61B illustrates a reception light intensity distribution calculated using the coefficients α and β and a measured reception light intensity distribution when the lighting target object is the rectangular pattern p2.

Figure 62A:
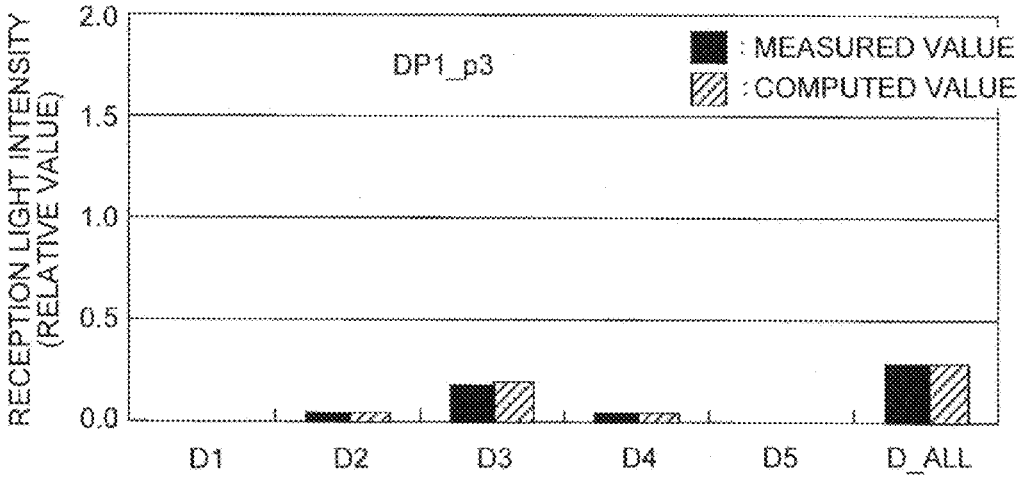
FIGS. 62A and 62B are second exemplary diagrams for describing a measured value and a calculated value.

FIG. 62A illustrates a reception light intensity distribution calculated using the coefficients α and β and a measured reception light intensity distribution when the lighting target object is the rectangular pattern p3.

Figure 62B:
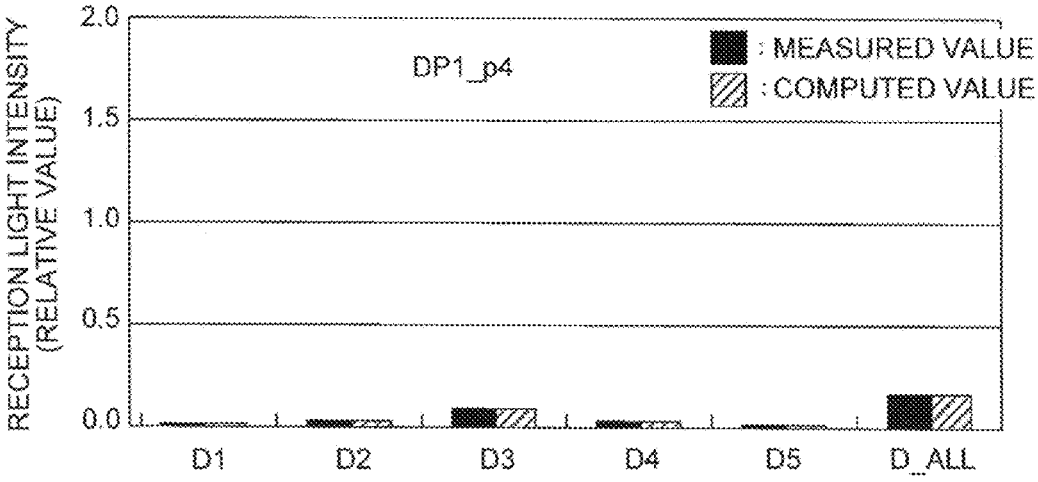

FIG. 62B illustrates a reception light intensity distribution calculated using the coefficients α and β and a measured reception light intensity distribution when the lighting target object is the rectangular pattern p4.

However, in general, since the reflectivity of a transfer belt is larger than the reflectivity of toner, if a method of least squares is used as $\delta Di=(Di_{p4}-Di_{p4}')$ rather than applying weights in the equations (6) to (10), there is a problem in that the coefficient β is suppressed to be small.

As the denominator in the right side of the equations (6) to (10), $Di_{p4}^{1/2}$ or $Di_{p4}^3$ may be used instead of $Di_{p4}^2$.

Further, when a plurality of measured values is present for each lighting target object, the coefficients α and β can be obtained similarly using an average value. This case will be described.

An average reception light intensity of the light-receiving element D1 when a lighting target object is the transfer belt will be denoted as $avD1_{Belt}$, an average reception light intensity of the light-receiving element D2 will be denoted as $avD2_{Belt}$, an average reception light intensity of the light-receiving element D3 will be denoted as $avD3_{Belt}$, an average reception light intensity of the light-receiving element D4 will be denoted as $avD4_{Belt}$, and an average reception light intensity of the light-receiving element D5 will be denoted as $avD5_{Belt}$.

Moreover, an average reception light intensity of the light-receiving element D1 when a lighting target object is a solid pattern will be denoted as $avD1_p$, an average reception light intensity of the light-receiving element D2 will be denoted as $avD2_p$, an average reception light intensity of the light-receiving element D3 will be denoted as $avD3_p$, an average reception light intensity of the light-receiving element D4 will be denoted as $avD4_p$, and an average reception light intensity of the light-receiving element D5 will be denoted as $avD5_p$.

Furthermore, an average reception light intensity of the light-receiving element D1 when a lighting target object is the rectangular pattern p4 will be denoted as $avD1_{p4}$, an average reception light intensity of the light-receiving element D2 will be denoted as $avD2_{p4}$, an average reception light intensity of the light-receiving element D3 will be denoted as $avD3_{p4}$, an average reception light intensity of the light-receiving element D4 will be denoted as $avD4_{p4}$, and an average reception light intensity of the light-receiving element D5 will be denoted as $avD5_{p4}$. Further, the value of a standard deviation of the reception light intensities of the respective light-receiving elements in this case will be denoted as a $\sigma Di_{P4}$.

Further, $avD1_{p4}'$ to $avD5_{p4}'$ are defined by the following equations (12) to (16).

$$avD1_{p4}'=k1\cdot avD1_{Belt}+k2\cdot avD1_{p} \quad (12)$$

$$avD2_{p4}'=k1\cdot avD2_{Belt}+k2\cdot avD2_{p} \quad (13)$$

$$avD3_{p4}'=k1\cdot avD3_{Belt}+k2\cdot avD3_{p} \quad (14)$$

$$avD4_{p4}'=k1\cdot avD4_{Belt}+k2\cdot avD4_{p} \quad (15)$$

$$avD5_{p4}'=k1\cdot avD5_{Belt}+k2\cdot avD5_{p} \quad (16)$$

Next, δavD1 to δavD5 are defined by the following equations (17) to (21).

$$\delta avD1=(avD1_{p4}-avD1_{p4}')^2\div\sigma Di_{p4}^2 \quad (17)$$

$$\delta avD2=(avD2_{p4}-avD2_{p4}')^2\div\sigma Di_{p4}^2 \quad (18)$$

$$\delta avD3=(avD3_{p4}-avD3_{p4}')^2\div\sigma Di_{p4}^2 \quad (19)$$

$$\delta avD4=(avD4_{p4}-avD4_{p4}')^2\div\sigma Di_{p4}^2 \quad (20)$$

$$\delta avD5=(avD5_{p4}-avD5_{p4}')^2\div\sigma Di_{p4}^2 \quad (21)$$

Moreover, the values of k1 and k2 when the value of δavD illustrated in the following equation (22) amounts to the minimum are set to the coefficients α and β.

$$\delta avD=\delta avD1+\delta avD2+\delta avD3+\delta avD4+\delta avD5 \quad (22)$$

As the denominator in the right side of the equations (17) to (21), $avDi_{p4}^2$, $avDi_{p4}^{1/2}$ or $avDi_{p4}^3$ may be used instead of $\sigma Di_{p4}^2$.

(14-2) The reception light intensity of each light-receiving element is divided into the reception light intensity of a regular reflected light and the reception light intensity of a diffuse reflected light. In this example, α×Ds1 corresponds to the reception light intensity of the regular reflected light and β×Ds2 corresponds to the reception light intensity of the diffuse reflected light. Further, the reception light intensity of the diffuse reflected light when the lighting target object is the transfer belt 2040 and the reception light intensity of the regular reflected light when the lighting target object is the solid pattern are set to 0.

For each density detection pattern, values (denoted by "Dα" and "Dβ") respectively obtained by multiplying the coefficients α and β with D_ALL when the lighting target object is the transfer belt and D_ALL when the lighting target object is the rectangular patterns p1 to p5 are obtained.

Figure 63:
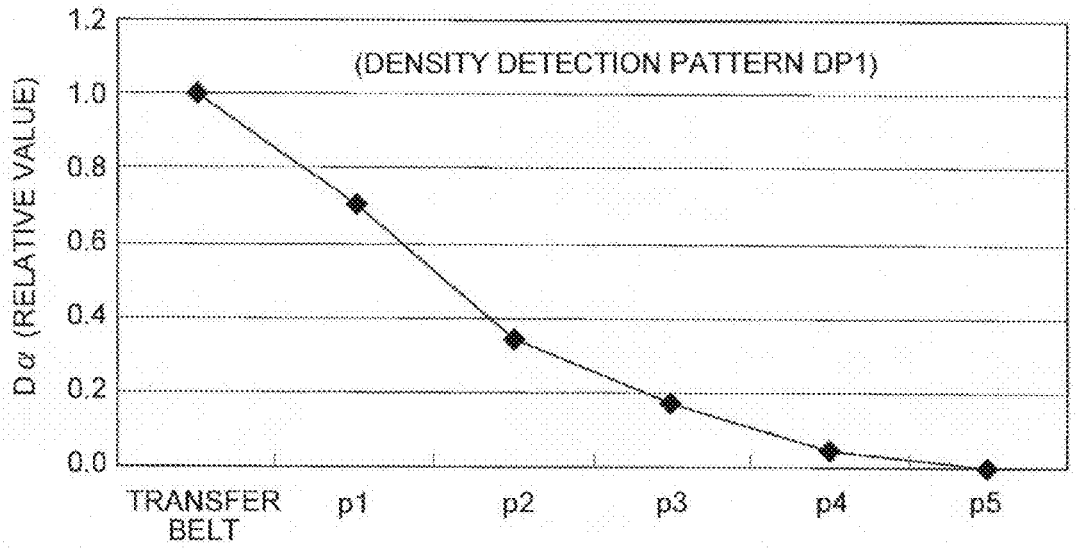
FIG. 63 is an exemplary diagram for describing a relation between $D\alpha$ (relative value) and a lighting target object.

FIG. 63 illustrates Dα (that is, the reception light intensity of the regular reflected light) on the transfer belt and the density detection pattern DP1. According to this figure, Dα decreases as the toner density increases, and Dα and the toner density are in a one-to-one correspondence. In FIG. 63, the maximum value is set to 1.

Figure 64:
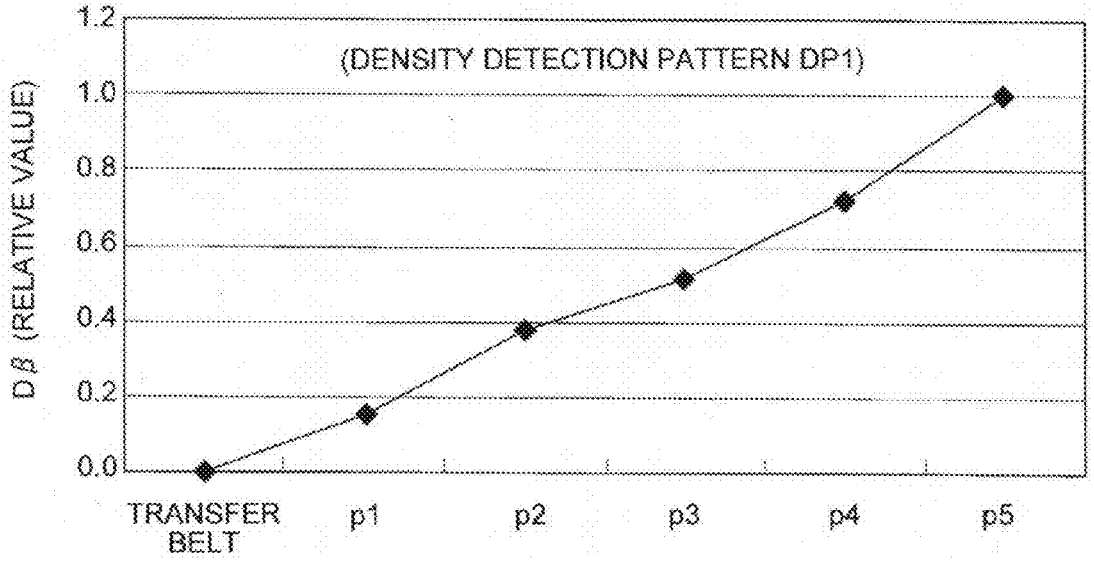
FIG. 64 is an exemplary diagram for describing a relation between $D\beta$ (relative value) and a lighting target object.

FIG. 64 illustrates Dβ (that is, the reception light intensity of the diffuse reflected light) on the transfer belt and the density detection pattern DP1. According to this figure, Dβ increases as the toner density increases, and Dβ and the toner density are in a one-to-one correspondence. In FIG. 64, the maximum value is set to 1.

(14-3) The toner density is calculated. In this example, the toner density of each rectangular pattern is calculated from the computed values of the Dα or Dβ of each rectangular pattern with reference to the density conversion lookup table (LUT) stored in the ROM of the printer control device 2090.

(15) In step S329, subsequently, a positional deviation amount of the linear pattern of the PP pattern array is calculated.

Figure 65:
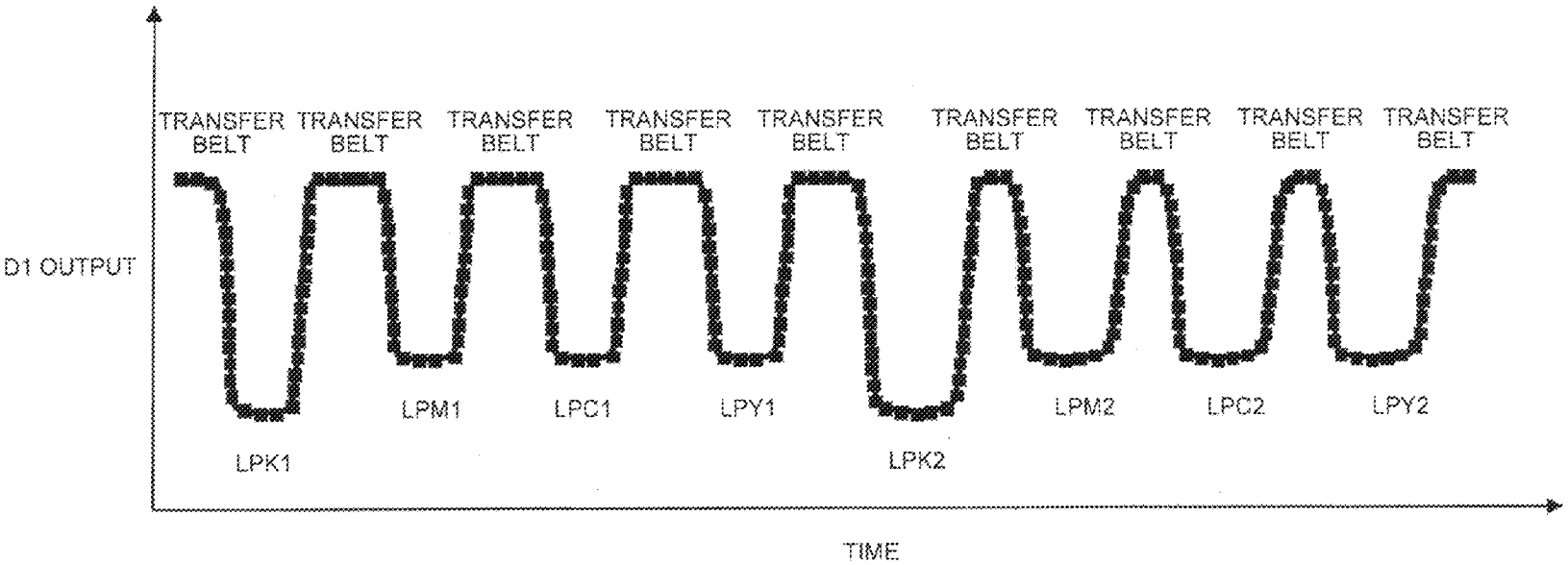
FIG. 65 is an exemplary diagram for describing an output value of a light-receiving element D1 acquired in correspondence to the first example of sampling timing of the PP pattern array.
Figure 66:
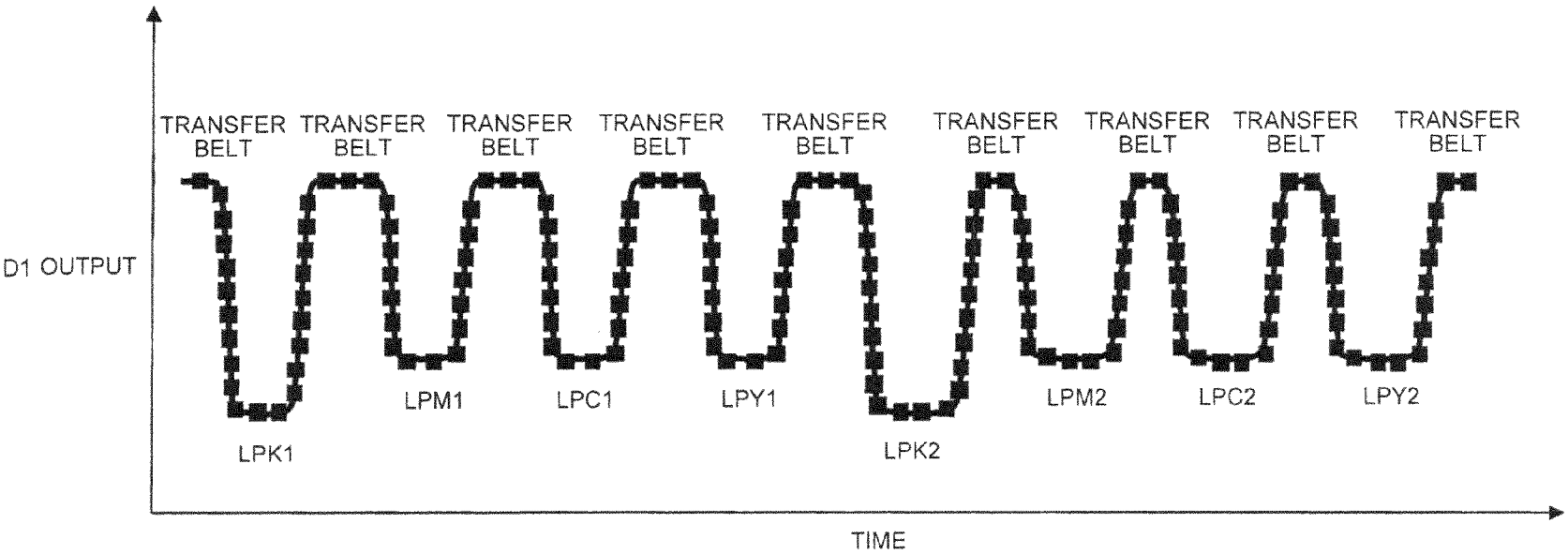
FIG. 66 is an exemplary diagram for describing an output value of a light-receiving element D1 acquired in correspondence to the second example of sampling timing of the PP pattern array.

As an example, FIG. 65 illustrates a change in the output of the light-receiving element D1 when the light-emitting element E1 is always lit. Further, as an example, FIG. 66 illustrates a change in the output of the light-receiving element D1 when the light-emitting element E1 is lit in a pulsating manner. "Transfer belt" in FIGS. 65 and 66 means that the lighting target object is a transfer belt, and "LPK1" to "LPY2" means that the lighting target object is "LPK1" to "LPY2." Further, in the following description, a change in the output of the light-receiving element will be also referred to as an "output waveform."

(15-1) First, a calculated detection time of each linear pattern is obtained.

Figure 67:
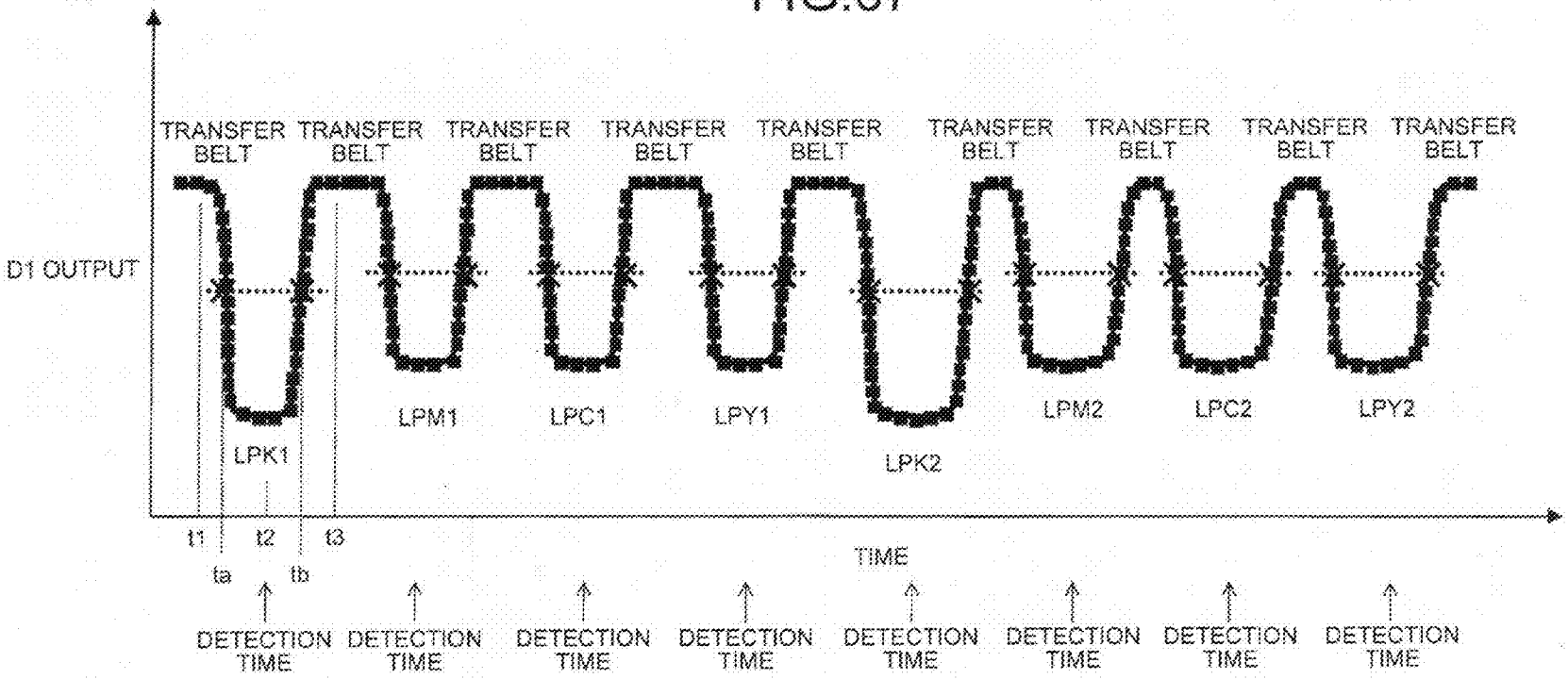
FIG. 67 is an exemplary diagram for describing a detection position of each linear pattern in correspondence to FIG. 65.

A method of obtaining a calculated detection time of the linear pattern LPK1 from the output waveform will be described with reference to FIG. 67. In this example, the time starts when lighting of a light-emitting element starts.

An average value of the output of the light-receiving element D1 within an optional period around time (t1) immediately before a falling edge of the output waveform of the linear pattern LPK1 and an average value of the output of the light-receiving element D1 within an optional period around time (t3) immediately after a rising edge of the output waveform are obtained. As can be easily understood, these average values take the same value, and this value is set to D_Belt.

An average value of the output of the light-receiving element D1 within an optional period around time (t2) when the entire detection beam S6 illuminates the linear pattern LPK1 is obtained, and this value is set to D_Bk. Moreover, a difference value between D_Belt and D_Bk is obtained. This difference value is set to D_BB.

The points in time (ta, tb) corresponding to a value obtained by adding 50% of D_BB to D_Bk are obtained one by one in a falling region of the output waveform and a rising region of the output waveform.

An average value of the two points in time (ta, tb) is obtained. A time corresponding to the average value is a detection time of the linear pattern LPK1. In the following description, obtaining the detection time of a linear pattern in this manner is also referred to as "detecting a pattern at a 50% threshold level."

However, depending on a sampling frequency of the light-receiving element, there is a case where the number of items of data of the output per unit time of the light-receiving element D1 is small, and a time corresponding to a value obtained by adding 50% of D_BB to D_Bk is not present in acquired data. In this case, by linearly interpolating two data points closest to a desired data point, a virtually desired data point (in this example, the time corresponding to the value obtained by adding 50% of D_BB to D_Bk) is obtained.

When obtaining the detection time of the linear pattern LPK1, although the time at which the output of the light-receiving element D1 has the value obtained by adding 50% of D_BB to D_Bk is obtained, the value is not limited to 50% of D_BB. For example, a time corresponding to a value obtained by adding 40% or 60% of D_BB to D_Bk may be obtained to obtain the detection position of the linear pattern LPK1. That is, the threshold level may be 40% or 60%. In an ideal case, even when the detection time is obtained by adding any one of 40%, 50%, and 60% of D_BB to D_Bk, substantially the same results are obtained.

Subsequently, the detection time of another linear pattern is obtained in a similar manner.

Figure 68:
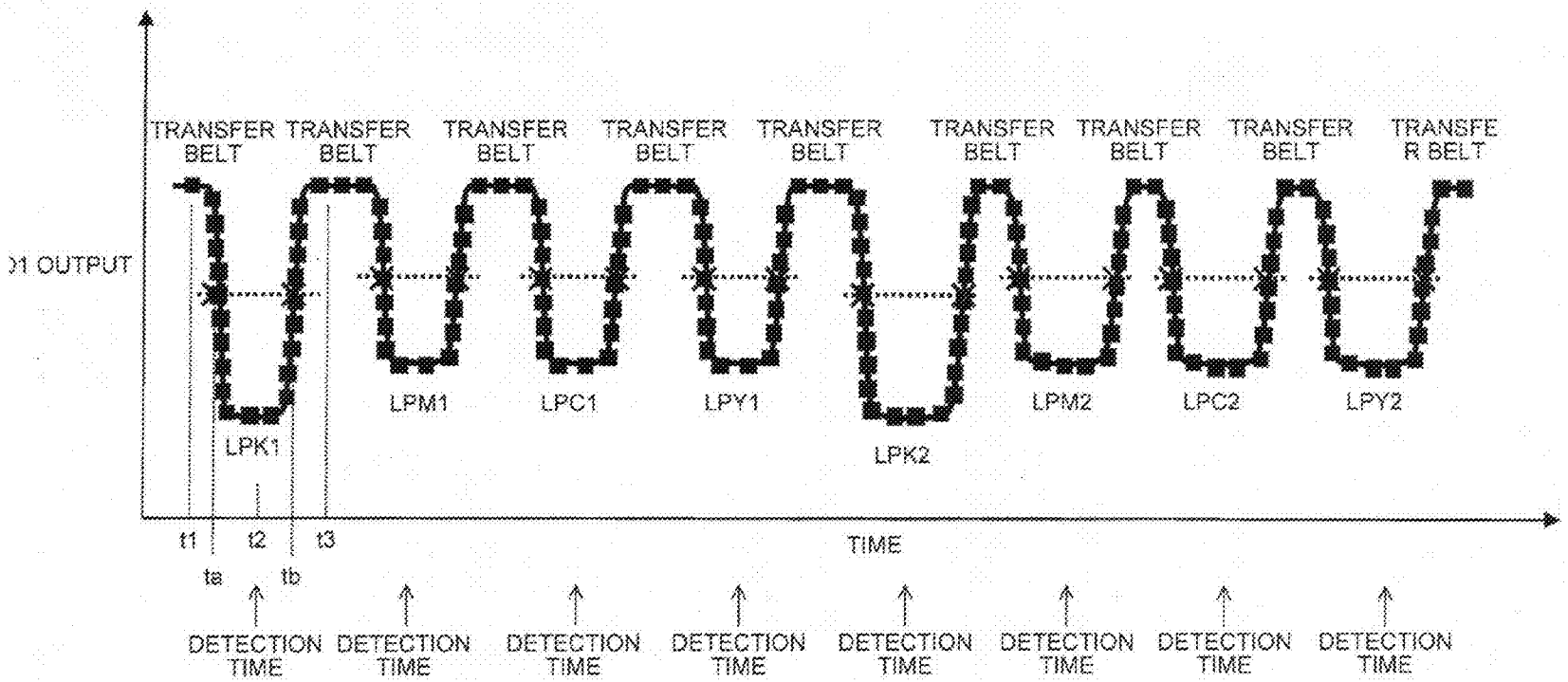
FIG. 68 is an exemplary diagram for describing a detection position of each linear pattern in correspondence to FIG. 66.

In the above description, although a case where the light-emitting element E1 is always lit has been described, it is possible to obtain the detection time according to the same method as the above method even when the output waveform of the light-receiving element D1 when the light-emitting element E1 is lit in a pulsating manner is also used (see FIG. 68). In this case, the output of the light-receiving element is acquired in synchronization with the pulse frequency of the light-emitting element. Thus, depending on the pulse frequency, there may be a case where the number of items of data of the output per unit time of the light-receiving element D1 is small, and a data point corresponding to each threshold level is not present. In this case, by linearly interpolating two data points closest to a desired data point, a virtually desired data point may be obtained and then the above method may be applied.

Further, in general, the sampling frequency of the light-receiving element may be set to be higher than the pulse frequency of the light-emitting element. Thus, the number of items of data of the output per unit time of the light-receiving element D1 when the light-emitting element E1 is always lit becomes larger than that when the light-emitting element E1 is lit in a pulsating manner, and the accuracy of the linear interpolation also increases. As a result, the positional deviation detection accuracy also increases. A method of calculating the detection time of the linear pattern is not limited to the above method.

Figure 69:
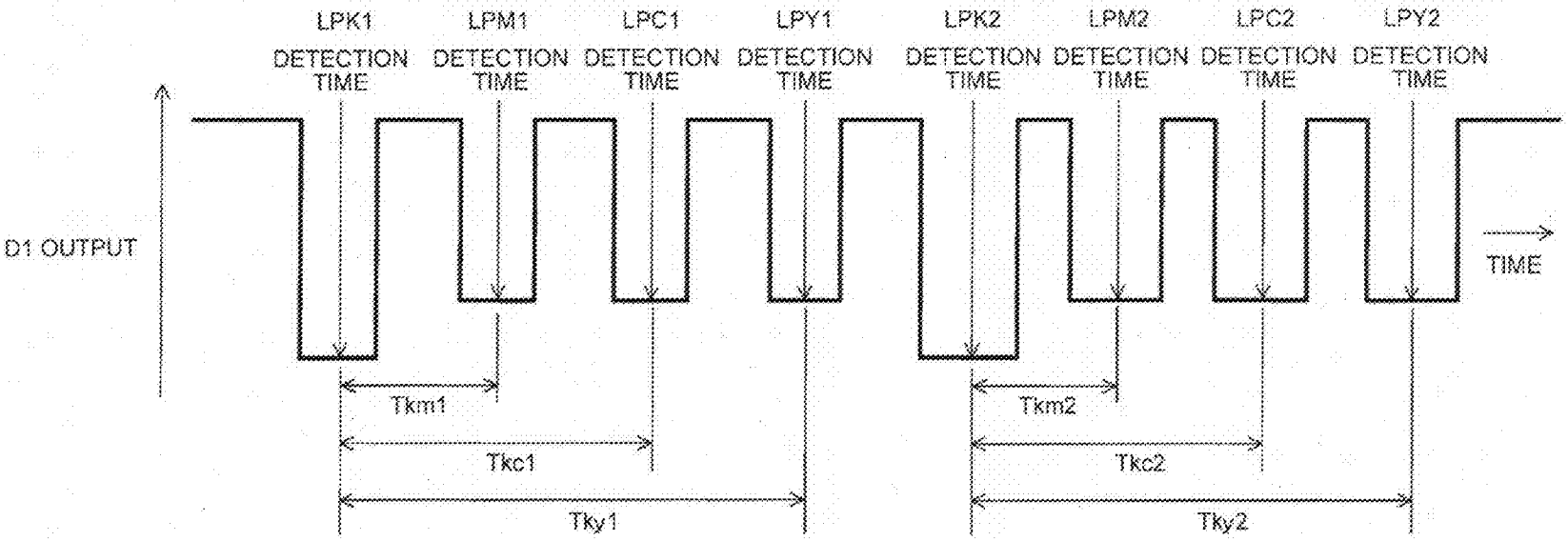
FIG. 69 is an exemplary diagram for describing calculation of a positional deviation amount.

(15-2) As an example, as schematically illustrated in FIG. 69, a period Tkm1 from the detection time of the linear pattern LPK1 to the detection time of the linear pattern LPM1 in the output waveform of the light-receiving element D1, a period Tkc1 from the detection time of the linear pattern LPK1 to the detection time of the linear pattern LPC1, and a period Tky1 from the detection time of the linear pattern LPK1 to the detection time of the linear pattern LPY1 are obtained for each positional deviation detection pattern.

Further, a period Tkm2 from the detection time of the linear pattern LPK2 to the detection time of the linear pattern LPM2 in the output waveform of the light-receiving element D1, a period Tkc2 from the detection time of the linear pattern LPK2 to the detection time of the linear pattern LPC2, and a period Tky2 from the detection time of the linear pattern LPK2 to the detection time of the linear pattern LPY2 are obtained for each positional deviation detection pattern.

(15-3) The obtained four periods Tkm1, four periods Tkc1, four periods Tky1, four periods Tkm2, four periods Tkc2, and four periods Tky2 are averaged respectively to obtain the periods Tkm1, Tkc1, Tky1, Tkm2, Tkc2, and Tky2 on the PP pattern array. In the averaging, if an obviously abnormal value is included, the value may be excluded.

(15-4) Differences (denoted as time differences ΔTm1, ΔTc1, and ΔTy1) between the periods Tkm1, Tkc1, and Tky1 on the PP pattern array and reference periods thereof obtained in advance are obtained. If the time difference is within an allowable range, it is determined that a positional relation in the sub-direction of a toner image of the corresponding color to a toner image of black is appropriate. On the other hand, if the time difference is not within the allowable range, it is determined that there is a deviation in the positional relation in the sub-direction of the toner image of the corresponding color to the toner image of black. In this case, the printer control device 2090 obtains a deviation amount (denoted as deviation amount ΔS1) of the positional relation from the time difference and sends the deviation amount ΔS1 to the scanning control device.

(15-5) Further, differences (denoted as time differences ΔTm2, ΔTc2, and ΔTy2) between the periods Tkm2, Tkc2, and Tky2 on the PP pattern array and reference periods thereof obtained in advance are obtained. If the time difference is within an allowable range, it is determined that a positional relation in the main direction of a toner image of the corresponding color to a toner image of black is appropriate. On the other hand, if the time difference is not within the allowable range, it is determined that there is a deviation in the positional relation in the main direction of the toner image of the corresponding color to the toner image of black. In this case, the printer control device 2090 obtains a deviation amount (denoted as deviation amount ΔS2) of the positional relation from the time difference and sends the deviation amount ΔS2 to the scanning control device.

Figure 70A:
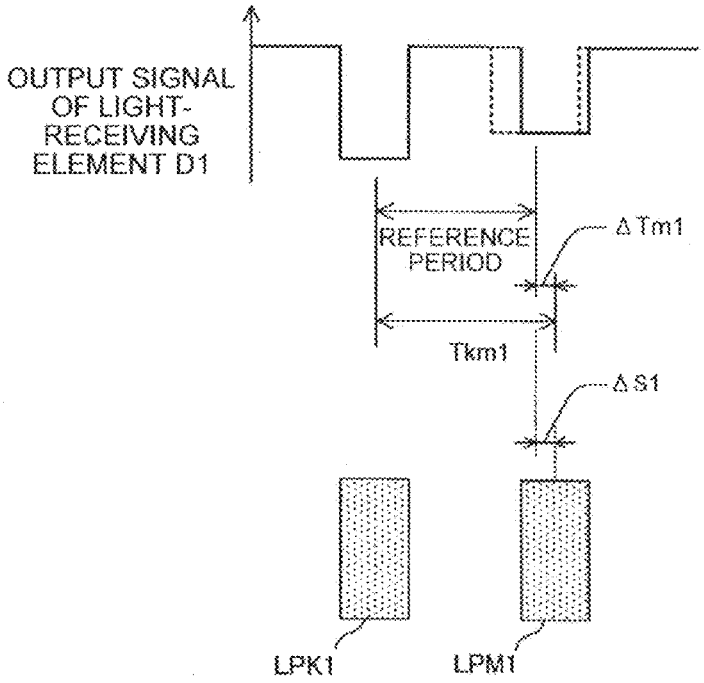
FIGS. 70A and 70B are exemplary diagrams for describing a positional deviation amount of a linear pattern of magenta.
Figure 70B:
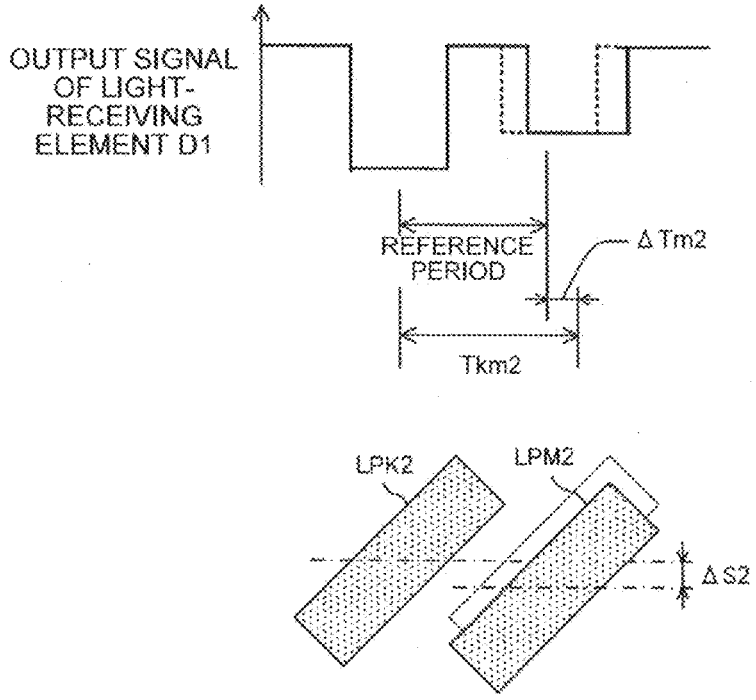

As an example, a case where the time difference ΔTm1 is not within the allowable range is schematically illustrated in FIG. 70A. Further, a case where the time difference ΔTm2 is not within the allowable range is schematically illustrated in FIG. 70B. In this case, the printer control device 2090 obtains a positional deviation amount ΔS2 in the main direction of the toner image of magenta to the toner image of black using the following equation (23). In this equation, "V" is a moving speed of the transfer belt 2040 in the sub-direction.

$$\Delta S2 = V \cdot \Delta Tm2 \cdot \cot 45° \quad (23)$$

(16) In step S331, subsequently, the image process control is performed.

In this example, a deviation amount of a toner density is obtained for each color of toner from the toner density obtained in the toner density calculation step. Moreover, when the deviation amount of the toner density exceeds an allowable limit, the toner density is controlled so that the toner density reaches a target toner density or the deviation amount of the toner density is within an allowable limit.

For example, developing potential control, gradation control, and the like are performed in the corresponding image forming station according to the toner density deviation amount.

In the developing potential control, a developing potential (developing bias—solid exposure potential) is controlled in order to secure a desired image density (for example, solid density). That is, from the relation between the toner density and the developing potential obtained from the density detection pattern, a developing gamma γ (an inclination between a developing potential on the horizontal axis and a toner density on the vertical axis) and a development start voltage Vk (an x-intercept at the time of a developing potential on the horizontal axis (x-axis) and a toner density on the vertical axis) are obtained. Moreover, a developing potential necessary for securing a desired image density is determined using the following equation (24), and the image forming conditions (exposure power, charging bias, and developing bias) are determined based on the developing potential.

$$\text{Necessary Developing Potential } [-\text{kV}] = \text{Desired Image Density (Toner Density) } [\text{mg/cm}^2]/\text{Developing Gamma } \gamma\ [(\text{mg/cm}^2)/(-\text{kV})] + \text{Development Start Voltage Vk } [-\text{kV}] \quad (24)$$

Although the developing gamma γ is maintained to be approximately constant if a toner charging amount and a developing potential are constant, a change in the toner charging amount is not avoidable in an environment where temperature and humidity are changed, and the tone of an intermediate gradation region changes. Gradation control is performed in order to correct this. The gradation control may use the same density detection pattern as used in the developing potential control.

Further, in the gradation control, a gradation correction LUT (lookup table) is appropriately changed so that a deviation between an obtained tone and a target tone is eliminated. Specifically, a method of rewriting to a new gradation correction LUT on an as-needed basis and a method of selection an optimal one from a plurality of gradation correction LUTs prepared in advance may be used.

Further, in the positional deviation amount calculation step, if there is a deviation in the positional relation in the sub-direction with respect to the toner image of black, the timing of writing an image to the corresponding photosensitive drum, for example, is changed so that the deviation amount approximately reaches 0.

Further, in the positional deviation amount calculation step, if there is a deviation in the positional relation in the main direction with respect to the toner image of black, the phase of a pixel clock when an image is written to the corresponding photosensitive drum, for example, is adjusted so that the deviation amount approximately reaches 0.

As obvious from the above description, in the color printer 2000 according to this embodiment, the reflecting optical sensor 2245 forms a reflecting optical sensor of an image forming apparatus. Further, the printer control device 2090 forms a processing device of an image forming apparatus of the embodiment.

As described above, the color printer 2000 according to this embodiment includes four photosensitive drums (2030*a*, 2030*b*, 2030*c*, and 2030*d*), four image forming units (2034*a*, 2034*b*, 2034*c*, and 2034*d*), the optical scanning device 2010, the transfer belt 2040, the reflecting optical sensor 2245, the printer control device 2090, and the like.

The reflecting optical sensor 2245 includes an emitting system including eleven light-emitting elements (E1 to E11), an illumination optical system including eleven illumination microlenses (LE1 to LE11), a light-receiving optical system including eleven light-receiving microlenses (LD1 to LD11), a light-receiving system including eleven light-receiving elements (D1 to D11), and the like. Moreover, the size (diameter) of the detection beam spot is 0.40 mm which is the same as the interval Le of the light-emitting elements.

The printer control device 2090 forms the DP pattern array for detecting the toner density and the PP pattern array for detecting the positional deviation on the transfer belt 2040 so that the pattern arrays are adjacent to each other in the main direction with the aid of the optical scanning device 2010 and the four image forming stations. Moreover, a dimension of each pattern array in the main direction is 1 mm, and a center-to-center distance between the DP pattern array and the PP pattern array in the main direction is 2 mm.

In this case, the reflecting optical sensor 2245 causes the DP pattern array and the PP pattern array to be simultaneously and individually illuminated with light from the emitting system and causes the light beams reflected from the DP pattern array and the PP pattern array to be simultaneously and individually received by the light-receiving system.

Thus, the printer control device 2090 can perform toner density detection and positional deviation detection in a shorter period than the conventional technique. As a result, it is possible to shorten the period required for the image process control as compared to the conventional technique.

Further, in the reflecting optical sensor 2245, the distance between the light-emitting element Ei and the light-receiving element Di is 0.5 mm, and the distances between light-emitting elements and between light-receiving elements in relation to the main direction are both 0.4 mm. Thus, the size of the reflecting optical sensor 2245 in the main direction is approximately 5 mm. Therefore, it is possible to suppress an increase in the size of the image forming apparatus as compared to a case of using the conventional reflecting optical sensor.

Furthermore, since the size of the toner pattern can be decreased as compared to the conventional technique, it is possible to shorten the time required for the density detection and the positional deviation detection as compared to the conventional technique. Further, it is possible to greatly decrease the amount of consumption of non-contributing toner as compared to the conventional technique.

Since the DP pattern array and the PP pattern array are formed on a portion (so-called paper interval) of the transfer belt 2040 where no image is formed, between the m-th image and the (m+1)-th image, it is possible to perform density detection and positional deviation detection without stopping a printing operation. Thus, it is possible to increase the number of prints per unit time as compared to the conventional technique and to shorten a user standby period as compared to the conventional technique. That is, it is possible to suppress a decrease in efficiency of the image forming operation.

Furthermore, in the reflecting optical sensor according to this embodiment, since the light-emitting element and the light-receiving element are adjacent to each other, it is possible to decrease an incidence angle and a reflection angle of a detection beam on a lighting target object. As a result, it is possible to reduce a detection error resulting from a shadow factor in which the transfer belt becomes a shadow of toner and clattering of the transfer belt (a variation in the distance between the reflecting optical sensor and the transfer belt).

Further, since a dummy pattern which is illuminated with a light beam emitted from the emitting system is added in advance to the DP pattern array and the PP pattern array, it is possible to grasp the positions of the DP pattern array and the PP pattern array in the main direction in advance. In this case, it is possible to suppress a decrease in the detection accuracy in the density detection and the positional deviation detection and an increase in the time required for the density detection and the positional deviation detection.

However, the size (spot diameter) of the detection beam spot is associated with how small a toner pattern can be read. If the spot diameter is larger than the interval Le (in this example, 0.40 mm), it is possible to accurately detect only a toner pattern that is larger than the interval Le in the sub-direction. Further, in this case, beam spots based on light beams that are emitted from adjacent two light-emitting elements partially overlap each other since the center-to-center distance thereof is the same as the interval Le. When beam spots partially overlap each other, if a plurality of adjacent optional light-emitting elements are lit at the same time, detection accuracy may decrease.

On the other hand, if the spot diameter is smaller than the interval Le, in a toner pattern of which the size in the sub-direction is smaller than the interval Le, it is possible to accurately detect the toner pattern if the size corresponds to the spot diameter. However, since the center-to-center distance between adjacent two beam spots is the same as the interval Le, a region that is not illuminated with a detection beam occurs between edges of beam spots based on the light beams that are emitted from adjacent light-emitting elements. If a toner pattern having a size corresponding to a region that is not illuminated with a detection beam or a toner pattern that is smaller than the region passes through the region, it is not possible to detect the position of the toner pattern. Further, since the toner density of the toner pattern is not always uniform, the output of the light-receiving element is likely to fluctuate when the spot diameter decreases.

In this embodiment, since the spot diameter is the same as the interval Le, adjacent detection beam spots may not overlap. When performing density detection and positional deviation detection, even when a plurality of adjacent optional light-emitting elements are lit at the same time, it is possible to suppress a decrease in detection accuracy. Further, due to the large spot diameter, it is possible to prevent an increase in the dimension of the toner pattern in the sub-direction. Furthermore, since a region that is not illuminated with a detection beam does not occur, it is possible to accurately detect a toner pattern having a size corresponding to the region and a toner pattern that is smaller than the region.

Therefore, according to the color printer 2000, it is possible to maintain high image quality without increase the size and decreasing operability.

However, since most of the conventional reflecting optical sensors have only one light-emitting element, in order to detect a plurality of toner patterns arranged in the main direction, a number of conventional reflecting optical sensors corresponding to the number of toner patterns arranged in the main direction need to be arranged in the main direction. Further, although some of the conventional reflecting optical sensors include two light-emitting elements, even when the two light-emitting elements are lit at the same time, if the distance between the reflecting optical sensor and the toner pattern is set to the distance that is determined in order to detect the toner pattern, the beam spots from the two light-emitting elements overall on one toner pattern. Thus, in a conventional reflecting optical sensor having two light-emitting elements, a number of reflecting optical sensors corresponding to the number of toner patterns arranged in the main direction need to be arranged in the main direction. The dimension of the conventional reflecting optical sensor in the main direction is approximately 3 cm.

On the other hand, in the reflecting optical sensor 2245 of this embodiment, since a plurality of toner patterns arranged in the main direction can be detected using one reflecting optical sensor, it is possible to decrease the cost.

In the above embodiment, although when obtaining the calculated detection time of each linear pattern, the average value of two points in time (ta, tb) is used as the detection time, the present invention is not limited to this, one of the two points in time (ta, tb) may be used as the detection time.

Further, in the above embodiment, although a case where the PP pattern array includes four positional deviation detection patterns has been described, the present invention is not limited to this.

Further, in the above embodiment, although a case where different toner density gradations of the density detection pattern are realized in an analog manner has been described, the present invention is not limited to this, and the same may be realized in a digital manner. In this case, since a rectangular pattern of an intermediate color is in a state where a toner portion and a background portion are mixed, a reception light intensity of each light-receiving element can be divided more accurately into a reception light intensity of a regular reflected light and a reception light intensity of a diffuse reflected light.

Further, in the above embodiment, although a case where the surface of the transfer belt is smooth has been described, the present invention is not limited to this, and the surface of the transfer belt may be not smooth. In this case, the detection process can be performed in a manner similarly to the above embodiment. Further, a portion of the surface of the transfer belt may be smooth.

Further, in the above embodiment, although a case where eleven illumination microlenses (LE1 to LE11) and eleven light-receiving microlenses (LD1 to LD11) are integrated has been described, the present invention is not limited to this.

Further, in the above embodiment, a processing device may be provided in the reflecting optical sensor 2245, and at least a portion of the processes of the printer control device 2090 may be performed by the processing device.

Further, in the above embodiment, at least a portion of the processes of the printer control device 2090 may be performed by the scanning control device.

Further, in the above embodiment, the dummy pattern DKDP and the dummy pattern LDPK may not be formed when the detection process is performed. For example, each dummy pattern may be formed only in the first detection process which is performed when the power of the color printer 2000 is turned on (ON), and in the detection process performed until the power of the color printer 2000 is turned off (OFF), the position of each pattern array in the main direction may be estimated based on the information obtained in the detection process performed previously.

For example, the next position of each pattern array may be estimated from the output information of each light-receiving element when each pattern array was illuminated previously, stored in the RAM of the printer control device 2090. Specifically, it can be estimated that a pattern array is present in such a position that the pattern array faces a light-emitting element in which when the light-emitting element Ei (i=1 to 11) is lit, a difference (output difference ΔDi) between the output of the light-receiving element Di that receives the regular reflected light from the transfer belt 2040 and the output of the light-receiving element Di that receives the regular reflected light from the toner pattern on the transfer belt 2040 is the largest.

Further, even if the output information of the light-receiving element is not referred to, when the time elapsed from the previous detection process and a change in the environmental conditions (temperature or humidity) is small, since the position of the pattern array generally does not change greatly, the position of the pattern array can be estimated to be the same as the previous position.

When the dummy pattern is not formed, the process of step S307 is not performed.

Figure 71:
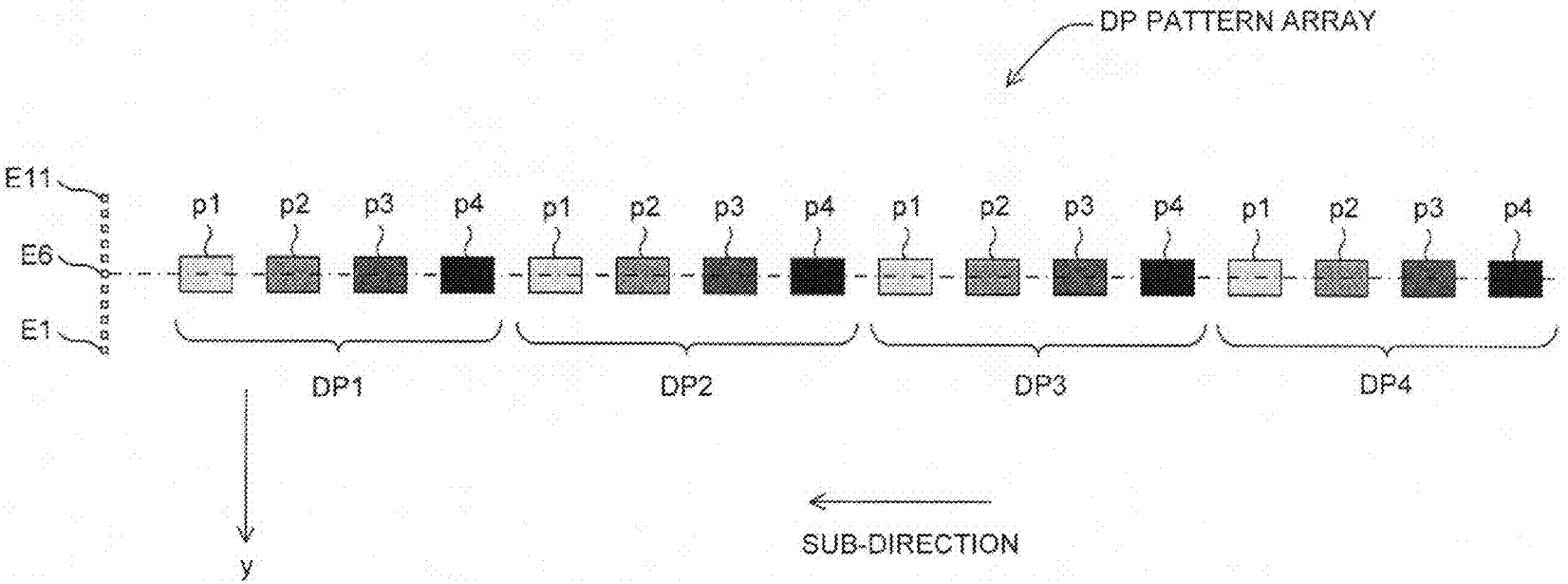
FIG. 71 is an exemplary diagram for describing a first modification example of a toner pattern.

Further, the toner pattern described in the above embodiment is exemplary, the size (dimension), the shape, the number, and the like are not limited to those described in the embodiment. For example, each of the density detection patterns (DP1 to DP4) may include four rectangular patterns (p1 to p4) (see FIG. 71). In this case, the rectangular pattern p4 may be used as a solid pattern. Moreover, it is possible to further shorten the time required for the density detection process.

Figure 72:
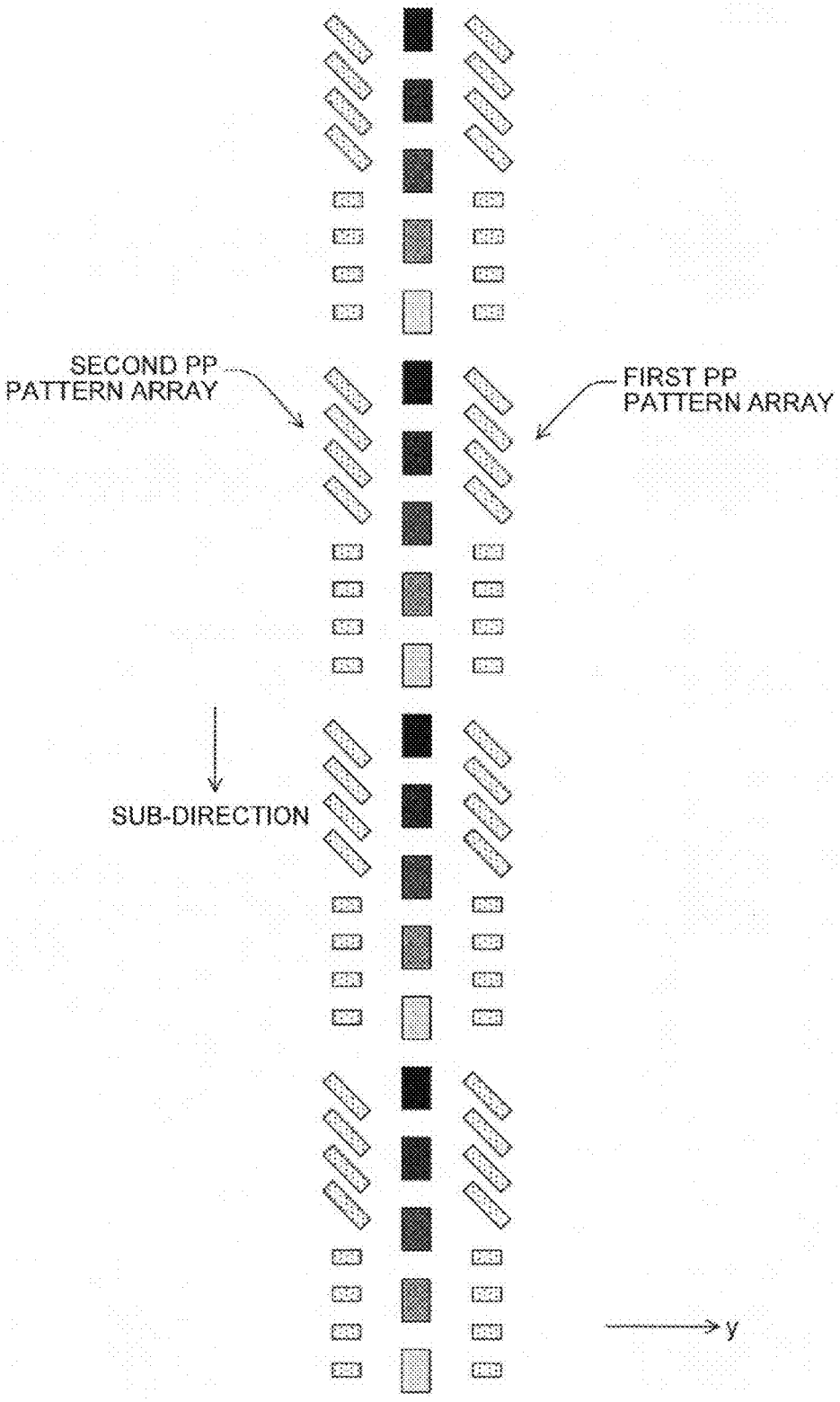
FIG. 72 is an exemplary diagram for describing a second modification example of a toner pattern.
Figure 73:
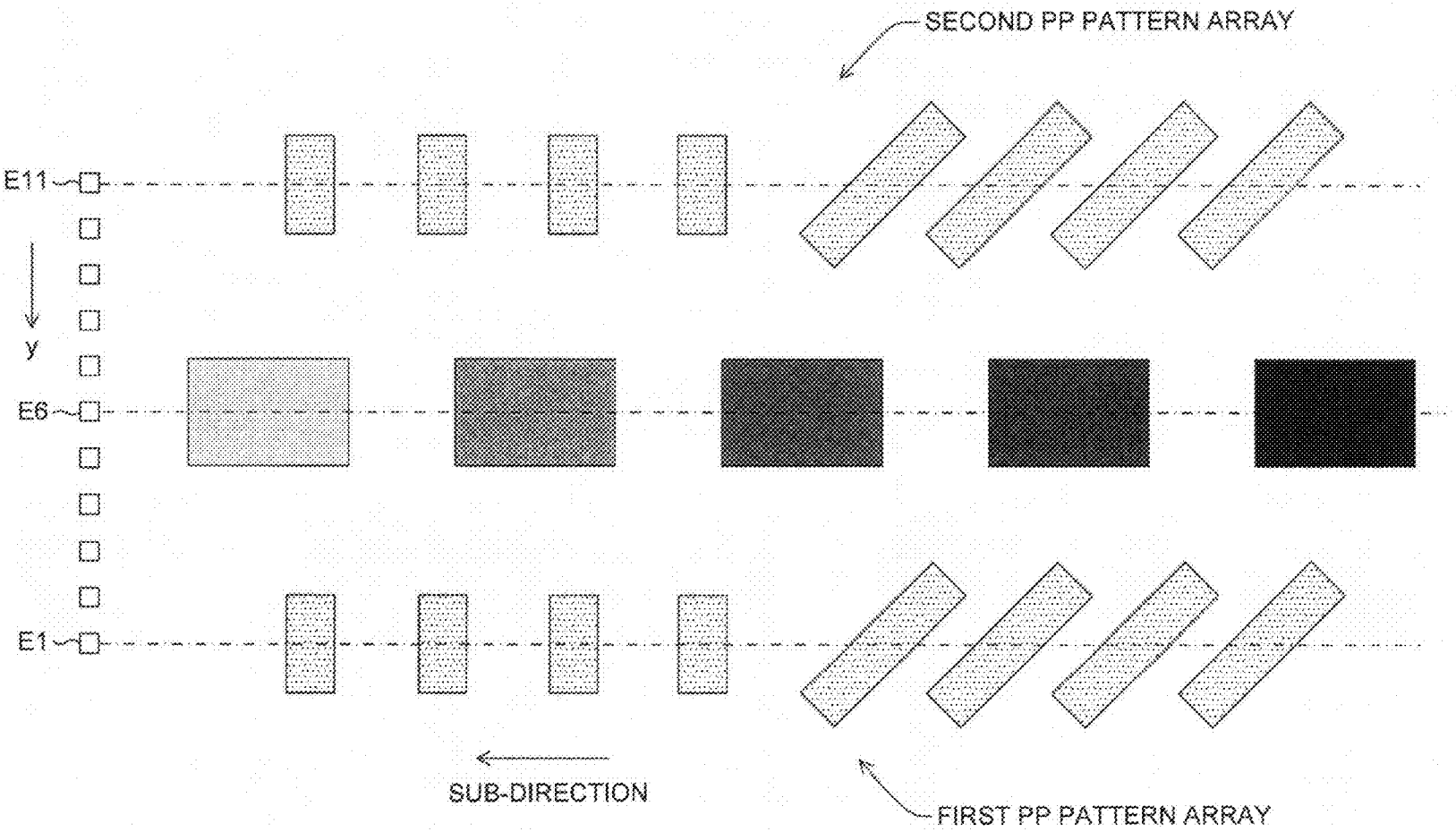
FIG. 73 is an exemplary diagram for describing a positional relation between a toner pattern of the second modification example and a light-emitting element.

Further, as an example, as illustrated in FIG. 72, two PP pattern arrays (first PP pattern array and second PP pattern array) may be formed so as to interpose a DP pattern array therebetween. In this case, it is possible to further improve the positional deviation detection accuracy. In this case, as an example, as illustrated in FIG. 73, the first PP pattern array may be formed at such a position that the PP pattern array is illuminated with the detection beam S1 from the light-emitting element E1, and the second PP pattern array may be formed at such a position that the PP pattern array is illuminated with the detection beam S11 from the light-emitting element E11.

Figure 74:
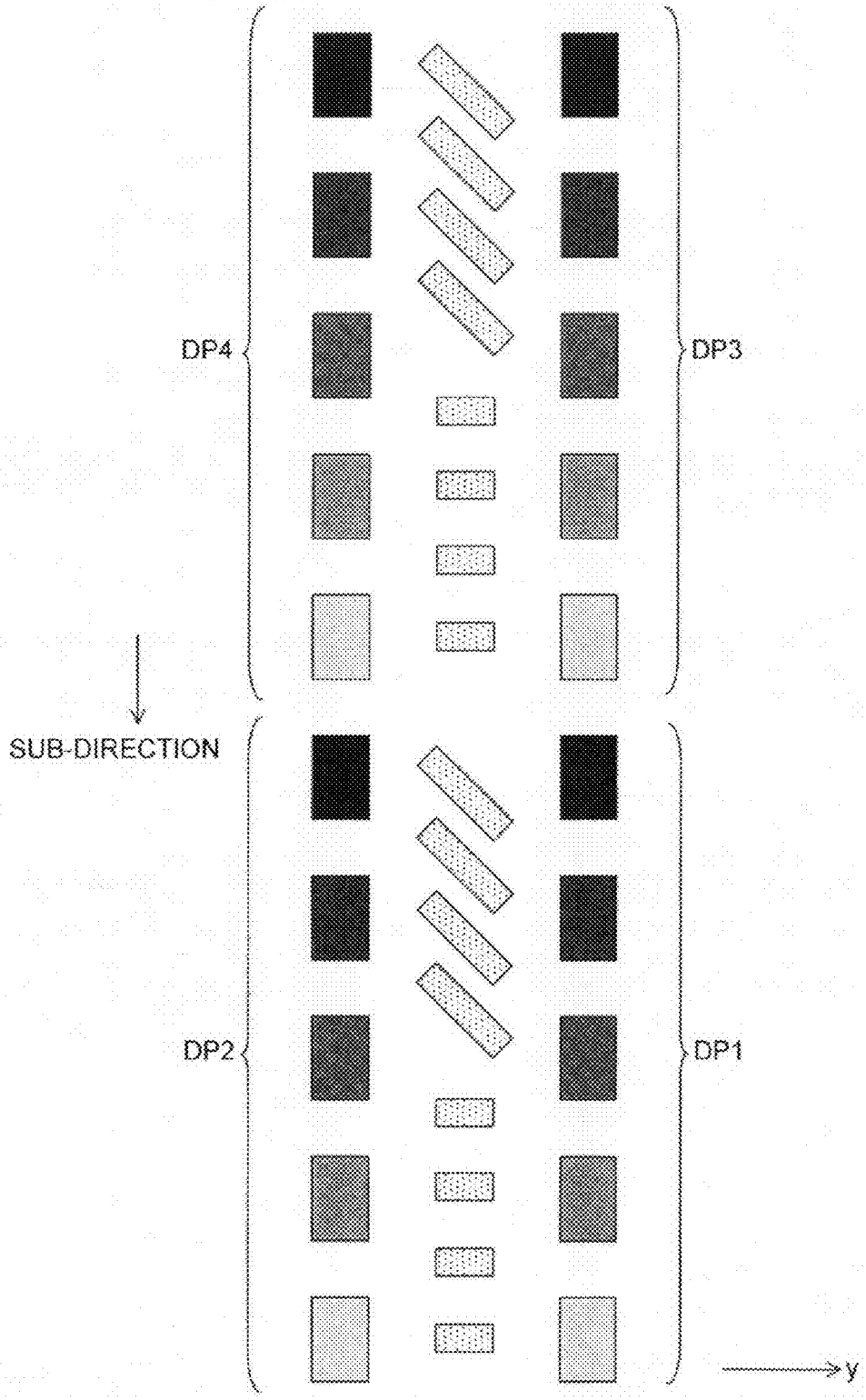
FIG. 74 is an exemplary diagram for describing a third modification example of a toner pattern.

Further, as an example, as illustrated in FIG. 74, the DP pattern array may be divided into a first partial DP pattern array that includes the density detection patterns DP1 and DP3 and a second partial DP pattern array that includes the density detection patterns DP2 and DP4, and the first and second partial DP pattern arrays may be formed so as to interpose the PP pattern array therebetween. In this case, it is possible to further shorten the time required for the density detection. Furthermore, at the same time, when the number of positional deviation detection patterns PP that form the PP pattern array is decreased, it is possible to further shorten the time required for the image process control.

Figure 75:
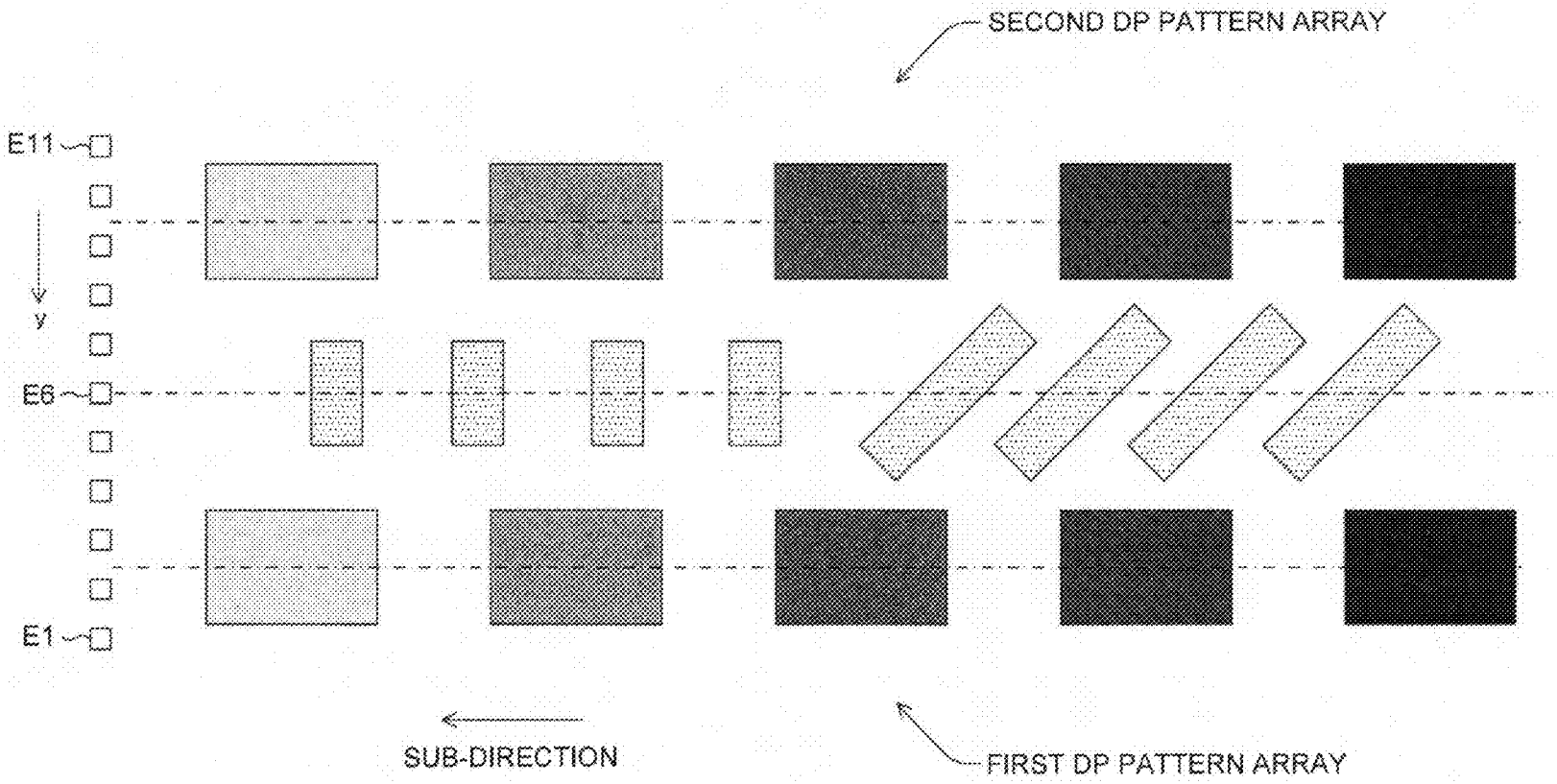
FIG. 75 is an exemplary diagram for describing a positional relation between a toner pattern of the third modification example and a light-emitting element.

FIG. 75 illustrates a case where the first partial DP pattern array is formed at such a position that the partial DP pattern array is illuminated with the detection beam S2 from the light-emitting element E2 and the detection beam S3 from the light-emitting element E3 and a second partial DP pattern array is formed at such a position that the partial DP pattern array is illuminated with the detection beam S9 from the light-emitting element E9 and the detection beam S10 from the light-emitting element E10. In this case, since the light-receiving elements D4, D5, D7, and D8 receive reflected lights of the detection beams from different light-emitting elements, it is preferable to cause the light-emitting elements E2, E3, and E6 to be lit at different timing from that of the light-emitting elements E6, E9, and E10, respectively. However, if the output distribution (reception light intensity profile) of the light-receiving system when the respective light-emitting elements are lit individually is obtained in advance, the plurality of light-emitting elements may be lit at the same time. In this case, the reception light intensity can be divided for each light-emitting element when the light-emitting elements are lit at the same time by referring to the reception light intensity profile.

Figure 76:
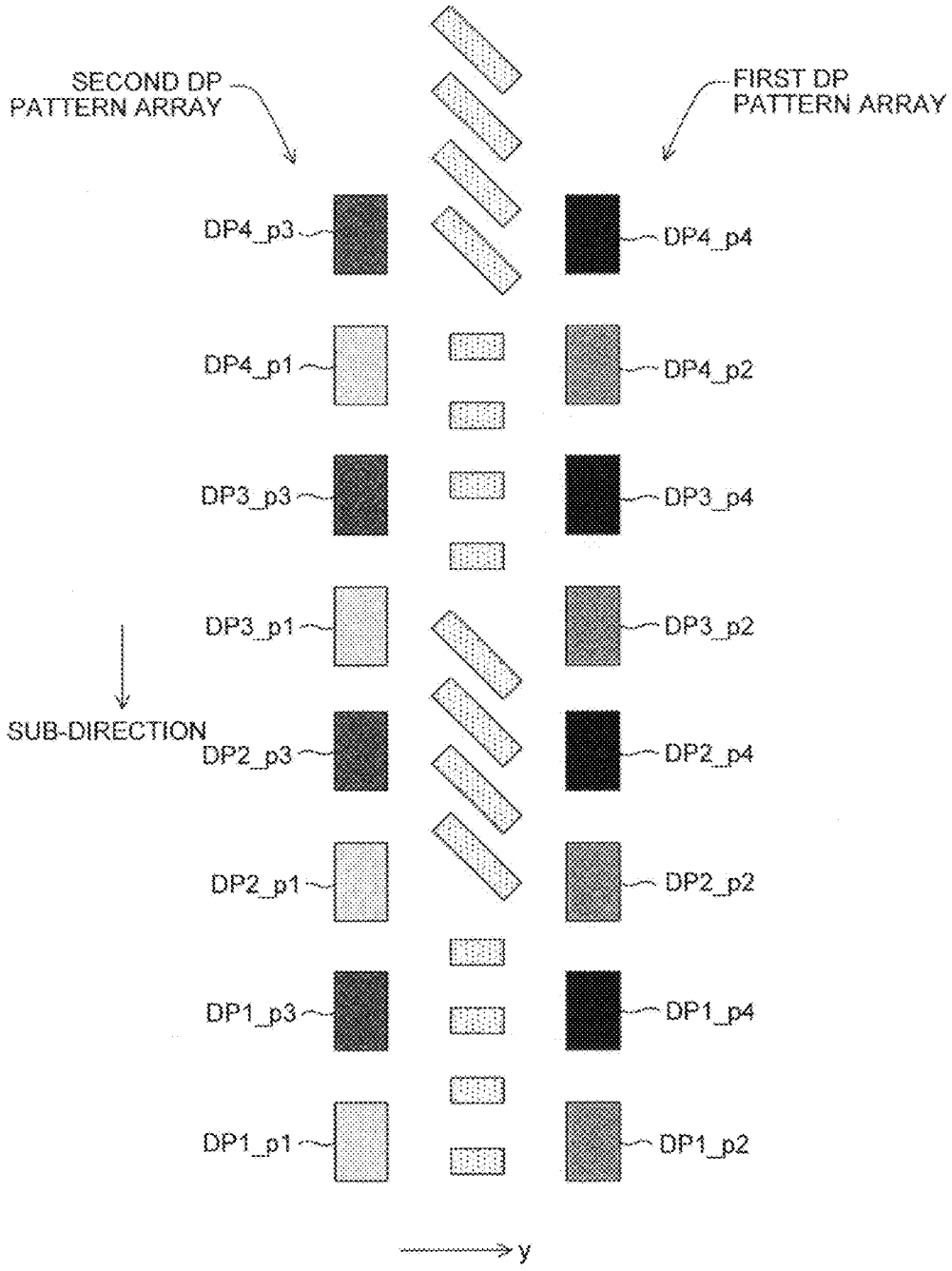
FIG. 76 is an exemplary diagram for describing a fourth modification example of a toner pattern.

Further, a plurality of rectangular patterns that form one density detection pattern may be formed so that some rectangular patterns belong to the first partial DP pattern array, and the remaining rectangular patterns belong to the second partial DP pattern array. FIG. 76 illustrates an example, in which one density detection pattern includes four rectangular patterns, rectangular patterns p2 and p4 belong to the first partial DP pattern array, and rectangular patterns p1 and p3 belong to the second partial DP pattern array.

Figure 77:
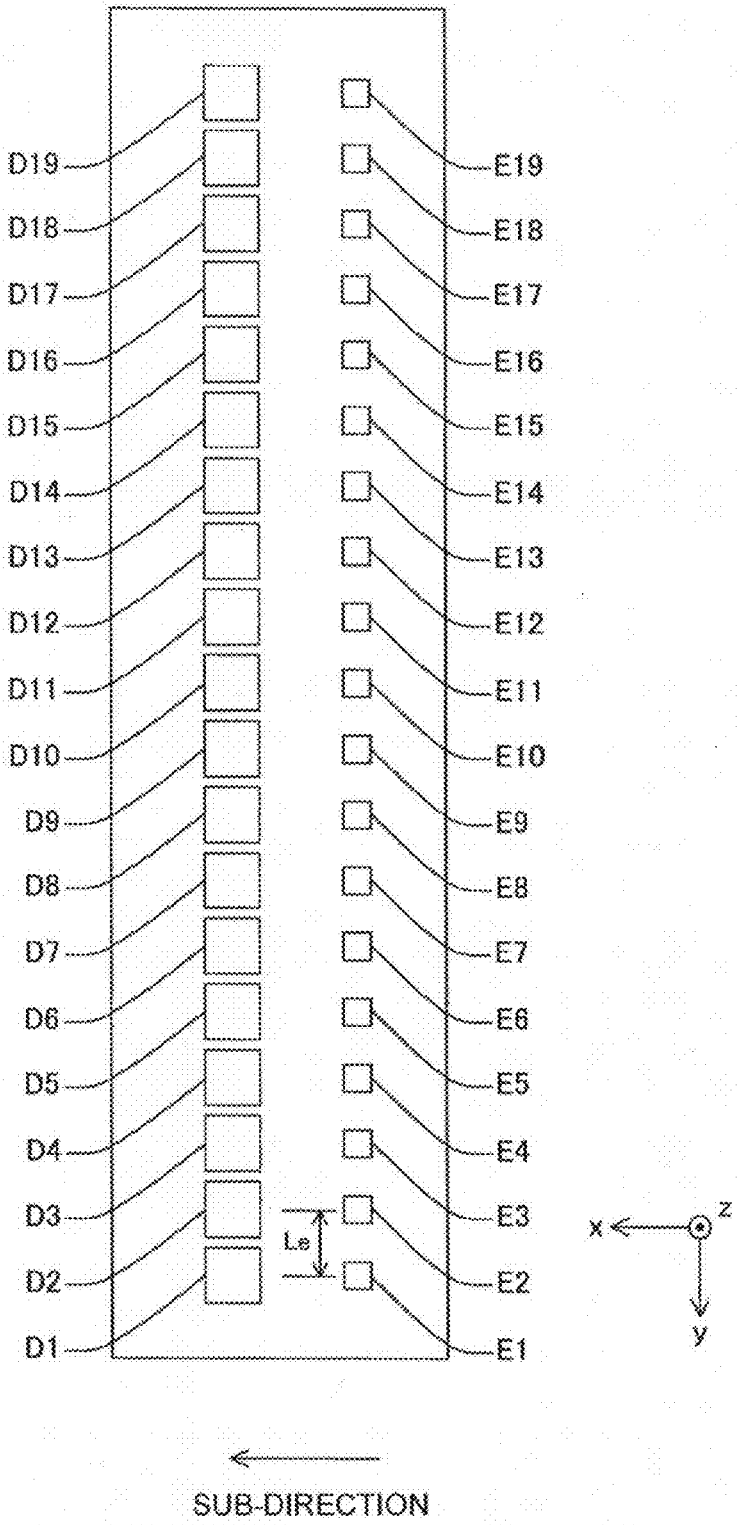
FIG. 77 is an exemplary diagram for describing a modification example of a reflecting optical sensor.
Figure 78:
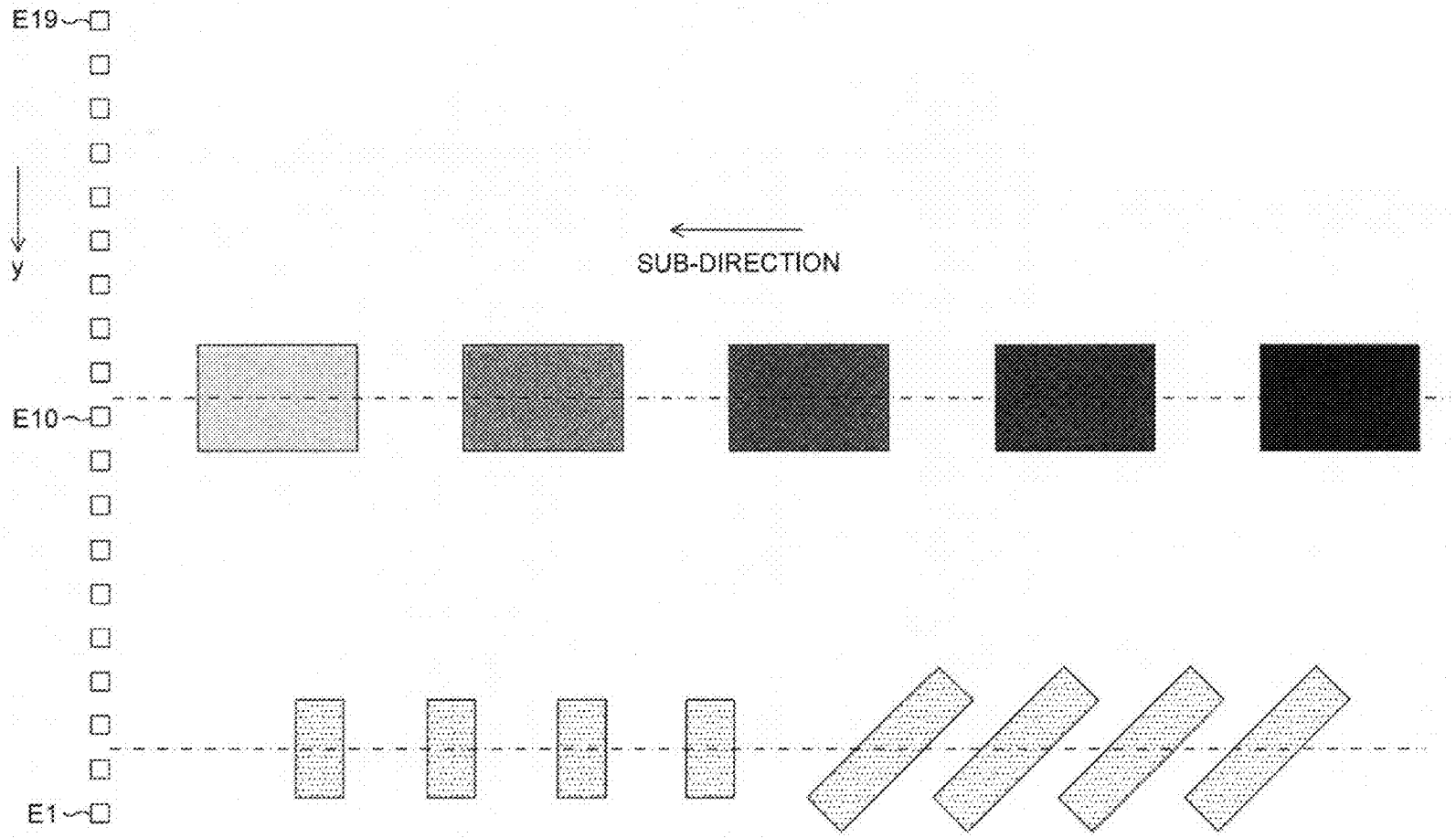
FIG. 78 is a first exemplary diagram for describing a positional relation between a light-emitting element of a reflecting optical sensor of the modification example and a toner pattern.
Figure 79:
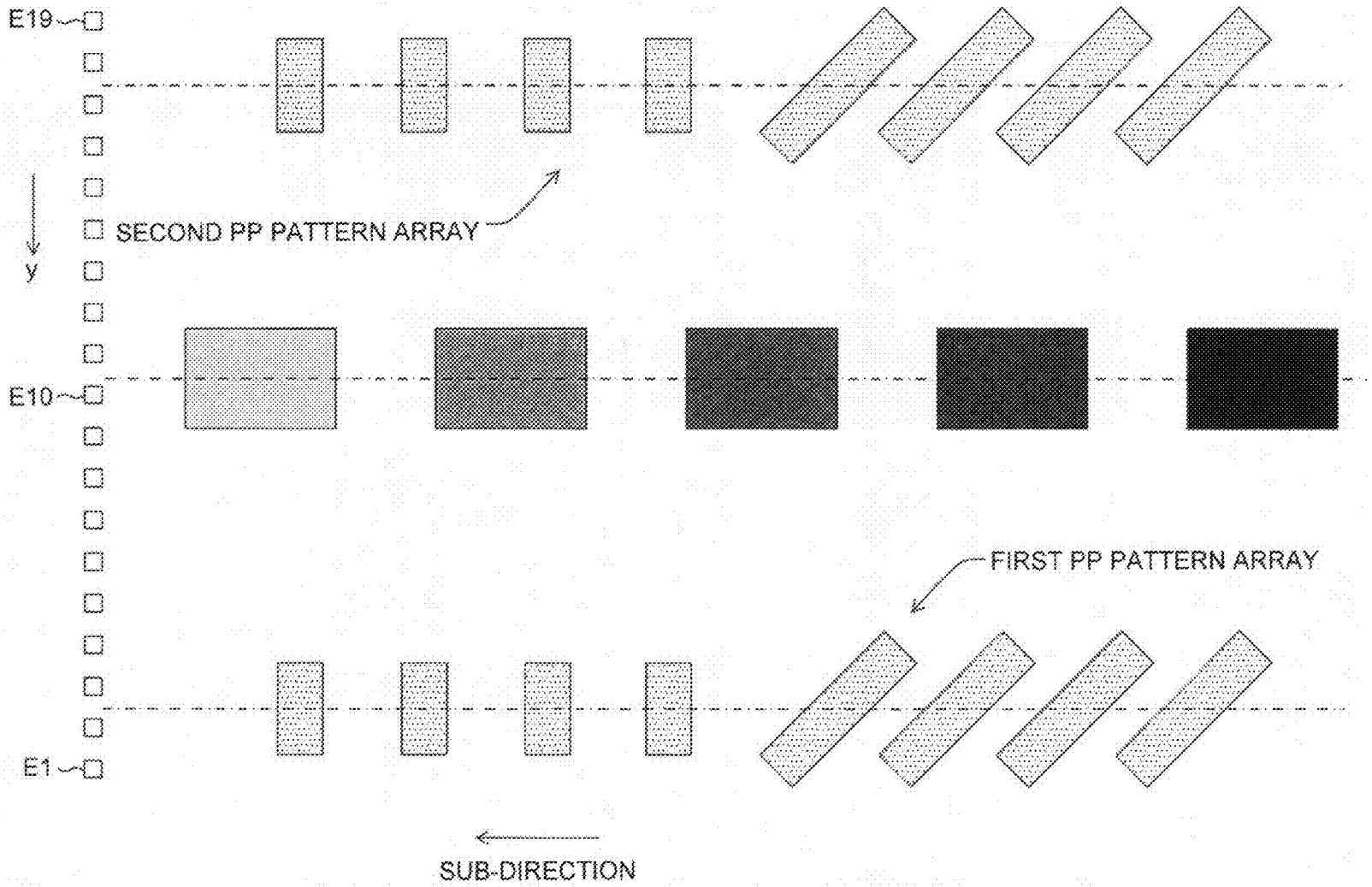
FIG. 79 is a second exemplary diagram for describing a positional relation between a light-emitting element of a reflecting optical sensor of the modification example and a toner pattern.
Figure 80:
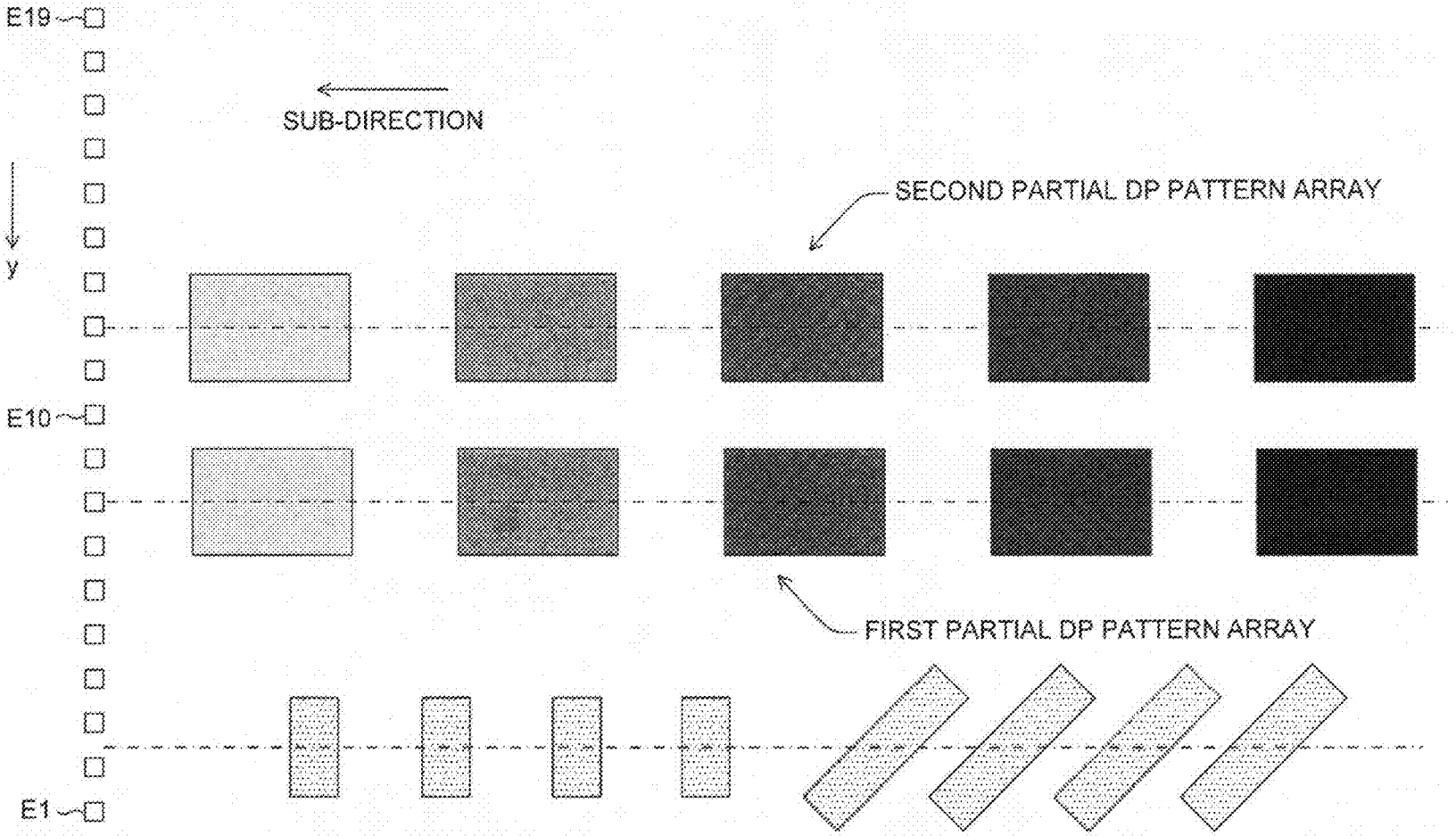
FIG. 80 is a third exemplary diagram for describing a positional relation between a light-emitting element of a reflecting optical sensor of the modification example and a toner pattern.
Figure 81:
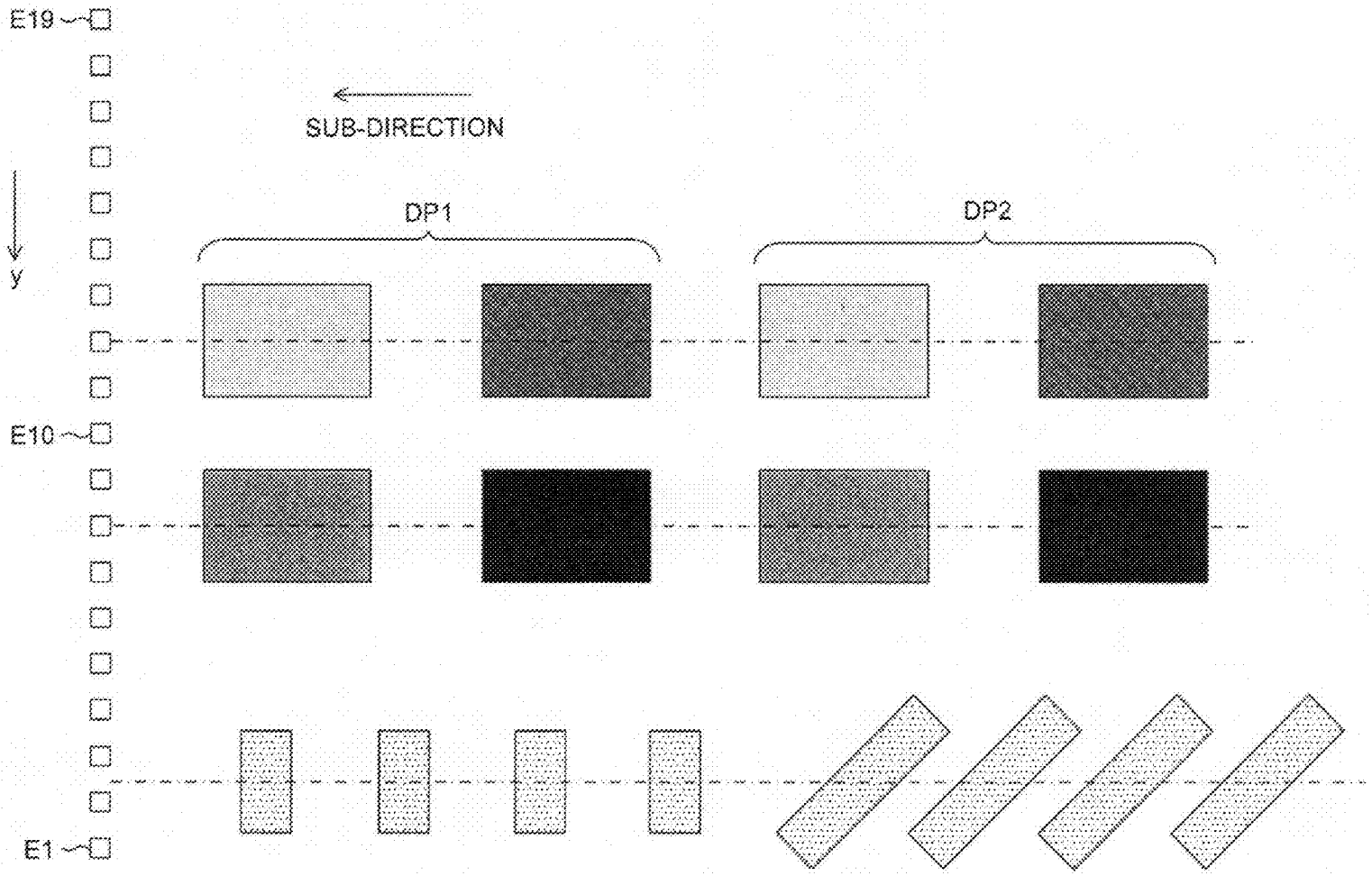
FIG. 81 is a fourth exemplary diagram for describing a positional relation between a light-emitting element of a reflecting optical sensor of the modification example and a toner pattern.
Figure 82:
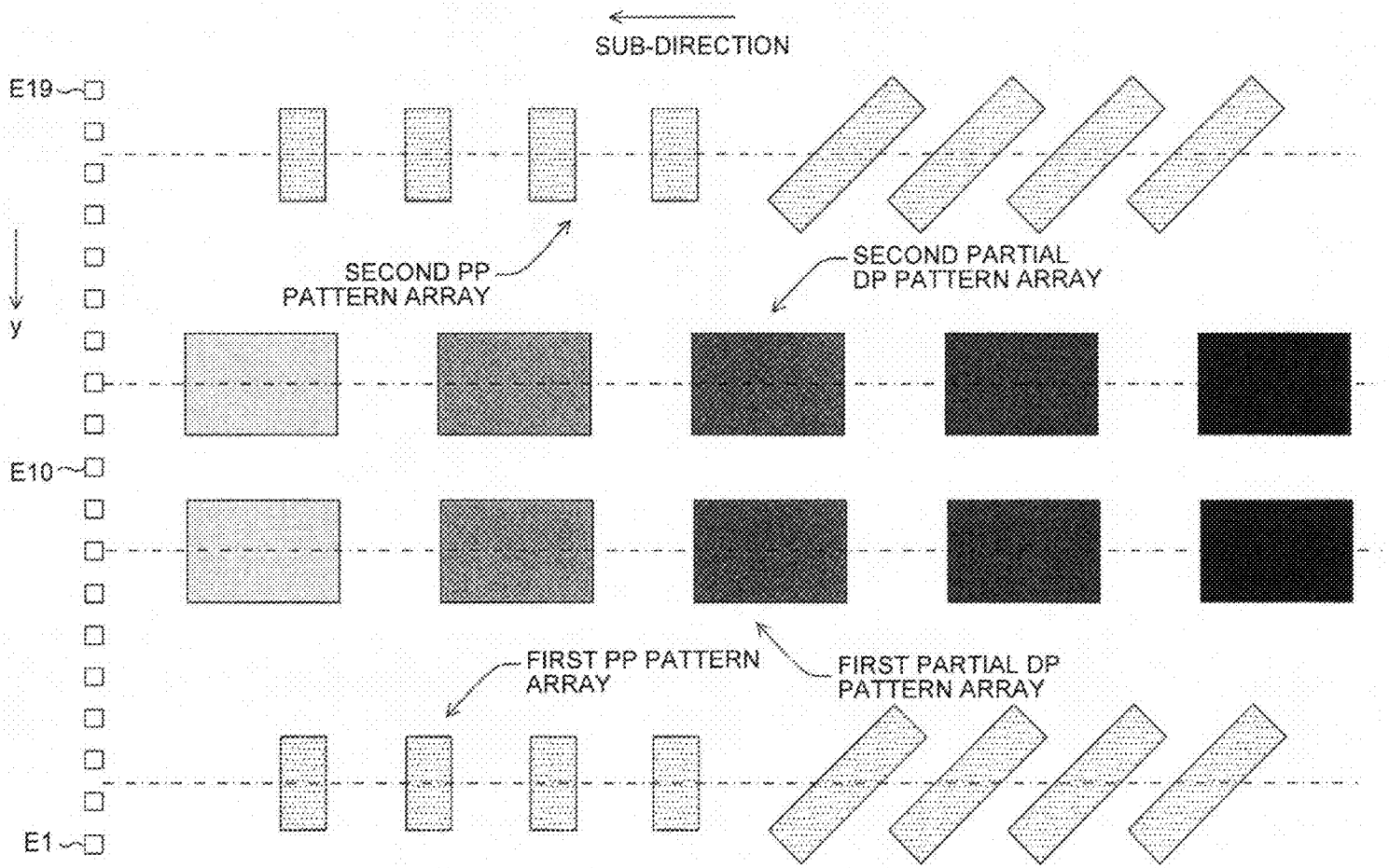
FIG. 82 is a fifth exemplary diagram for describing a positional relation between a light-emitting element of a reflecting optical sensor of the modification example and a toner pattern.

Further, in the above embodiment, although a case where the reflecting optical sensor 2245 includes eleven light-emitting elements has been described, the present invention is not limited to this. For example, as illustrated in FIG. 77, the reflecting optical sensor 2245 may include an emitting system that includes nineteen light-emitting elements (E1 to E19) and a light-receiving system that includes nineteen light-receiving elements (D1 to D19). In this case, an illumination optical system includes nineteen illumination microlenses and a light-receiving optical system includes nineteen light-receiving microlenses. FIGS. 78 to 82 illustrate examples of the positional relation between light-emitting elements and toner patterns for this case.

Figure 83:
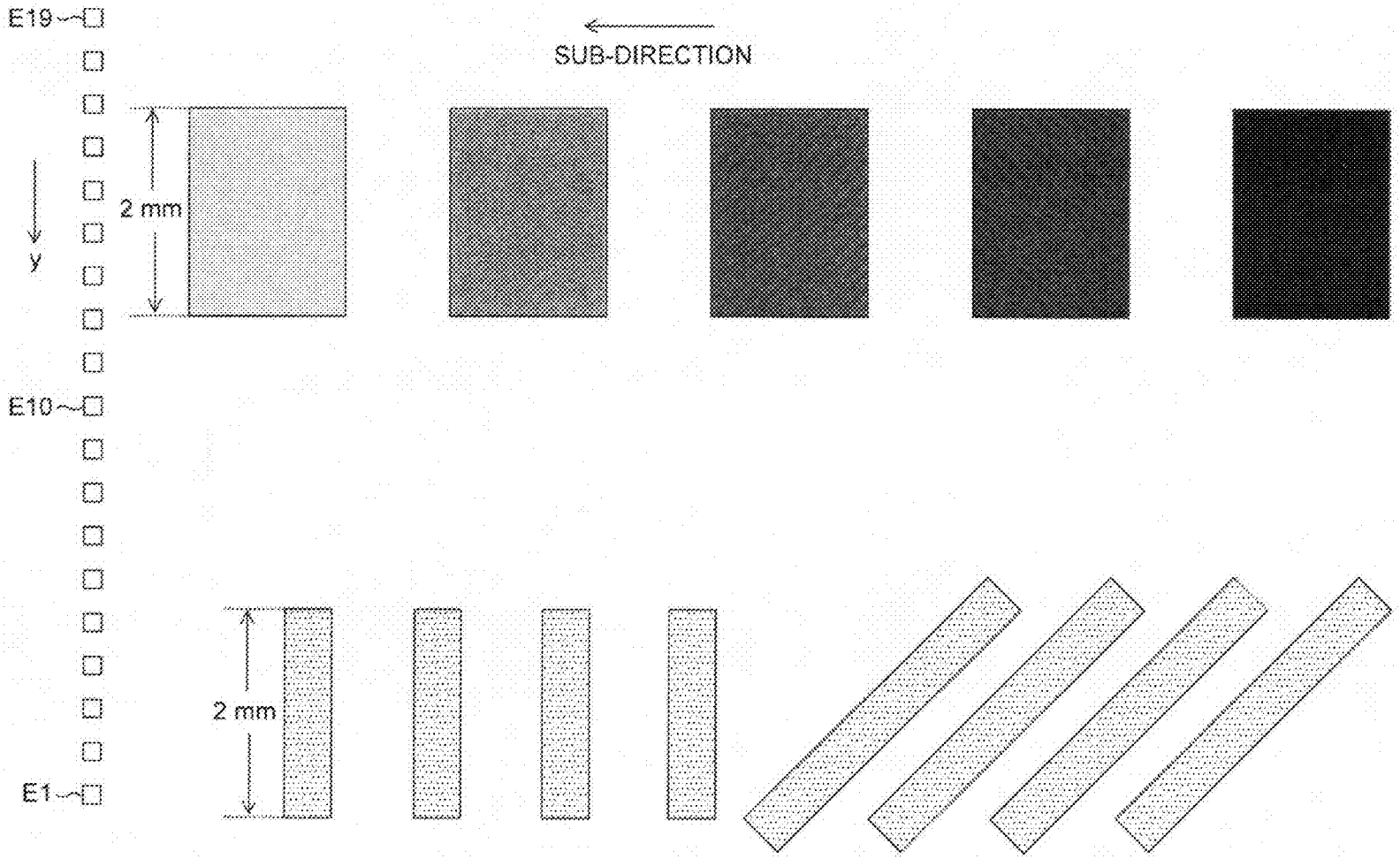
FIG. 83 is an exemplary diagram for describing a fifth modification example of a toner pattern.

Further, in this case, the dimension of the DP pattern array and the PP pattern array in the main direction may be larger than 1 mm. For example, as illustrated in FIG. 83, the dimension of the DP pattern array and the PP pattern array in the main direction may be 2 mm.

Further, in the above embodiment, although a case where the reflecting optical sensor 2245 is provided at a position corresponding to the center of the effective image region in relation to the y-axis direction has been described, the present invention is not limited to this. For example, the reflecting optical sensor 2245 may be provided at a position corresponding to a portion outside the effective image region in relation to the y-axis direction. In this case, it is possible to perform the density detection process and the positional deviation detection process without stopping a printing operation. Thus, it is possible to correct the toner density and the positional deviation on a real-time basis. Further, since the dimension of the conventional reflecting optical sensor in the main direction is approximately 3 cm, whereas the dimension of the reflecting optical sensor 2245 of the embodiment in the main direction can be set to approximately 5 mm, it is possible to decrease the dimension of the transfer belt in the main direction as compared to the image forming apparatus that includes the conventional reflecting optical sensor. As a result, it is possible to reduce the size of the image forming apparatus.

Further, in the above embodiment, although a case where one reflecting optical sensor 2245 is provided has been described, the present invention is not limited to this, and a plurality of reflecting optical sensors 2245 may be provided. In this case, it is possible to further increase the detection accuracy of the density detection process and the positional deviation detection process.

Figure 84:
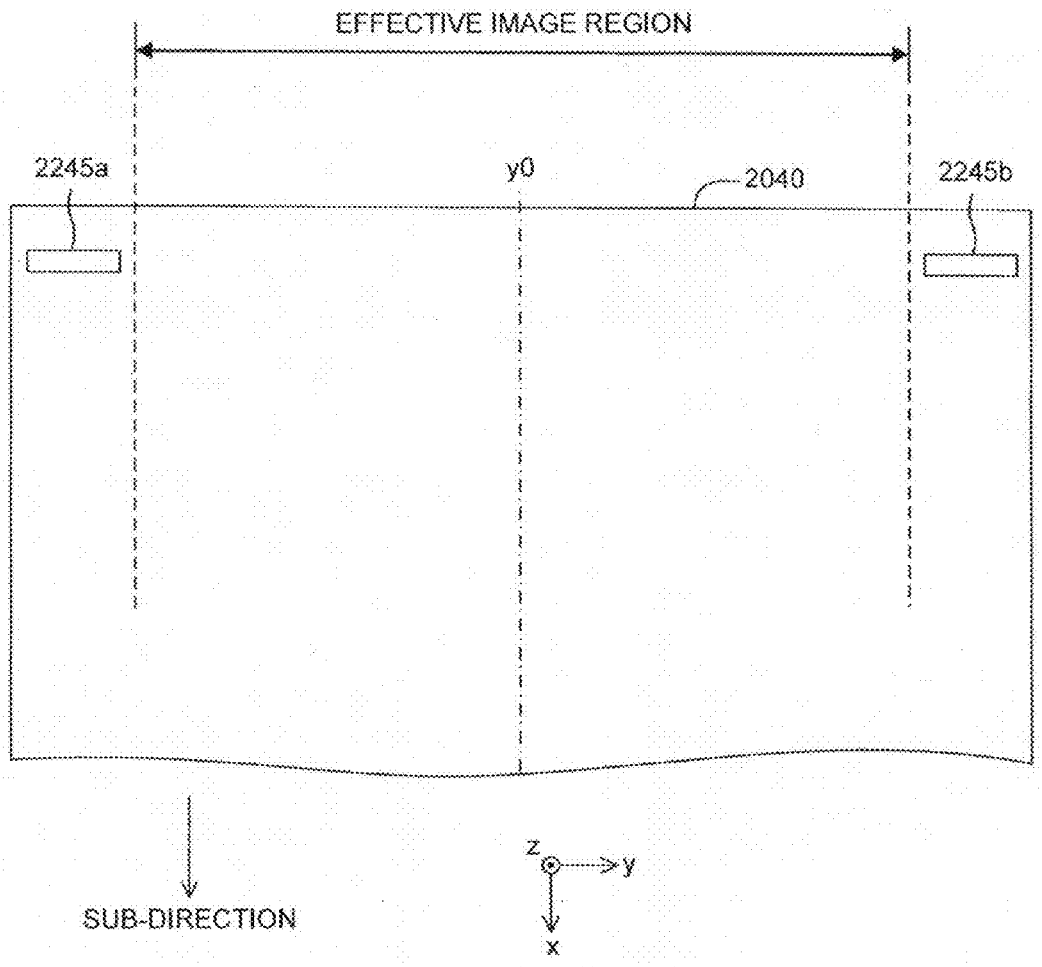
FIG. 84 is an exemplary diagram for describing two reflecting optical sensors disposed outside an effective image region.
Figure 85:
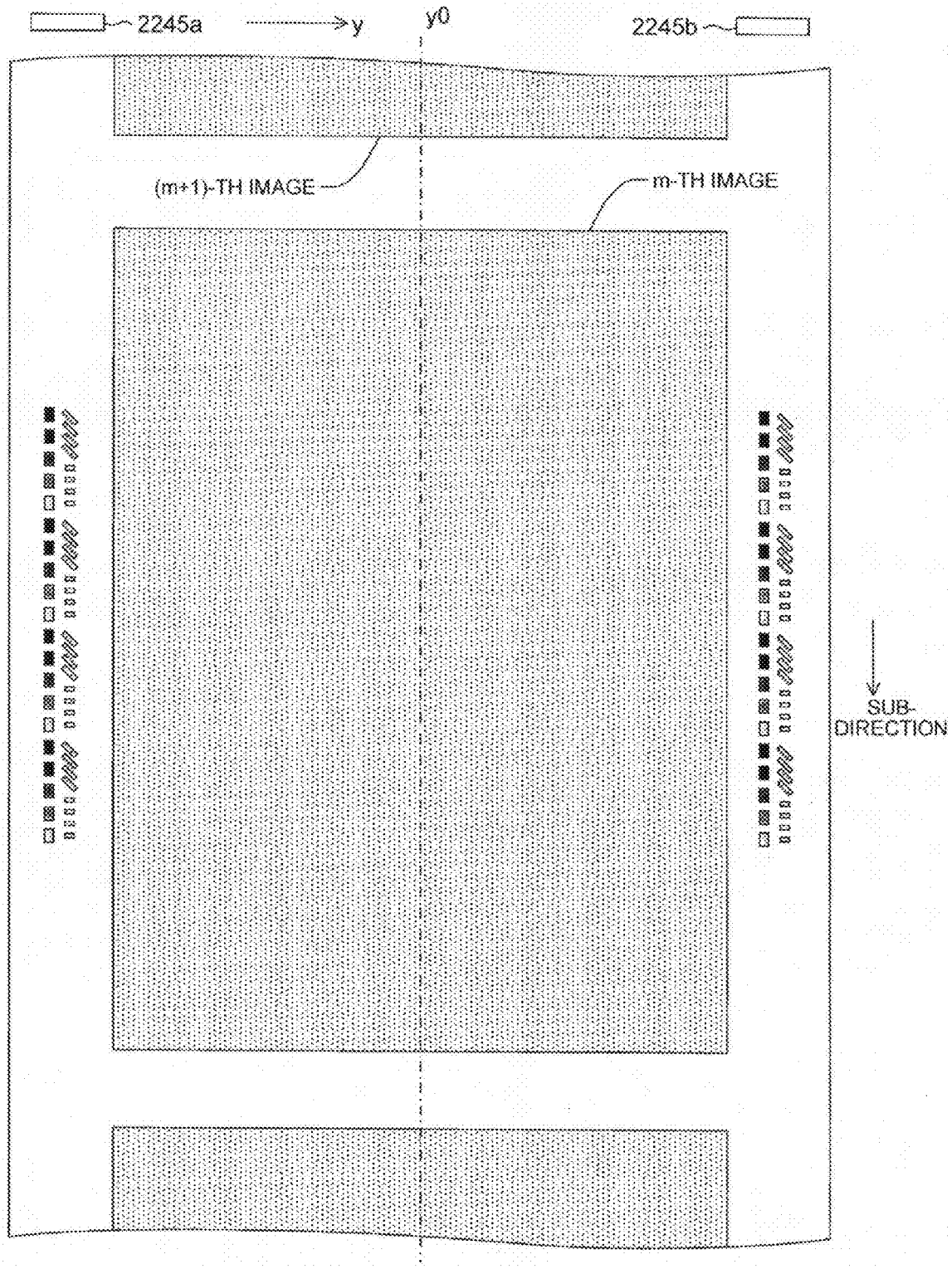
FIG. 85 is a first exemplary diagram for describing a toner pattern formed outside an effective image region.
Figure 86:
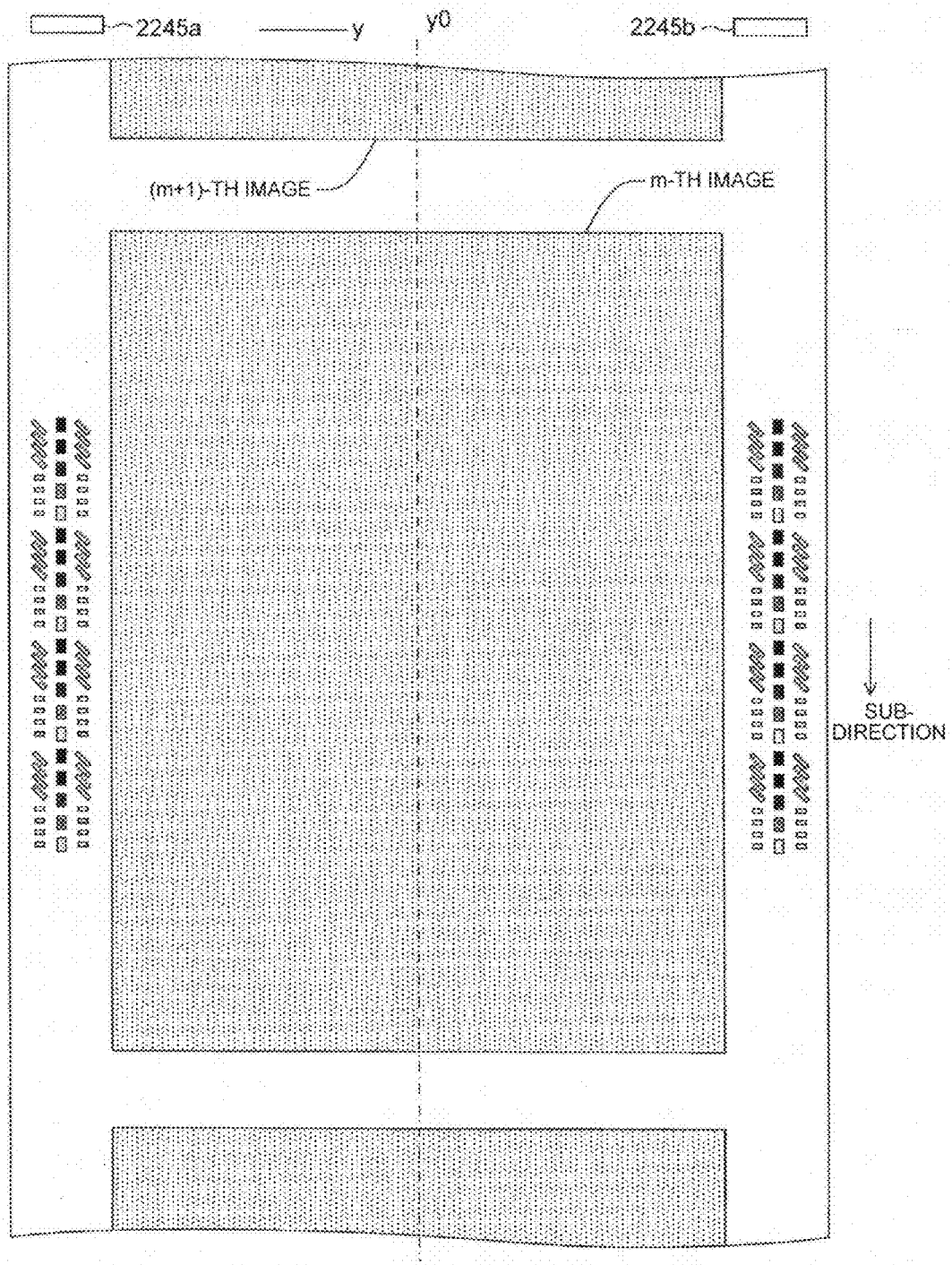
FIG. 86 is a second exemplary diagram for describing a toner pattern formed outside an effective image region.
Figure 87:
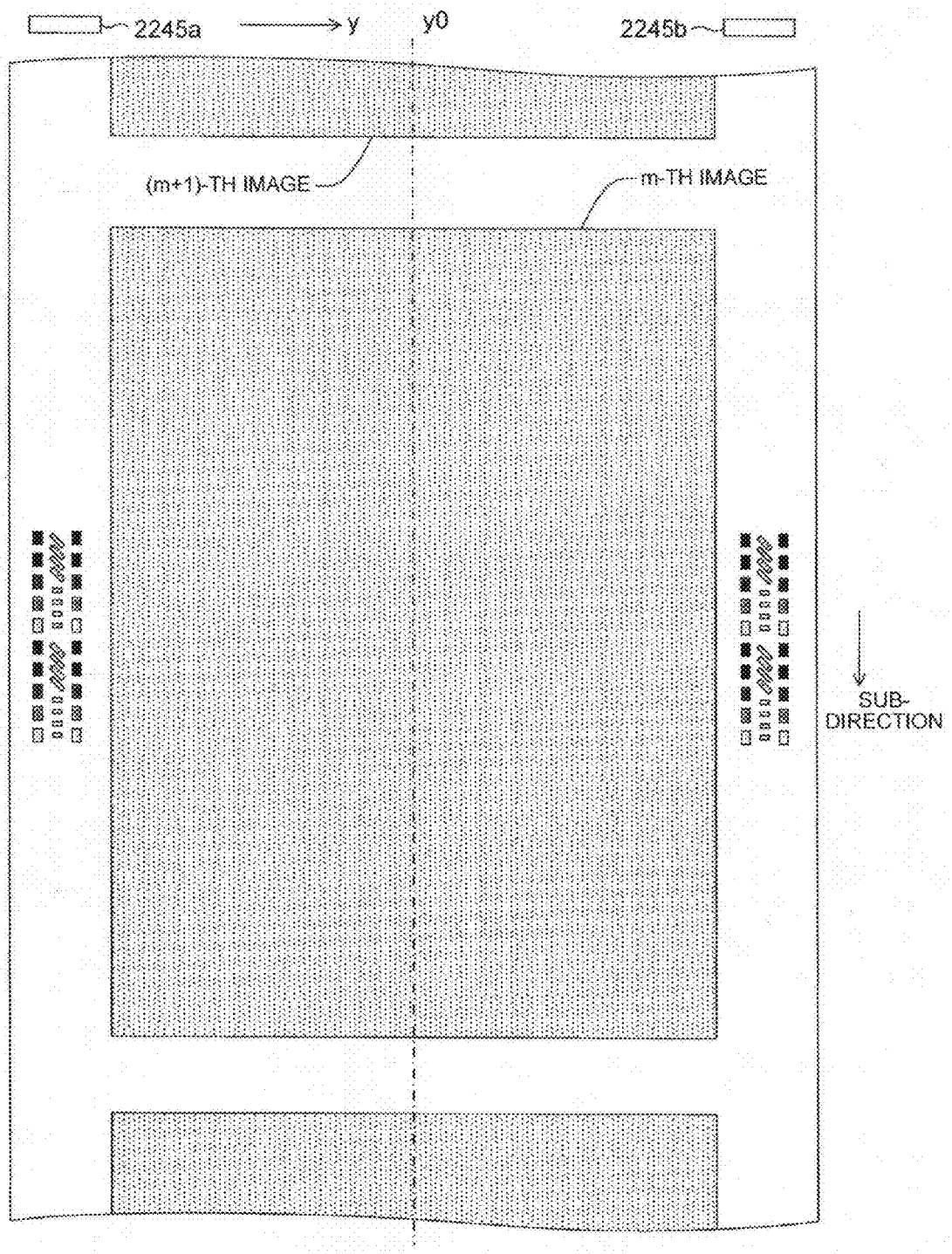
FIG. 87 is a third exemplary diagram for describing a toner pattern formed outside an effective image region.
Figure 88:
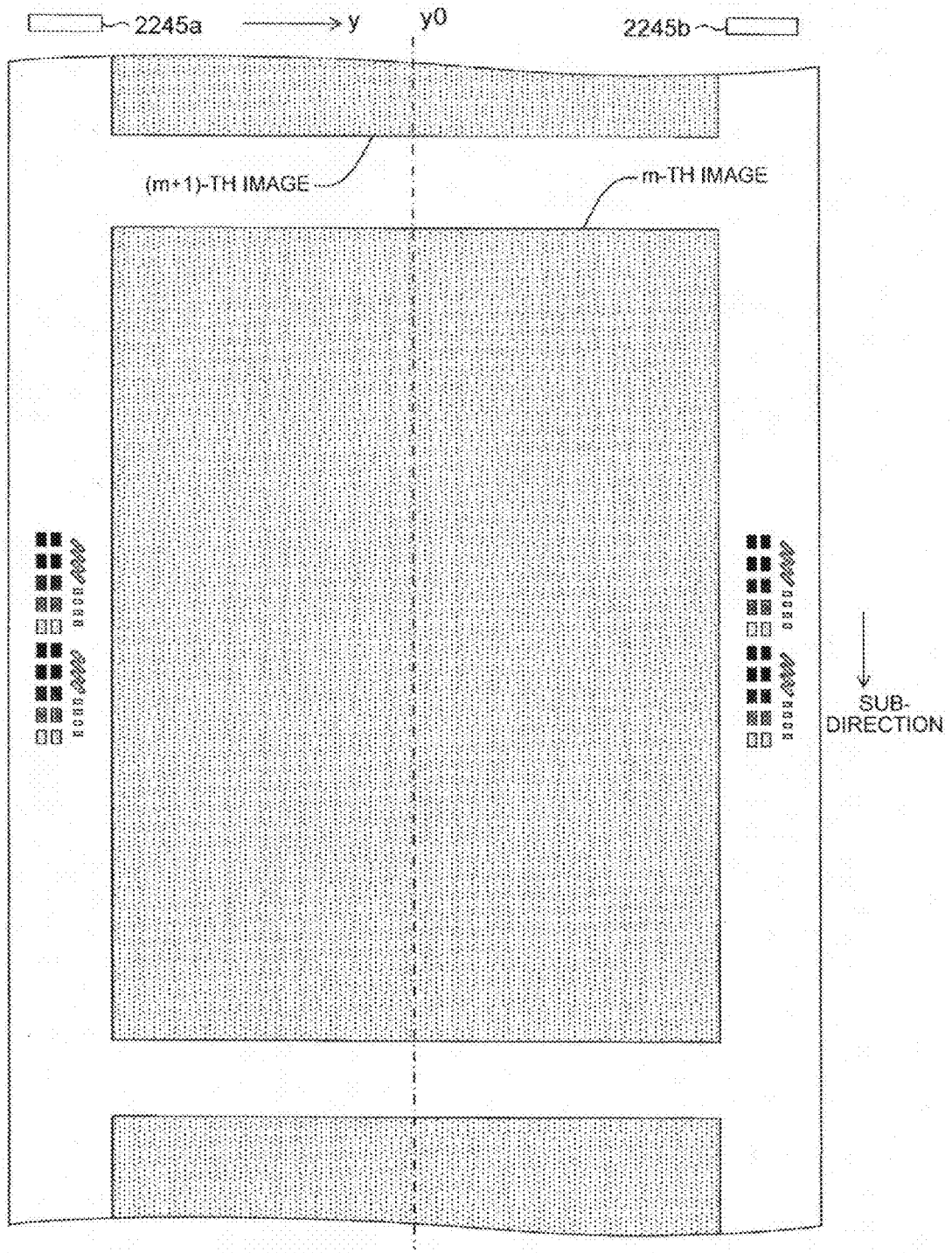
FIG. 88 is a fourth exemplary diagram for describing a toner pattern formed outside an effective image region.
Figure 89:
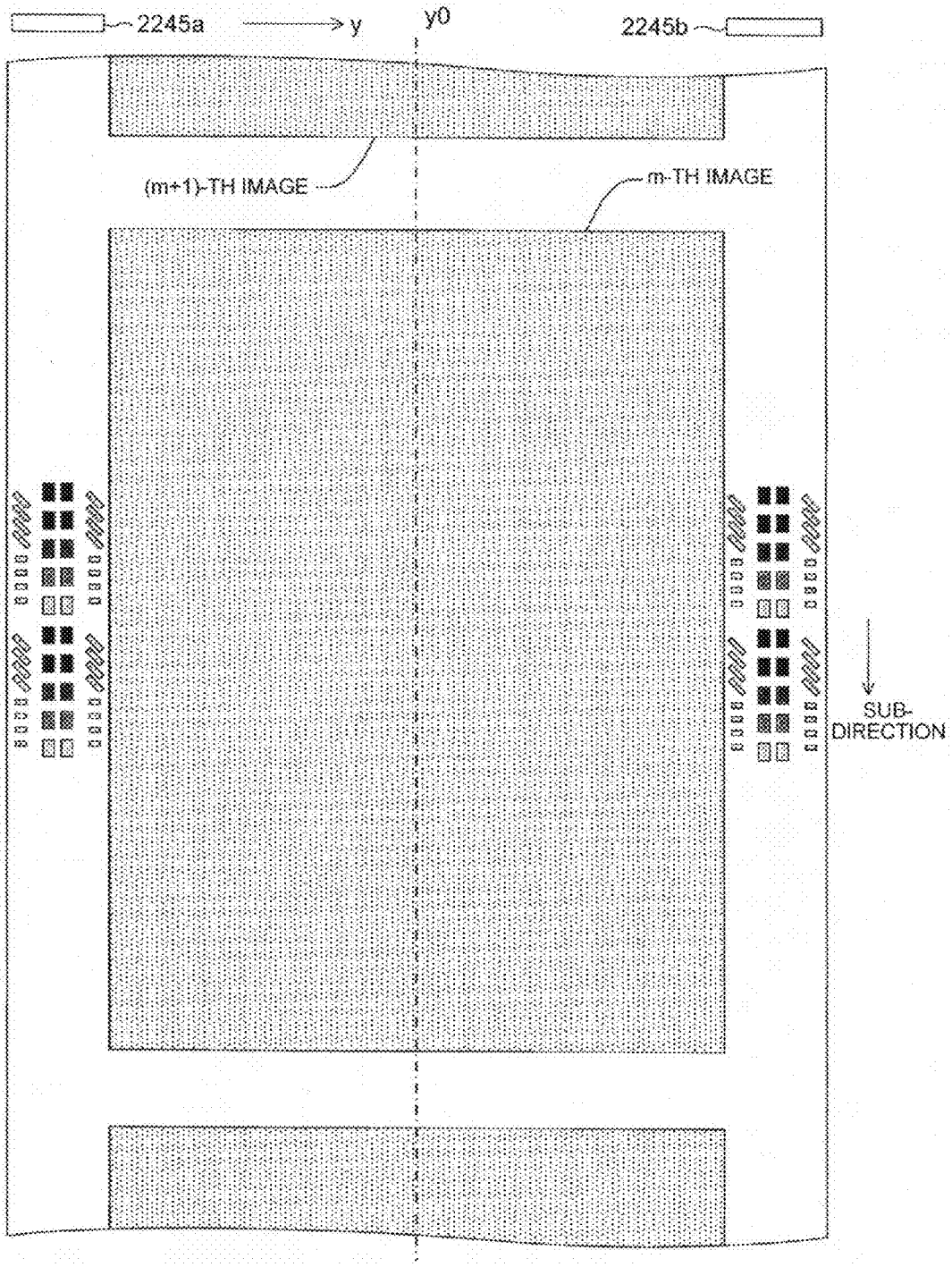
FIG. 89 is a fifth exemplary diagram for describing a toner pattern formed outside an effective image region.

As an example, FIG. 84 illustrates a case where two reflecting optical sensors (2245*a*, 2245*b*) equivalent to the reflecting optical sensor 2245 are provided at a position corresponding to a portion outside the effective image region in relation to the y-axis direction. Moreover, examples of the toner pattern formed in this case are illustrated in FIGS. 85 to 89.

Figure 90:
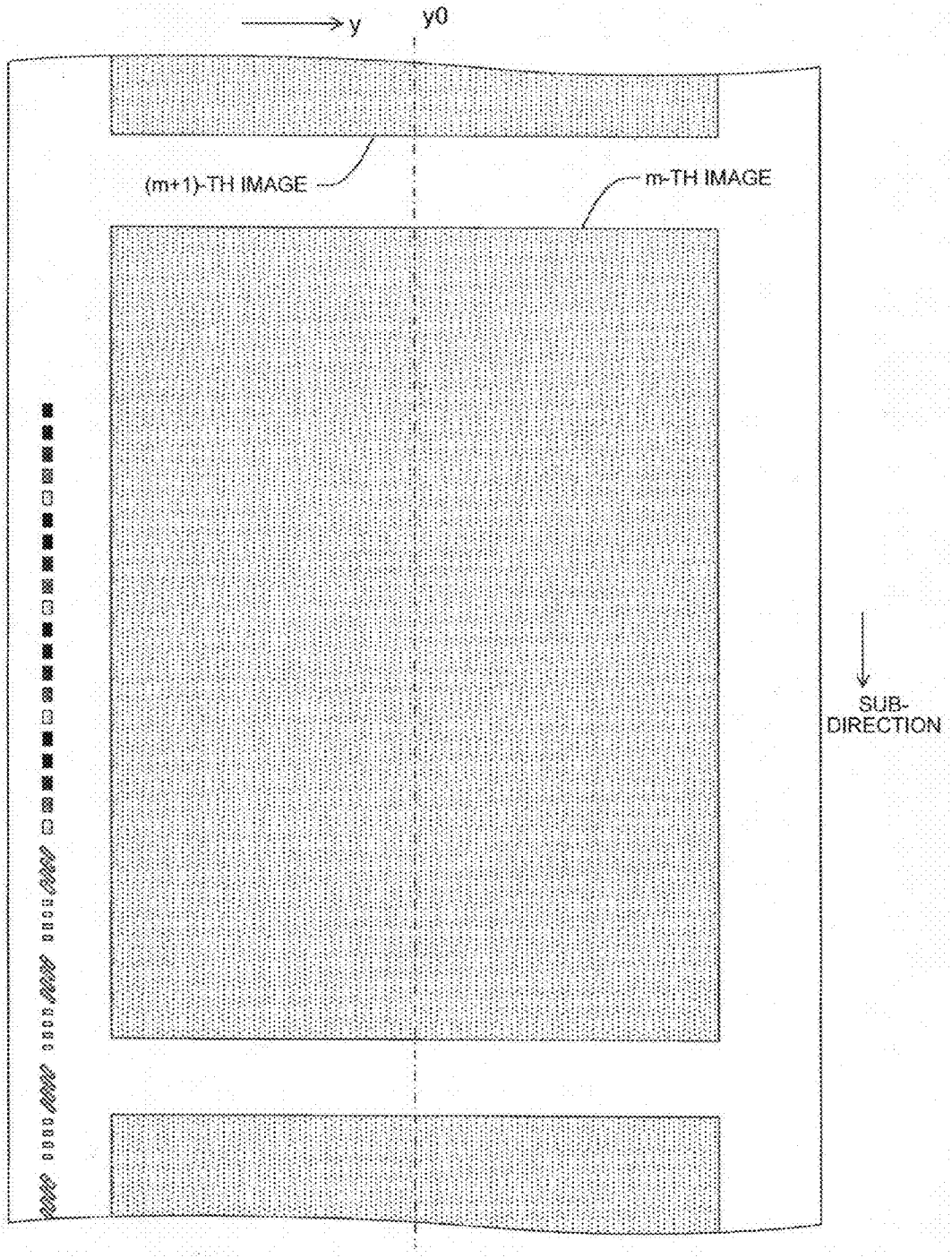
FIG. 90 is an exemplary diagram for describing a case where a DP pattern array and a PP pattern array are formed in a line along a sub-direction.

As an example, as illustrated in FIG. 90, when the DP pattern array and the PP pattern array are formed in a line along the sub-direction, it is difficult to correct the toner density and the positional deviation on a real-time basis.

Further, in the above embodiment, all of the four density detection patterns DP1 to DP4 may be not formed in one paper interval portion. Similarly, all of the four positional deviation detection patterns PP1 to PP4 may be not formed in one paper interval portion.

For example, the density detection pattern DP1 and the positional deviation detection pattern PP1 may be formed in a paper interval portion between an m-th image and an (m+1)-th image on the transfer belt 2040, the density detection pattern DP2 and the positional deviation detection pattern PP2 may be formed in a paper interval portion between an (m+1)-th image and an (m+2)-th image on the transfer belt 2040, the density detection pattern DP3 and the positional deviation detection pattern PP3 may be formed in a paper interval portion between an (m+2)-th image and an (m+3)-th image on the transfer belt 2040, and the density detection pattern DP4 and the positional deviation detection pattern PP4 may be formed in a paper interval portion between an (m+3)-th image and an (m+4)-th image on the transfer belt 2040.

Furthermore, for example, a portion of the density detection pattern DP1 and a portion of the positional deviation detection pattern PP1 may be formed in a paper interval portion between an m-th image and an (m+1)-th image on the transfer belt 2040, and the remaining portion of the density detection pattern DP1 and the remaining portion of the positional deviation detection pattern PP1 may be formed in a paper interval portion between an (m+1)-th image and an (m+2)-th image on the transfer belt 2040.

Further, in the above embodiment, although a case where toner of four colors is used has been described, the present invention is not limited to this. For example, toner of five colors or six colors may be used.

Further, in the above embodiment, a case where the reflecting optical sensor 2245 detects the toner pattern on the transfer belt 2040 has been described, the present invention is not limited to this, and the reflecting optical sensor 2245 may detect the toner pattern on the surface of the photosensitive drum. The surface of the photosensitive drum is close to a regular reflector similarly to the transfer belt 2040.

Further, in the above embodiment, the toner pattern may be transferred to a recording sheet and the toner pattern on the recording sheet may be detected by the reflecting optical sensor 2245.

Further, in the above embodiment, although a case where the color printer 2000 is used as an image forming apparatus has been described, the present invention is not limited to this, and the image forming apparatus may be an image forming apparatus other than a printer such as a copying machine, a facsimile, or an MFP in which these are integrated.

According to the image forming apparatus of the embodiment, it is possible to shorten the time necessary for detecting a toner density and a positional deviation.

Although the invention has been described with respect to specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image on a moving body using toner, comprising:

a pattern creating device that creates a first pattern for toner density detection and a second pattern for positional deviation detection on the moving body so that the first pattern and second pattern are disposed to be arrayed in a second direction orthogonal to a first direction in which the moving body moves;

a reflecting optical sensor including an emitting system that includes at least three light-emitting elements of which positions at least in the second direction are different and a light-receiving system that includes at least three light-receiving elements that receive light beams that are emitted from the emitting system and reflected from the first pattern and second pattern; and a processing device that obtains toner density information and positional deviation information simultaneously based on an output signal of the light-receiving system.

2. The image forming apparatus according to claim 1, wherein the pattern creating device creates the first pattern and second pattern in a portion of the moving body outside a region where an image is formed.

3. The image forming apparatus according to claim 1, wherein the pattern creating device creates the first pattern and second pattern in a region that is interposed between two images formed on the moving body.

4. The image forming apparatus according to claim 1, wherein the pattern creating device adds a pattern position recognition toner patch that is illuminated with a light beam emitted from the emitting system in advance to at least one of the first pattern and second pattern, and the processing device estimates the position of the pattern in the second direction based on the output signal of the light-receiving system when the pattern position recognition toner patch is illuminated.

5. The image forming apparatus according to claim 1, wherein the processing device causes at least two of the at least three light-emitting elements to be lit or unlit sequentially.

6. The image forming apparatus according to claim 1, wherein the first pattern includes a plurality of toner patches, and the processing device causes at least two of the at least three light-emitting elements to be individually lit or unlit against each of the plurality of toner patches.

7. The image forming apparatus according to claim 1, wherein the first pattern includes a plurality of toner patches, and the processing device causes the same light-emitting element to be lit or unlit a plurality of number of times against each of the plurality of toner patches.

8. The image forming apparatus according to claim 1, wherein a diameter of a light beam that is emitted from the emitting system and that illuminates the first pattern and second pattern formed on the moving body is approximately the same as an interval of the at least three light-emitting elements in the second direction.

9. The image forming apparatus according to claim 1, wherein the moving body is of an intermediate transfer belt.

10. The image forming apparatus according to claim 1, wherein the moving body is of a photosensitive image carrier.

* * * * *